US011530833B2

(12) United States Patent
Tokudi et al.

(10) Patent No.: US 11,530,833 B2
(45) Date of Patent: Dec. 20, 2022

(54) SYSTEMS AND METHODS FOR CONTROLLING AND PREDICTING HEAT LOAD DISTURBANCES

(71) Applicant: Johnson Controls Technology Company, Auburn Hills, MI (US)

(72) Inventors: Mikihito Tokudi, Shizuoka (JP); Serdar Suindykov, Shizuoka (JP); Mohammad N. Elbsat, Milwaukee, WI (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 380 days.

(21) Appl. No.: 16/719,469

(22) Filed: Dec. 18, 2019

(65) Prior Publication Data

US 2021/0190355 A1 Jun. 24, 2021

(51) Int. Cl.
*F24F 11/47* (2018.01)
*F24F 11/48* (2018.01)
(Continued)

(52) U.S. Cl.
CPC ..... *F24F 11/47* (2018.01); *F24F 11/48* (2018.01); *F24F 11/88* (2018.01);
(Continued)

(58) Field of Classification Search
CPC ..... F24F 11/47–48; F24F 11/88; F24F 10/10; F24F 2120/10; F24F 2130/10; F24F 2130/20
(Continued)

(56) References Cited

U.S. PATENT DOCUMENTS 8,046,106 B2 * 10/2011 Tsai ..... H04L 67/12 236/1 C
8,645,495 B2 * 2/2014 Johnson ..... G05B 15/02 709/216

(Continued)

OTHER PUBLICATIONS

Batterman, Stuart. Review and Extension of CO2-Based Methods to Determine Ventilation Rates with Application to School Classrooms. International Journal of Environmental Research and Public Health. Feb. 4, 2017. 22 Pages.

(Continued)

*Primary Examiner* — Md Azad
(74) *Attorney, Agent, or Firm* — Foley & Lardner LLP

(57) ABSTRACT

An environmental control system for a building space including heating, ventilation, or air conditioning (HVAC) equipment that operates to control a temperature of the building space. The system includes lighting equipment that operates to control a luminosity and affect a heat load disturbance for the building space. The system includes an environmental controller including a processing circuit configured to predict the heat load disturbance based on potential operating states of the lighting equipment over a time period. The heat load disturbance affects the temperature of the building space. The processing circuit is configured to generate control decisions for the HVAC and lighting equipment based on the predicted heat load disturbance and subject to constraints on the temperature and luminosity of the building space. The processing circuit is configured to operate the HVAC and lighting equipment based on the control decisions.

20 Claims, 18 Drawing Sheets

(51) Int. Cl.

| | |
|---|---|
| ***F24F 11/88*** | (2018.01) |
| ***F24F 110/10*** | (2018.01) |
| ***F24F 130/20*** | (2018.01) |
| ***F24F 120/10*** | (2018.01) |
| ***F24F 130/10*** | (2018.01) |

(52) U.S. Cl.
CPC ..... *F24F 2110/10* (2018.01); *F24F 2120/10* (2018.01); *F24F 2130/10* (2018.01); *F24F 2130/20* (2018.01)

(58) Field of Classification Search
USPC ..... 700/276
See application file for complete search history.

(56) References Cited

U.S. PATENT DOCUMENTS

2014/0058566 A1* 2/2014 Rains, Jr. ..... G05B 15/02 700/276
2015/0234369 A1* 8/2015 Wen ..... H05B 39/042 700/278
2015/0316907 A1 11/2015 Elbsat et al.
2015/0355649 A1* 12/2015 Ovadia ..... G10L 17/22 704/233
2017/0104345 A1 4/2017 Wenzel et al.
2018/0285800 A1 10/2018 Wenzel et al.
2019/0316802 A1 10/2019 Alanqar et al.
2019/0384238 A1* 12/2019 Songkakul ..... G05B 15/02
2021/0003308 A1* 1/2021 Venne ..... F24F 11/64

OTHER PUBLICATIONS

Chen, Xiao; Wang, Qian; Srebric, Jelena. Occupant Feedback Based Model Predictive Control for Thermal Comfort and Energy Optimization: A Chamber Experimental Evaluation. Applied Energy 164. 2016, pp. 341-351.
Kang et al., Novel Modeling and Control Strategies for a HVAC System Including Carbon Dioxide Control. Jun. 2, 2014. 19 Pages.
Lampinen, Markku J. Thermodynamics of Humid Air. Sep. 2015. 39 Pages.
Ljung, L. (1999). System Identification: Theory for the User, 2nd ed. (Prentice Hall PTR, Upper Saddle River).
Luo, Xiaoyan. Maximizing Thermal Comfort and International Design. Loughborough University. Jan. 18, 2019. 4 Pages.
Sama Aghniaey et al., The Assumption of Equidistance in the Seven-Point Thermal Sensation Scale and a Comparison between Categorical and Continuous Metrics. University of Georgia College of Engineering, Jan. 18, 2019. 4 Pages.
Sudhakaran, Saurabh; Shaurette Mark. Temperature, Relative Humidity, and CarbonDioxide Modulation in a Near-Zero Energy Efficient Retrofit House. Purdue University. 2016, 11 Pages.
Weekly, Kevin et al., Modeling and Estimation of the Humans' Effect on the CO2 Dynamics Inside a Conference Room. IEEE Transactions on Control Systems Technology, vol. 23, No. 5, Sep. 2015, 12 pages.

* cited by examiner

SYSTEMS AND METHODS FOR CONTROLLING AND PREDICTING HEAT LOAD DISTURBANCES

BACKGROUND

The present disclosure relates generally to an environmental control system of a building. The present disclosure relates more particularly to an environmental control system that estimates heat load disturbances in order to maintain occupant comfort.

Maintaining occupant comfort in a building requires building equipment to be operated to change environmental conditions in the building. However, during operation, the building equipment may not be the only source of heat within the building. If other sources of heat are affecting the building, controlling the building equipment without consideration of the other sources of heat may result in uncomfortable conditions for occupants and/or may incur unnecessary costs.

SUMMARY

One implementation of the present disclosure is an environmental control system for a building space, according to some embodiments. The system includes heating, ventilation, or air conditioning (HVAC) equipment that operates to control a temperature of the building space by adding heat to the building space or removing heat from the building space, according to some embodiments. The system includes lighting equipment that operates to control a luminosity of the building space and affects a heat load disturbance for the building space, according to some embodiments. The system includes an environmental controller including a processing circuit, according to some embodiments. The processing circuit is configured to predict the heat load disturbance based on one or more potential operating states of the lighting equipment over a time period, according to some embodiments. The heat load disturbance affects the temperature of the building space, according to some embodiments. The processing circuit is configured to generate control decisions for the HVAC equipment and the lighting equipment based on the predicted heat load disturbance and subject to constraints on the temperature of the building space and the luminosity of the building space over the time period, according to some embodiments. The processing circuit is configured to operate the HVAC equipment and the lighting equipment based on the control decisions, according to some embodiments.

In some embodiments, the lighting equipment includes shading equipment that operates to affect a portion of the heat load disturbance originating from an external space.

In some embodiments, generating the control decisions for the HVAC equipment and the lighting equipment includes performing an optimization of an objective function that accounts for at least one of an amount of one or more resources consumed by the HVAC equipment and the lighting equipment or a cost of the one or more resources consumed by the HVAC equipment and the lighting equipment.

In some embodiments, the optimization includes identifying one or more periods of time during which the building space is scheduled to be occupied based on an occupancy schedule for the building space. The optimization includes predicting a portion of the heat load disturbance caused by occupants in the building space during the one or more periods of time, according to some embodiments.

In some embodiments, predicting the heat load disturbance includes determining one or more weather conditions outside the building space. The one or more weather conditions include at least one of a forecast of cloud cover or a forecast of solar intensity, according to some embodiments. Predicting the heat load disturbance includes predicting a portion of the heat load disturbance caused by the one or more weather conditions, according to some embodiments.

In some embodiments, the processing circuit is configured to predict the luminosity of the building space based on the control decisions for the lighting equipment. The lighting equipment includes electric lights that operate to affect the luminosity of the building space, according to some embodiments. The heat load disturbance comprises heat emitted due to operation of the electric lights, according to some embodiments. The processing circuit is configured to predict the temperature of the building space based on the control decisions for the HVAC equipment and the control decisions for the lighting equipment, according to some embodiments.

In some embodiments, predicting the heat load disturbance includes determining a number of occupants in the building space based on presence data from one or more occupancy sensors associated with the building space. Predicting the heat load disturbance includes estimating a portion of the heat load disturbance based on the number of occupants in the building space, according to some embodiments.

Another implementation of the present disclosure is a method for operating heating, ventilation, or air conditioning (HVAC) equipment and lighting equipment of a building space, according to some embodiments. The method includes predicting a heat load disturbance based on one or more potential operating states of the lighting equipment over a time period, according to some embodiments. The heat load disturbance affects a temperature of the building space, according to some embodiments. The lighting equipment operates to control a luminosity of the building space and affect the heat load disturbance, according to some embodiments. The method includes generating control decisions for the HVAC equipment and the lighting equipment based on the predicted heat load disturbance and subject to constraints on the temperature of the building space and the luminosity of the building space over the time period, according to some embodiments. The HVAC equipment operates to control the temperature of the building space by adding heat to the building space or removing heat from the building space, according to some embodiments. The method includes operating the HVAC equipment and the lighting equipment based on the control decisions, according to some embodiments.

In some embodiments, the lighting equipment includes shading equipment that operates to affect a portion of the heat load disturbance originating from an external space.

In some embodiments, generating the control decisions for the HVAC equipment and the lighting equipment includes performing an optimization of an objective function that accounts for at least one of an amount of one or more resources consumed by the HVAC equipment and the lighting equipment or a cost of the one or more resources consumed by the HVAC equipment and the lighting equipment.

In some embodiments, the optimization includes identifying one or more periods of time during which the building space is scheduled to be occupied based on an occupancy schedule for the building space. The optimization includes predicting a portion of the heat load disturbance caused by occupants in the building space during the one or more periods of time, according to some embodiments.

In some embodiments, predicting the heat load disturbance includes determining one or more weather conditions outside the building space. The one or more weather conditions include at least one of a forecast of cloud cover or a forecast of solar intensity, according to some embodiments. Predicting the heat load disturbance includes predicting a portion of the heat load disturbance caused by the one or more weather conditions, according to some embodiments.

In some embodiments, the method includes predicting the luminosity of the building space based on the control decisions for the lighting equipment. The lighting equipment includes electric lights that operate to affect the luminosity of the building space, according to some embodiments. The heat load disturbance includes heat emitted due to operation of the electric lights, according to some embodiments. The method includes predicting the temperature of the building space based on the control decisions for the HVAC equipment and the control decisions for the lighting equipment, according to some embodiments.

In some embodiments, predicting the heat load disturbance includes determining a number of occupants in the building space based on presence data from one or more occupancy sensors associated with the building space. Predicting the heat load disturbance includes estimating a portion of the heat load disturbance based on the number of occupants in the building space, according to some embodiments.

Another implementation of the present disclosure is an environmental controller for a building space, according to some embodiments. The controller includes one or more processors, according to some embodiments. The controller includes one or more non-transitory computer-readable media storing instructions that, when executed by the one or more processors, cause the one or more processors to perform operations, according to some embodiments. The operations include predicting a heat load disturbance affecting a temperature of the building space based on an operational state of lighting equipment, according to some embodiments. The operations include generating control decisions for both the lighting equipment and heating, ventilation, or air conditioning (HVAC) equipment by performing a coordinated control process comprising predicting an effect of the control decisions for the lighting equipment on the heat load disturbance and adjusting the control decisions for the HVAC equipment based on the predicted effect, according to some embodiments. The operations include operating the lighting equipment and the HVAC equipment based on the control decisions for the lighting equipment and the control decisions for the HVAC equipment, according to some embodiments.

In some embodiments, the lighting equipment includes at least one of shading equipment or electric lights. The shading equipment operates to affect an amount of solar radiation affecting the building space, according to some embodiments. The electric lights operate to affect the luminosity of the building space, according to some embodiments.

In some embodiments, the operations include determining a modified heat load disturbance value based on the predicted heat load disturbance and the predicted effect of the control decisions for the lighting equipment. The control decisions for the HVAC equipment are generated based on the modified heat load disturbance value, according to some embodiments.

In some embodiments, the control decisions for the lighting equipment are generated to proactively influence the heat load disturbance while maintaining a luminosity in the building space within a predetermined range.

In some embodiments, the coordinated control process includes performing an optimization of an objective function to generate the control decisions for both the lighting equipment and the HVAC equipment as results of the optimization. The objective function accounts for at least one of an amount of one or more resources consumed by the HVAC equipment and the lighting equipment or a cost of the one or more resources consumed by the HVAC equipment and the lighting equipment, according to some embodiments.

In some embodiments, the operations include identifying one or more periods of time during which the building space is scheduled to be occupied based on an occupancy schedule for the building space. The operations include predicting a portion of the heat load disturbance caused by occupants in the building space during the one or more periods of time, according to some embodiments.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Overview

Figure 1:
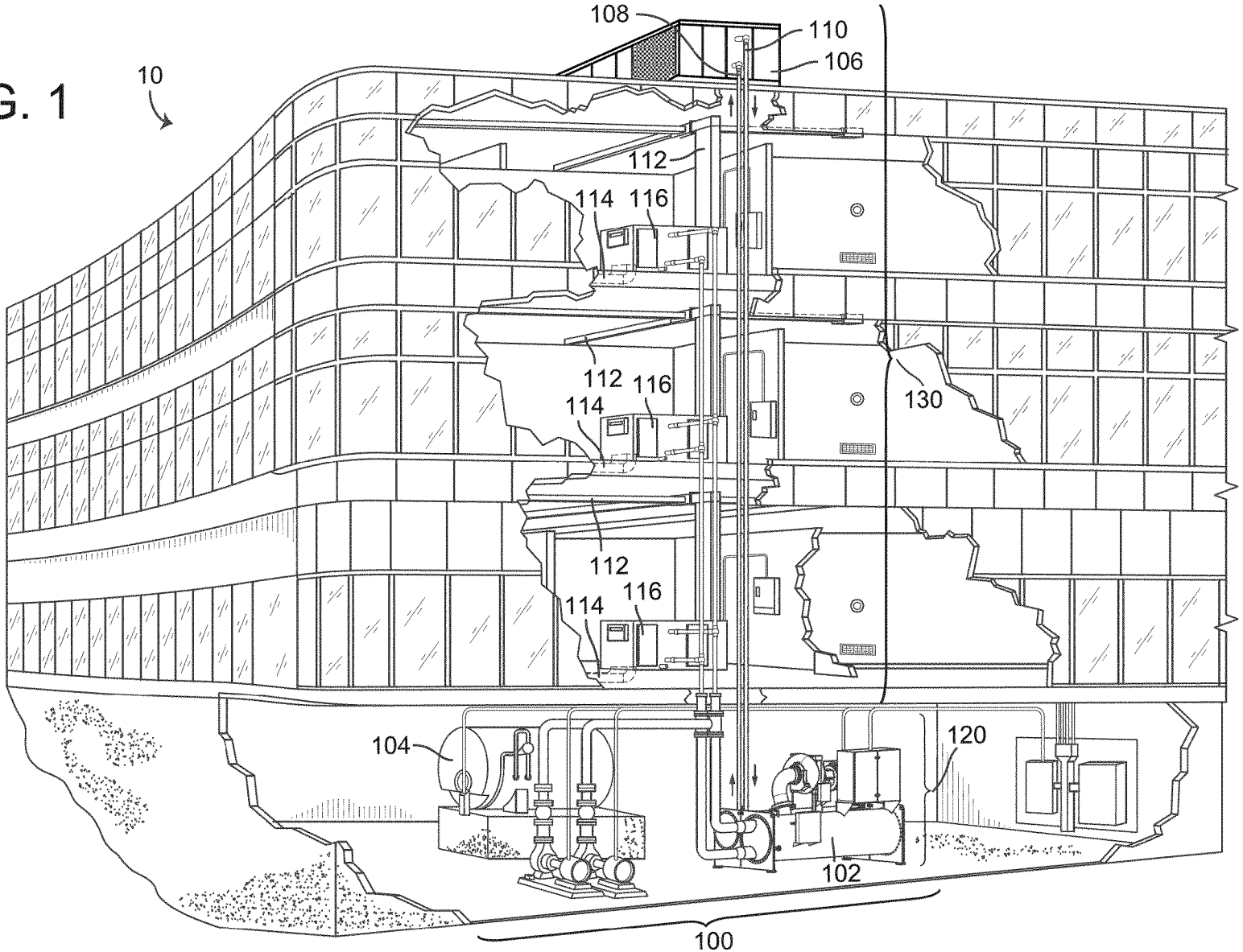
FIG. 1 is a drawing of a building equipped with a HVAC system, according to some embodiments.

Referring generally to the FIGURES, systems and methods for predicting and controlling heat load disturbances are shown, according to some embodiments. A heat load disturbance can affect impact environmental control systems by introducing heat from sources not controlled by the environmental control system. For example, solar radiation can cause a heat load disturbance that increases a temperature in a space of a building. As another example, people in the space can emit body heat, thereby increasing the temperature of the space without operation of building equipment (e.g., a heater, an air conditioner, etc.) of the space. If not appropriately handled, heat load disturbances can jeopardize comfort of occupants of the space. As such, systems and methods for maintaining occupant comfort while optimizing (e.g., reducing) costs by accounting for heat load disturbances are shown below.

An environmental controller and components thereof are shown below, according to some embodiments. The environmental controller can include an asset allocator configured to manage energy assets such as central plant equipment, battery storage, and other types of equipment configured to serve the energy loads of a building. The asset allocator can determine an optimal distribution of heating, cooling, electricity, and energy loads across different subplants (i.e., equipment groups) of the central plant capable of producing that type of energy.

In some embodiments, the asset allocator is configured to control the distribution, production, storage, and usage of resources in the central plant. The asset allocator can be configured to minimize the economic cost (or maximize the economic value) of operating the central plant over a duration of an optimization period. The economic cost may be defined by a cost function J(x) that expresses economic cost as a function of the control decisions made by the asset allocator. The cost function J(x) may account for the cost of resources purchased from various sources, as well as the revenue generated by selling resources (e.g., to an energy grid) or participating in incentive programs.

The asset allocator can be configured to define various sources, subplants, storage, and sinks. These four categories of objects define the assets of a central plant and their interaction with the outside world. Sources may include commodity markets or other suppliers from which resources such as electricity, water, natural gas, and other resources can be purchased or obtained. Sinks may include the requested loads of a building or campus as well as other types of resource consumers. Subplants are the main assets of a central plant. Subplants can be configured to convert resource types, making it possible to balance requested loads from a building or campus using resources purchased from the sources. Storage can be configured to store energy or other types of resources for later use.

In some embodiments, the asset allocator performs an optimization process determine an optimal set of control decisions for each time step within the optimization period. The control decisions may include, for example, an optimal amount of each resource to purchase from the sources, an optimal amount of each resource to produce or convert using the subplants, an optimal amount of each resource to store or remove from storage, an optimal amount of each resource to sell to resources purchasers, and/or an optimal amount of each resource to provide to other sinks. In some embodiments, the asset allocator is configured to optimally dispatch all campus energy assets (i.e., the central plant equipment) in order to meet the requested heating, cooling, and electrical loads of the campus for each time step within the optimization period.

In some embodiments, the asset allocator accounts for shading equipment when performing the optimization process. Based on the control decisions determined, the asset allocator can operate the shading equipment to control an amount of radiant heat entering the space. Further, the asset allocator can also account for occupancy schedules of a space when performing the optimization process. For example, the asset allocator may access an online calendar to determine when a space is scheduled to have meetings and can determine control decisions based on said determinations. These and other features of the asset allocator and the environmental controller are described in greater detail below.

In some embodiments, the systems and methods described herein can be extended to other types of equipment to predict and control other types of disturbances. For example, some equipment may generate carbon monoxide, carbon dioxide, particulate matter, and/or other air pollutants during operation. In this case, the systems and methods described herein can be utilized to predict and control a pollutant disturbance instead of or in addition to a heat load disturbance. The pollutant disturbance can be predicted as a function of operating decisions for equipment that produce the pollutant, by measuring pollutant levels in outdoor air used to ventilate the building, making predictions based on historical data, or any other prediction technique. The pollutant disturbance can be influenced by operating air purifiers to remove the pollutant from the air, controlling an amount of outside air used to ventilate the building, adjusting the operation of equipment that produces the pollutant, or any other pollutant control technique.

As another example, the systems and methods described herein can be applied to predict and control a humidity disturbance. In this case, the systems and methods described herein may account for occupant schedules, predict occupancy of building spaces at multiple times throughout a day, and predict a humidity disturbance due to moisturized air exhaled by occupants. In some embodiments, the humidity disturbance can be influenced by operating HVAC equipment that adds or removes humidity from the air as a primary function of the HVAC equipment or secondary function of the HVAC equipment (e.g., a side effect), adjusting an amount of outside air used to ventilate the building, or any other humidity control technique. Accordingly, it should be appreciated that the systems and methods described herein are not limited to heat load disturbances and can be applied to any type of disturbance for any type of environmental condition. This disclosure primarily references heat load disturbances for sake of example and clarity but should not be interpreted as being limited to heat load.

Building and HVAC System

Referring now to FIG. 1, a perspective view of a building 10 is shown. Building 10 can be served by a building management system (BMS). A BMS is, in general, a system of devices configured to control, monitor, and manage equipment in or around a building or building area. A BMS can include, for example, a HVAC system, a security system, a lighting system, a fire alerting system, any other system that is capable of managing building functions or devices, or any combination thereof. An example of a BMS which can be used to monitor and control building 10 is described in U.S. patent application Ser. No. 14/717,593 filed May 20, 2015, the entire disclosure of which is incorporated by reference herein.

The BMS that serves building 10 may include a HVAC system 100. HVAC system 100 can include a plurality of HVAC devices (e.g., heaters, chillers, air handling units, pumps, fans, thermal energy storage, etc.) configured to provide heating, cooling, ventilation, or other services for building 10. For example, HVAC system 100 is shown to include a waterside system 120 and an airside system 130. Waterside system 120 may provide a heated or chilled fluid to an air handling unit of airside system 130. Airside system 130 may use the heated or chilled fluid to heat or cool an airflow provided to building 10. In some embodiments, waterside system 120 can be replaced with or supplemented by a central plant or central energy facility (described in greater detail with reference to FIG. 2). An example of an airside system which can be used in HVAC system 100 is described in greater detail with reference to FIG. 3.

HVAC system 100 is shown to include a chiller 102, a boiler 104, and a rooftop air handling unit (AHU) 106. Waterside system 120 may use boiler 104 and chiller 102 to heat or cool a working fluid (e.g., water, glycol, etc.) and may circulate the working fluid to AHU 106. In various embodiments, the HVAC devices of waterside system 120 can be located in or around building 10 (as shown in FIG. 1) or at an offsite location such as a central plant (e.g., a chiller plant, a steam plant, a heat plant, etc.). The working fluid can be heated in boiler 104 or cooled in chiller 102, depending on whether heating or cooling is required in building 10. Boiler 104 may add heat to the circulated fluid, for example, by burning a combustible material (e.g., natural gas) or using an electric heating element. Chiller 102 may place the circulated fluid in a heat exchange relationship with another fluid (e.g., a refrigerant) in a heat exchanger (e.g., an evaporator) to absorb heat from the circulated fluid. The working fluid from chiller 102 and/or boiler 104 can be transported to AHU 106 via piping 108.

AHU 106 may place the working fluid in a heat exchange relationship with an airflow passing through AHU 106 (e.g., via one or more stages of cooling coils and/or heating coils). The airflow can be, for example, outside air, return air from within building 10, or a combination of both. AHU 106 may transfer heat between the airflow and the working fluid to provide heating or cooling for the airflow. For example, AHU 106 can include one or more fans or blowers configured to pass the airflow over or through a heat exchanger containing the working fluid. The working fluid may then return to chiller 102 or boiler 104 via piping 110.

Airside system 130 may deliver the airflow supplied by AHU 106 (i.e., the supply airflow) to building 10 via air supply ducts 112 and may provide return air from building 10 to AHU 106 via air return ducts 114. In some embodiments, airside system 130 includes multiple variable air volume (VAV) units 116. For example, airside system 130 is shown to include a separate VAV unit 116 on each floor or zone of building 10. VAV units 116 can include dampers or other flow control elements that can be operated to control an amount of the supply airflow provided to individual zones of building 10. In other embodiments, airside system 130 delivers the supply airflow into one or more zones of building 10 (e.g., via supply ducts 112) without using intermediate VAV units 116 or other flow control elements. AHU 106 can include various sensors (e.g., temperature sensors, pressure sensors, etc.) configured to measure attributes of the supply airflow. AHU 106 may receive input from sensors located within AHU 106 and/or within the building zone and may adjust the flow rate, temperature, or other attributes of the supply airflow through AHU 106 to achieve setpoint conditions for the building zone.

Central Plant

Figure 2:
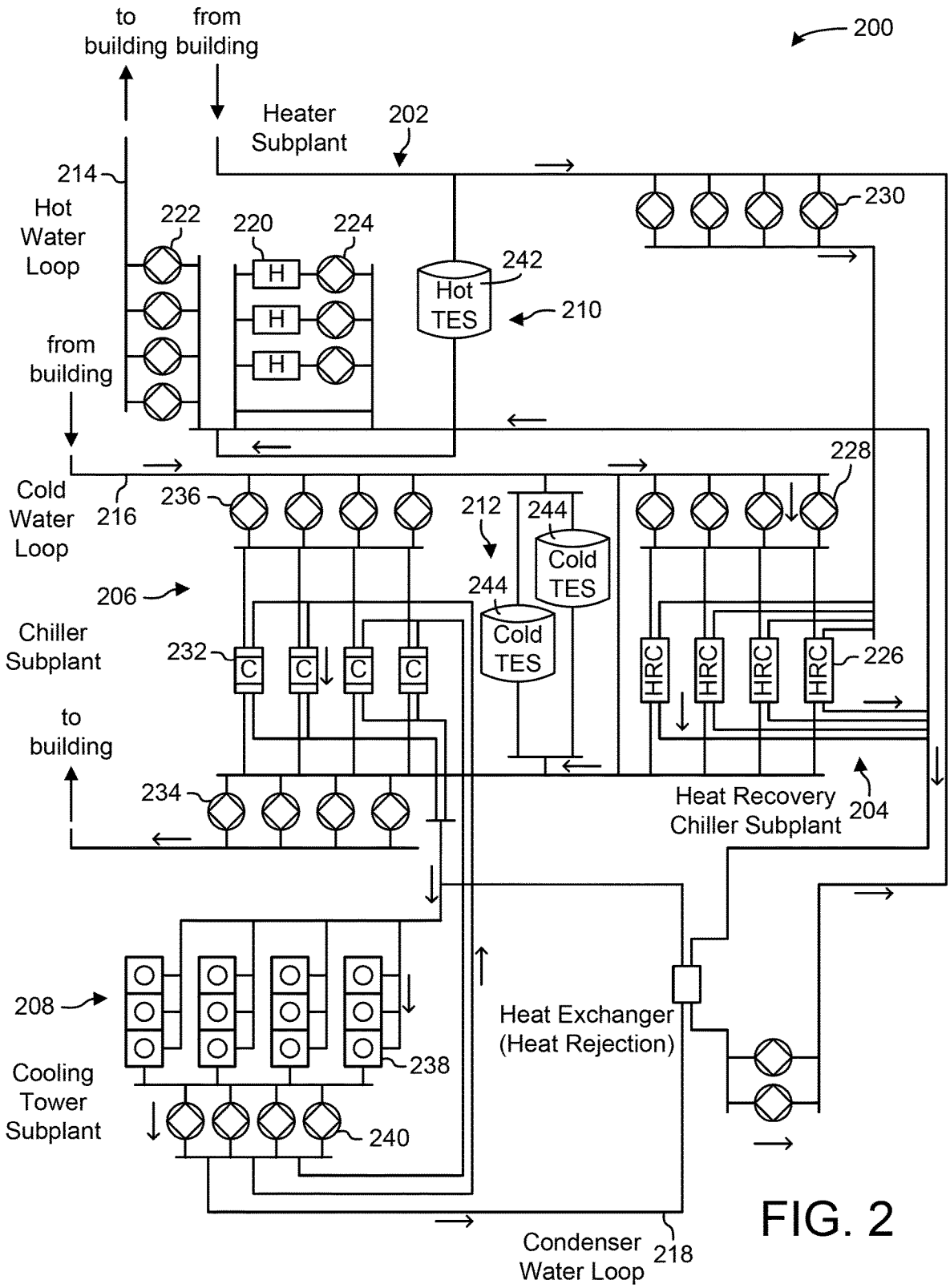
FIG. 2 is a block diagram of a central plant which can be used to serve the energy loads of the building of FIG. 1, according to some embodiments.

Referring now to FIG. 2, a block diagram of a central plant 200 is shown, according to some embodiments. In various embodiments, central plant 200 can supplement or replace waterside system 120 in HVAC system 100 or can be implemented separate from HVAC system 100. When implemented in HVAC system 100, central plant 200 can include a subset of the HVAC devices in HVAC system 100 (e.g., boiler 104, chiller 102, pumps, valves, etc.) and may operate to supply a heated or chilled fluid to AHU 106. The HVAC devices of central plant 200 can be located within building 10 (e.g., as components of waterside system 120) or at an offsite location such as a central energy facility that serves multiple buildings.

Central plant 200 is shown to include a plurality of subplants 202-208. Subplants 202-208 can be configured to convert energy or resource types (e.g., water, natural gas, electricity, etc.). For example, subplants 202-208 are shown to include a heater subplant 202, a heat recovery chiller subplant 204, a chiller subplant 206, and a cooling tower subplant 208. In some embodiments, subplants 202-208 consume resources purchased from utilities to serve the energy loads (e.g., hot water, cold water, electricity, etc.) of a building or campus. For example, heater subplant 202 can be configured to heat water in a hot water loop 214 that circulates the hot water between heater subplant 202 and building 10. Similarly, chiller subplant 206 can be configured to chill water in a cold water loop 216 that circulates the cold water between chiller subplant 206 building 10.

Heat recovery chiller subplant 204 can be configured to transfer heat from cold water loop 216 to hot water loop 214 to provide additional heating for the hot water and additional cooling for the cold water. Condenser water loop 218 may absorb heat from the cold water in chiller subplant 206 and reject the absorbed heat in cooling tower subplant 208 or transfer the absorbed heat to hot water loop 214. In various embodiments, central plant 200 can include an electricity subplant (e.g., one or more electric generators) configured to generate electricity or any other type of subplant configured to convert energy or resource types.

Hot water loop 214 and cold water loop 216 may deliver the heated and/or chilled water to air handlers located on the rooftop of building 10 (e.g., AHU 106) or to individual floors or zones of building 10 (e.g., VAV units 116). The air handlers push air past heat exchangers (e.g., heating coils or cooling coils) through which the water flows to provide heating or cooling for the air. The heated or cooled air can be delivered to individual zones of building 10 to serve thermal energy loads of building 10. The water then returns to subplants 202-208 to receive further heating or cooling.

Although subplants 202-208 are shown and described as heating and cooling water for circulation to a building, it is understood that any other type of working fluid (e.g., glycol, $CO_2$, etc.) can be used in place of or in addition to water to serve thermal energy loads. In other embodiments, subplants 202-208 may provide heating and/or cooling directly to the building or campus without requiring an intermediate heat transfer fluid. These and other variations to central plant 200 are within the teachings of the present disclosure.

Each of subplants 202-208 can include a variety of equipment configured to facilitate the functions of the subplant. For example, heater subplant 202 is shown to include a plurality of heating elements 220 (e.g., boilers, electric heaters, etc.) configured to add heat to the hot water in hot water loop 214. Heater subplant 202 is also shown to include several pumps 222 and 224 configured to circulate the hot water in hot water loop 214 and to control the flow rate of the hot water through individual heating elements 220. Chiller subplant 206 is shown to include a plurality of chillers 232 configured to remove heat from the cold water in cold water loop 216. Chiller subplant 206 is also shown to include several pumps 234 and 236 configured to circulate the cold water in cold water loop 216 and to control the flow rate of the cold water through individual chillers 232.

Heat recovery chiller subplant 204 is shown to include a plurality of heat recovery heat exchangers 226 (e.g., refrigeration circuits) configured to transfer heat from cold water loop 216 to hot water loop 214. Heat recovery chiller subplant 204 is also shown to include several pumps 228 and 230 configured to circulate the hot water and/or cold water through heat recovery heat exchangers 226 and to control the flow rate of the water through individual heat recovery heat exchangers 226. Cooling tower subplant 208 is shown to include a plurality of cooling towers 238 configured to remove heat from the condenser water in condenser water loop 218. Cooling tower subplant 208 is also shown to include several pumps 240 configured to circulate the condenser water in condenser water loop 218 and to control the flow rate of the condenser water through individual cooling towers 238.

In some embodiments, one or more of the pumps in central plant 200 (e.g., pumps 222, 224, 228, 230, 234, 236, and/or 240) or pipelines in central plant 200 include an isolation valve associated therewith. Isolation valves can be integrated with the pumps or positioned upstream or downstream of the pumps to control the fluid flows in central plant 200. In various embodiments, central plant 200 can include more, fewer, or different types of devices and/or subplants based on the particular configuration of central plant 200 and the types of loads served by central plant 200.

Still referring to FIG. 2, central plant 200 is shown to include hot thermal energy storage (TES) 210 and cold thermal energy storage (TES) 212. Hot TES 210 and cold TES 212 can be configured to store hot and cold thermal energy for subsequent use. For example, hot TES 210 can include one or more hot water storage tanks 242 configured to store the hot water generated by heater subplant 202 or heat recovery chiller subplant 204. Hot TES 210 may also include one or more pumps or valves configured to control the flow rate of the hot water into or out of hot TES tank 242.

Similarly, cold TES 212 can include one or more cold water storage tanks 244 configured to store the cold water generated by chiller subplant 206 or heat recovery chiller subplant 204. Cold TES 212 may also include one or more pumps or valves configured to control the flow rate of the cold water into or out of cold TES tanks 244. In some embodiments, central plant 200 includes electrical energy storage (e.g., one or more batteries) or any other type of device configured to store resources. The stored resources can be purchased from utilities, generated by central plant 200, or otherwise obtained from any source.

Airside System

Figure 3:
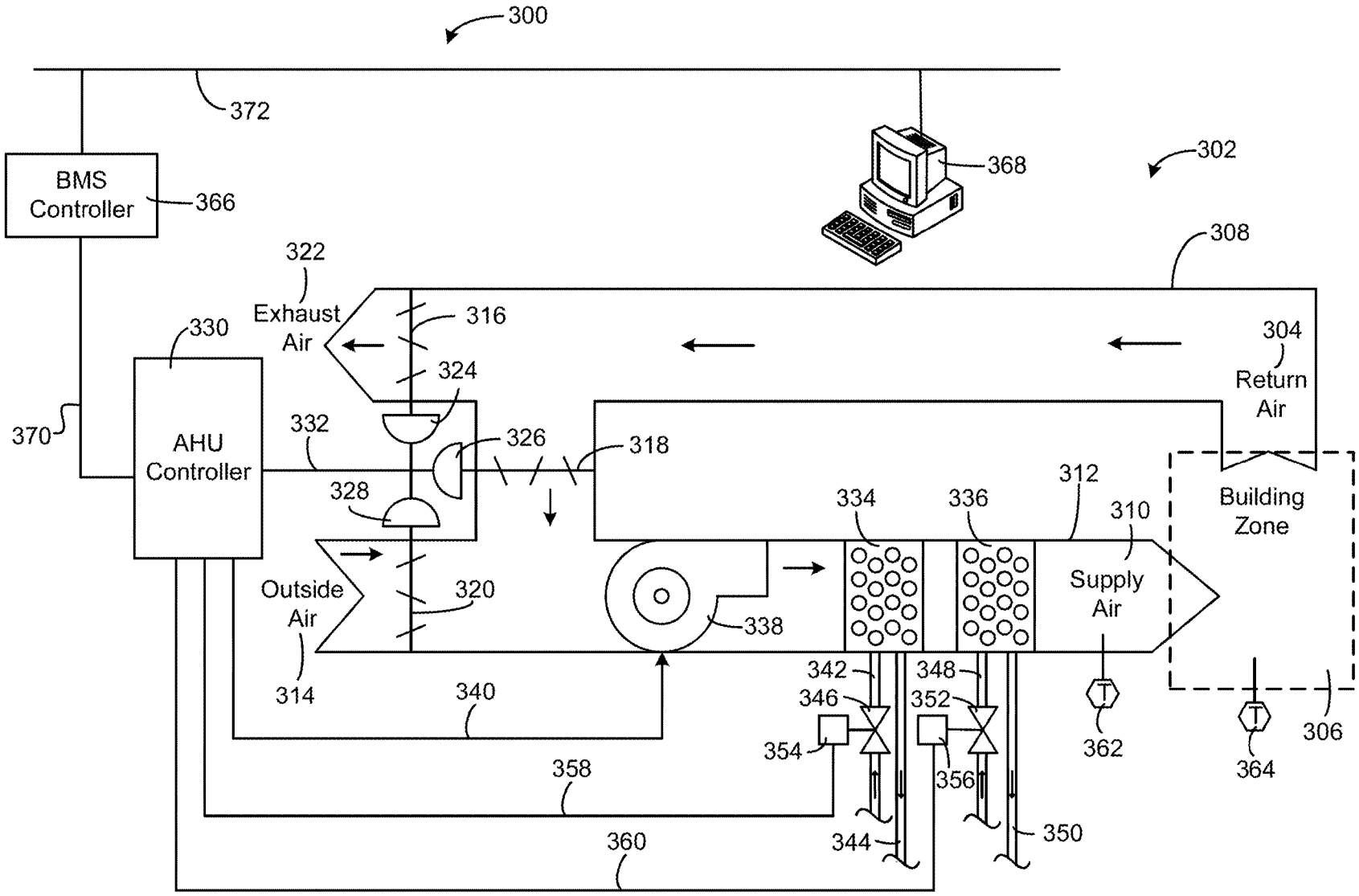
FIG. 3 is a block diagram of an airside system which can be implemented in the building of FIG. 1, according to some embodiments.

Referring now to FIG. 3, a block diagram of an airside system 300 is shown, according to some embodiments. In various embodiments, airside system 300 may supplement or replace airside system 130 in HVAC system 100 or can be implemented separate from HVAC system 100. When implemented in HVAC system 100, airside system 300 can include a subset of the HVAC devices in HVAC system 100 (e.g., AHU 106, VAV units 116, ducts 112-114, fans, dampers, etc.) and can be located in or around building 10. Airside system 300 may operate to heat or cool an airflow provided to building 10 using a heated or chilled fluid provided by central plant 200.

Airside system 300 is shown to include an economizer-type air handling unit (AHU) 302. Economizer-type AHUs vary the amount of outside air and return air used by the air handling unit for heating or cooling. For example, AHU 302 may receive return air 304 from building zone 306 via return air duct 308 and may deliver supply air 310 to building zone 306 via supply air duct 312. In some embodiments, AHU 302 is a rooftop unit located on the roof of building 10 (e.g., AHU 106 as shown in FIG. 1) or otherwise positioned to receive both return air 304 and outside air 314. AHU 302 can be configured to operate exhaust air damper 316, mixing damper 318, and outside air damper 320 to control an amount of outside air 314 and return air 304 that combine to form supply air 310. Any return air 304 that does not pass through mixing damper 318 can be exhausted from AHU 302 through exhaust damper 316 as exhaust air 322.

Each of dampers 316-320 can be operated by an actuator. For example, exhaust air damper 316 can be operated by actuator 324, mixing damper 318 can be operated by actuator 326, and outside air damper 320 can be operated by actuator 328. Actuators 324-328 may communicate with an AHU controller 330 via a communications link 332. Actuators 324-328 may receive control signals from AHU controller 330 and may provide feedback signals to AHU controller 330. Feedback signals can include, for example, an indication of a current actuator or damper position, an amount of torque or force exerted by the actuator, diagnostic information (e.g., results of diagnostic tests performed by actuators 324-328), status information, commissioning information, configuration settings, calibration data, and/or other types of information or data that can be collected, stored, or used by actuators 324-328. AHU controller 330 can be an economizer controller configured to use one or more control algorithms (e.g., state-based algorithms, extremum seeking control (ESC) algorithms, proportional-integral (PI) control algorithms, proportional-integral-derivative (PID) control algorithms, model predictive control (MPC) algorithms, feedback control algorithms, etc.) to control actuators 324-328.

Still referring to FIG. 3, AHU 302 is shown to include a cooling coil 334, a heating coil 336, and a fan 338 positioned within supply air duct 312. Fan 338 can be configured to force supply air 310 through cooling coil 334 and/or heating coil 336 and provide supply air 310 to building zone 306. AHU controller 330 may communicate with fan 338 via communications link 340 to control a flow rate of supply air 310. In some embodiments, AHU controller 330 controls an amount of heating or cooling applied to supply air 310 by modulating a speed of fan 338.

Cooling coil 334 may receive a chilled fluid from central plant 200 (e.g., from cold water loop 216) via piping 342 and may return the chilled fluid to central plant 200 via piping 344. Valve 346 can be positioned along piping 342 or piping 344 to control a flow rate of the chilled fluid through cooling coil 334. In some embodiments, cooling coil 334 includes multiple stages of cooling coils that can be independently activated and deactivated (e.g., by AHU controller 330, by BMS controller 366, etc.) to modulate an amount of cooling applied to supply air 310.

Heating coil 336 may receive a heated fluid from central plant 200 (e.g., from hot water loop 214) via piping 348 and may return the heated fluid to central plant 200 via piping 350. Valve 352 can be positioned along piping 348 or piping 350 to control a flow rate of the heated fluid through heating coil 336. In some embodiments, heating coil 336 includes multiple stages of heating coils that can be independently activated and deactivated (e.g., by AHU controller 330, by BMS controller 366, etc.) to modulate an amount of heating applied to supply air 310.

Each of valves 346 and 352 can be controlled by an actuator. For example, valve 346 can be controlled by actuator 354 and valve 352 can be controlled by actuator 356. Actuators 354-356 may communicate with AHU controller 330 via communications links 358-360. Actuators 354-356 may receive control signals from AHU controller 330 and may provide feedback signals to controller 330. In some embodiments, AHU controller 330 receives a measurement of the supply air temperature from a temperature sensor 362 positioned in supply air duct 312 (e.g., downstream of cooling coil 334 and/or heating coil 336). AHU controller 330 may also receive a measurement of the temperature of building zone 306 from a temperature sensor 364 located in building zone 306.

In some embodiments, AHU controller 330 operates valves 346 and 352 via actuators 354-356 to modulate an amount of heating or cooling provided to supply air 310 (e.g., to achieve a setpoint temperature for supply air 310 or to maintain the temperature of supply air 310 within a setpoint temperature range). The positions of valves 346 and 352 affect the amount of heating or cooling provided to supply air 310 by cooling coil 334 or heating coil 336 and may correlate with the amount of energy consumed to achieve a desired supply air temperature. AHU 330 may control the temperature of supply air 310 and/or building zone 306 by activating or deactivating coils 334-336, adjusting a speed of fan 338, or a combination of both.

Still referring to FIG. 3, airside system 300 is shown to include a building management system (BMS) controller 366 and a client device 368. BMS controller 366 can include one or more computer systems (e.g., servers, supervisory controllers, subsystem controllers, etc.) that serve as system level controllers, application or data servers, head nodes, or master controllers for airside system 300, central plant 200, HVAC system 100, and/or other controllable systems that serve building 10. BMS controller 366 may communicate with multiple downstream building systems or subsystems (e.g., HVAC system 100, a security system, a lighting system, central plant 200, etc.) via a communications link 370 according to like or disparate protocols (e.g., LON, BACnet, etc.). In various embodiments, AHU controller 330 and BMS controller 366 can be separate (as shown in FIG. 3) or integrated. In an integrated implementation, AHU controller 330 can be a software module configured for execution by a processor of BMS controller 366.

In some embodiments, AHU controller 330 receives information from BMS controller 366 (e.g., commands, setpoints, operating boundaries, etc.) and provides information to BMS controller 366 (e.g., temperature measurements, valve or actuator positions, operating statuses, diagnostics, etc.). For example, AHU controller 330 may provide BMS controller 366 with temperature measurements from temperature sensors 362-364, equipment on/off states, equipment operating capacities, and/or any other information that can be used by BMS controller 366 to monitor or control a variable state or condition within building zone 306.

Client device 368 can include one or more human-machine interfaces or client interfaces (e.g., graphical user interfaces, reporting interfaces, text-based computer interfaces, client-facing web services, web servers that provide pages to web clients, etc.) for controlling, viewing, or otherwise interacting with HVAC system 100, its subsystems, and/or devices. Client device 368 can be a computer workstation, a client terminal, a remote or local interface, or any other type of user interface device. Client device 368 can be a stationary terminal or a mobile device. For example, client device 368 can be a desktop computer, a computer server with a user interface, a laptop computer, a tablet, a smartphone, a PDA, or any other type of mobile or non-mobile device. Client device 368 may communicate with BMS controller 366 and/or AHU controller 330 via communications link 372.

Asset Allocation System

Figure 4:
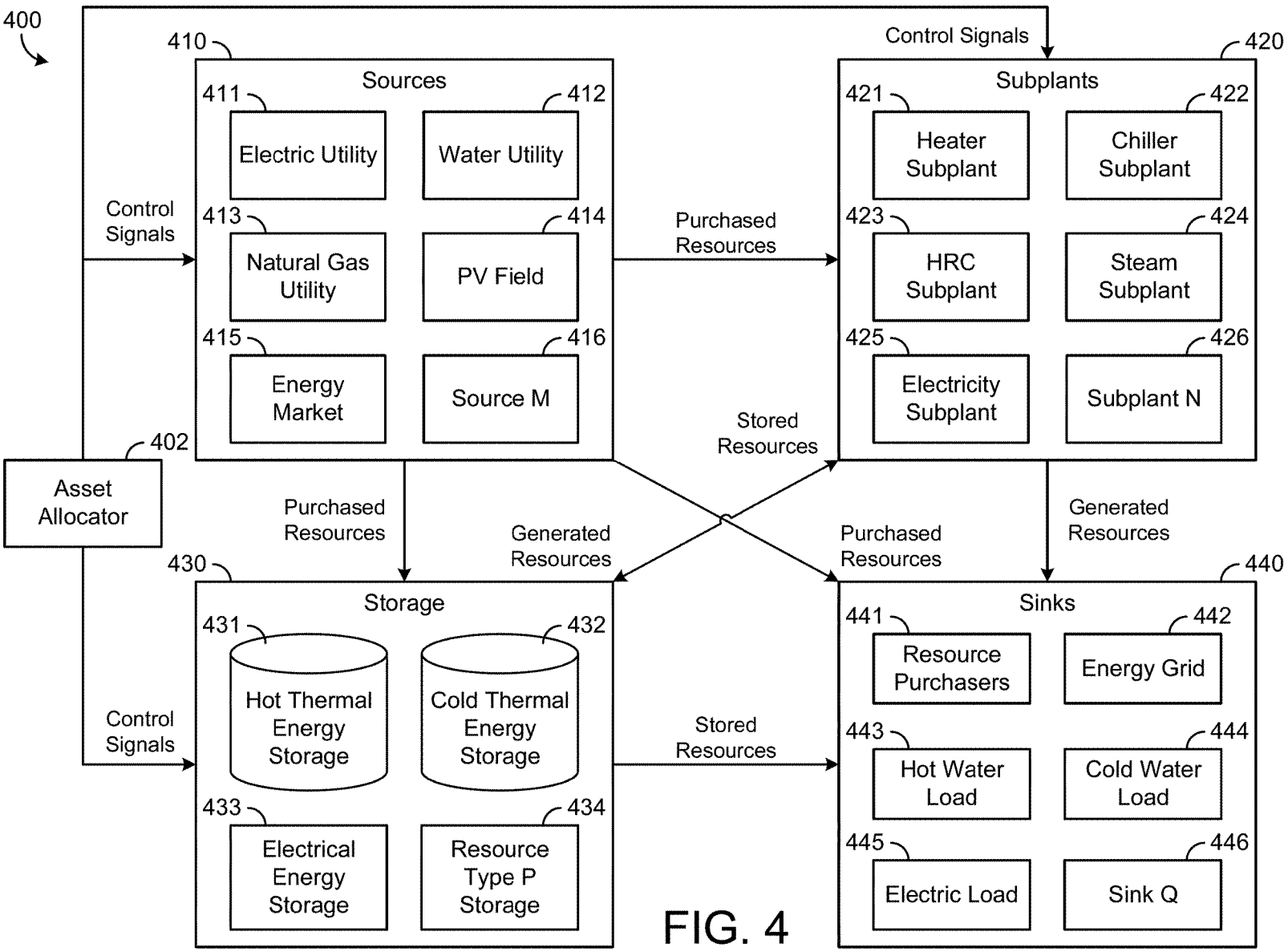
FIG. 4 is a block diagram of an asset allocation system including sources, subplants, storage, sinks, and an asset allocator configured to optimize the allocation of these assets, according to some embodiments.

Referring now to FIG. 4, a block diagram of an asset allocation system 400 is shown, according to an exemplary embodiment. Asset allocation system 400 can be configured to manage energy assets such as central plant equipment, battery storage, and other types of equipment configured to serve the energy loads of a building. Asset allocation system 400 can determine an optimal distribution of heating, cooling, electricity, and energy loads across different subplants (i.e., equipment groups) capable of producing that type of energy. In some embodiments, asset allocation system 400 is implemented as a component of central plant 200 and interacts with the equipment of central plant 200 in an online operational environment (e.g., performing real-time control of the central plant equipment). In other embodiments, asset allocation system 400 can be implemented as a component of a planning tool (described with reference to FIGS. 7-8) and can be configured to simulate the operation of a central plant over a predetermined time period for planning, budgeting, and/or design considerations.

Asset allocation system 400 is shown to include sources 410, subplants 420, storage 430, and sinks 440. These four categories of objects define the assets of a central plant and their interaction with the outside world. Sources 410 may include commodity markets or other suppliers from which resources such as electricity, water, natural gas, and other resources can be purchased or obtained. Sources 410 may provide resources that can be used by asset allocation system 400 to satisfy the demand of a building or campus. For example, sources 410 are shown to include an electric utility 411, a water utility 412, a natural gas utility 413, a photovoltaic (PV) field (e.g., a collection of solar panels), an energy market 415, and source M 416, where M is the total number of sources 410. Resources purchased from sources 410 can be used by subplants 420 to produce generated resources (e.g., hot water, cold water, electricity, steam, etc.), stored in storage 430 for later use, or provided directly to sinks 440.

Subplants 420 are the main assets of a central plant. Subplants 420 are shown to include a heater subplant 421, a chiller subplant 422, a heat recovery chiller subplant 423, a steam subplant 424, an electricity subplant 425, and subplant N, where N is the total number of subplants 420. In some embodiments, subplants 420 include some or all of the subplants of central plant 200, as described with reference to FIG. 2. For example, subplants 420 can include heater subplant 202, heat recovery chiller subplant 204, chiller subplant 206, and/or cooling tower subplant 208.

Subplants 420 can be configured to convert resource types, making it possible to balance requested loads from the building or campus using resources purchased from sources 410. For example, heater subplant 421 may be configured to generate hot thermal energy (e.g., hot water) by heating water using electricity or natural gas. Chiller subplant 422 may be configured to generate cold thermal energy (e.g., cold water) by chilling water using electricity. Heat recovery chiller subplant 423 may be configured to generate hot thermal energy and cold thermal energy by removing heat from one water supply and adding the heat to another water supply. Steam subplant 424 may be configured to generate steam by boiling water using electricity or natural gas. Electricity subplant 425 may be configured to generate electricity using mechanical generators (e.g., a steam turbine, a gas-powered generator, etc.) or other types of electricity-generating equipment (e.g., photovoltaic equipment, hydroelectric equipment, etc.).

The input resources used by subplants 420 may be provided by sources 410, retrieved from storage 430, and/or generated by other subplants 420. For example, steam subplant 424 may produce steam as an output resource. Electricity subplant 425 may include a steam turbine that uses the steam generated by steam subplant 424 as an input resource to generate electricity. The output resources produced by subplants 420 may be stored in storage 430, provided to sinks 440, and/or used by other subplants 420. For example, the electricity generated by electricity subplant 425 may be stored in electrical energy storage 433, used by chiller subplant 422 to generate cold thermal energy, used to satisfy the electric load 445 of a building, or sold to resource purchasers 441.

Storage 430 can be configured to store energy or other types of resources for later use. Each type of storage within storage 430 may be configured to store a different type of resource. For example, storage 430 is shown to include hot thermal energy storage 431 (e.g., one or more hot water storage tanks), cold thermal energy storage 432 (e.g., one or more cold thermal energy storage tanks), electrical energy storage 433 (e.g., one or more batteries), and resource type P storage 434, where P is the total number of storage 430. In some embodiments, storage 430 include some or all of the storage of central plant 200, as described with reference to FIG. 2. In some embodiments, storage 430 includes the heat capacity of the building served by the central plant. The resources stored in storage 430 may be purchased directly from sources or generated by subplants 420.

In some embodiments, storage 430 is used by asset allocation system 400 to take advantage of price-based demand response (PBDR) programs. PBDR programs encourage consumers to reduce consumption when generation, transmission, and distribution costs are high. PBDR programs are typically implemented (e.g., by sources 410) in the form of energy prices that vary as a function of time. For example, some utilities may increase the price per unit of electricity during peak usage hours to encourage customers to reduce electricity consumption during peak times. Some utilities also charge consumers a separate demand charge based on the maximum rate of electricity consumption at any time during a predetermined demand charge period.

Advantageously, storing energy and other types of resources in storage 430 allows for the resources to be purchased at times when the resources are relatively less expensive (e.g., during non-peak electricity hours) and stored for use at times when the resources are relatively more expensive (e.g., during peak electricity hours). Storing resources in storage 430 also allows the resource demand of the building or campus to be shifted in time. For example, resources can be purchased from sources 410 at times when the demand for heating or cooling is low and immediately converted into hot or cold thermal energy by subplants 420. The thermal energy can be stored in storage 430 and retrieved at times when the demand for heating or cooling is high. This allows asset allocation system 400 to smooth the resource demand of the building or campus and reduces the maximum required capacity of subplants 420. Smoothing the demand also asset allocation system 400 to reduce the peak electricity consumption, which results in a lower demand charge.

In some embodiments, storage 430 is used by asset allocation system 400 to take advantage of incentive-based demand response (IBDR) programs. IBDR programs provide incentives to customers who have the capability to store energy, generate energy, or curtail energy usage upon request. Incentives are typically provided in the form of monetary revenue paid by sources 410 or by an independent service operator (ISO). IBDR programs supplement traditional utility-owned generation, transmission, and distribution assets with additional options for modifying demand load curves. For example, stored energy can be sold to resource purchasers 441 or an energy grid 442 to supplement the energy generated by sources 410. In some instances, incentives for participating in an IBDR program vary based on how quickly a system can respond to a request to change power output/consumption. Faster responses may be compensated at a higher level. Advantageously, electrical energy storage 433 allows system 400 to quickly respond to a request for electric power by rapidly discharging stored electrical energy to energy grid 442.

Sinks 440 may include the requested loads of a building or campus as well as other types of resource consumers. For example, sinks 440 are shown to include resource purchasers 441, an energy grid 442, a hot water load 443, a cold water load 444, an electric load 445, and sink Q, where Q is the total number of sinks 440. A building may consume various resources including, for example, hot thermal energy (e.g., hot water), cold thermal energy (e.g., cold water), and/or electrical energy. In some embodiments, the resources are consumed by equipment or subsystems within the building (e.g., HVAC equipment, lighting, computers and other electronics, etc.). The consumption of each sink 440 over the optimization period can be supplied as an input to asset allocation system 400 or predicted by asset allocation system 400. Sinks 440 can receive resources directly from sources 410, from subplants 420, and/or from storage 430.

Still referring to FIG. 4, asset allocation system 400 is shown to include an asset allocator 402. Asset allocator 402 may be configured to control the distribution, production, storage, and usage of resources in asset allocation system 400. In some embodiments, asset allocator 402 performs an optimization process determine an optimal set of control decisions for each time step within an optimization period. The control decisions may include, for example, an optimal amount of each resource to purchase from sources 410, an optimal amount of each resource to produce or convert using subplants 420, an optimal amount of each resource to store or remove from storage 430, an optimal amount of each resource to sell to resources purchasers 441 or energy grid 440, and/or an optimal amount of each resource to provide to other sinks 440. In some embodiments, the control decisions include an optimal amount of each input resource and output resource for each of subplants 420.

In some embodiments, asset allocator 402 is configured to optimally dispatch all campus energy assets in order to meet the requested heating, cooling, and electrical loads of the campus for each time step within an optimization horizon or optimization period of duration h. Instead of focusing on only the typical HVAC energy loads, the concept is extended to the concept of resource. Throughout this disclosure, the term "resource" is used to describe any type of commodity purchased from sources 410, used or produced by subplants 420, stored or discharged by storage 430, or consumed by sinks 440. For example, water may be considered a resource that is consumed by chillers, heaters, or cooling towers during operation. This general concept of a resource can be extended to chemical processing plants where one of the resources is the product that is being produced by the chemical processing plat.

Asset allocator 402 can be configured to operate the equipment of asset allocation system 400 to ensure that a resource balance is maintained at each time step of the optimization period. This resource balance is shown in the following equation:

$$\Sigma x_{time}=0 \forall \text{resources}, \forall \text{time} \in \text{horizon}$$

where the sum is taken over all producers and consumers of a given resource (i.e., all of sources 410, subplants 420, storage 430, and sinks 440) and time is the time index. Each time element represents a period of time during which the resource productions, requests, purchases, etc. are assumed constant. Asset allocator 402 may ensure that this equation is satisfied for all resources regardless of whether that resource is required by the building or campus. For example, some of the resources produced by subplants 420 may be intermediate resources that function only as inputs to other subplants 420.

In some embodiments, the resources balanced by asset allocator 402 include multiple resources of the same type (e.g., multiple chilled water resources, multiple electricity resources, etc.). Defining multiple resources of the same type may allow asset allocator 402 to satisfy the resource balance given the physical constraints and connections of the central plant equipment. For example, suppose a central plant has multiple chillers and multiple cold water storage tanks, with each chiller physically connected to a different cold water storage tank (i.e., chiller A is connected to cold water storage tank A, chiller B is connected to cold water storage tank B, etc.). Given that only one chiller can supply cold water to each cold water storage tank, a different cold water resource can be defined for the output of each chiller. This allows asset allocator 402 to ensure that the resource balance is satisfied for each cold water resource without attempting to allocate resources in a way that is physically impossible (e.g., storing the output of chiller A in cold water storage tank B, etc.).

Asset allocator 402 may be configured to minimize the economic cost (or maximize the economic value) of operating asset allocation system 400 over the duration of the optimization period. The economic cost may be defined by a cost function J(x) that expresses economic cost as a function of the control decisions made by asset allocator 402. The cost function J(x) may account for the cost of resources purchased from sources 410, as well as the revenue generated by selling resources to resource purchasers 441 or energy grid 442 or participating in incentive programs. The cost optimization performed by asset allocator 402 can be expressed as:

$$\arg\min_{x} J(x)$$

where J(x) is defined as follows:

$$J(x) = \sum_{sources} \sum_{horizon} \text{cost}(\text{purchase}_{resource,time}, \text{time}) \sum_{incentives} \sum_{horizon} \text{revenue}(ReservationAmount)$$

The first term in the cost function J(x) represents the total cost of all resources purchased over the optimization horizon. Resources can include, for example, water, electricity, natural gas, or other types of resources purchased from a utility or other source 410. The second term in the cost function J(x) represents the total revenue generated by participating in incentive programs (e.g., IBDR programs) over the optimization horizon. The revenue may be based on the amount of power reserved for participating in the incentive programs. Accordingly, the total cost function represents the total cost of resources purchased minus any revenue generated from participating in incentive programs.

Each of subplants 420 and storage 430 may include equipment that can be controlled by asset allocator 402 to optimize the performance of asset allocation system 400. Subplant equipment may include, for example, heating devices, chillers, heat recovery heat exchangers, cooling towers, energy storage devices, pumps, valves, and/or other devices of subplants 420 and storage 430. Individual devices of subplants 420 can be turned on or off to adjust the resource production of each subplant 420. In some embodiments, individual devices of subplants 420 can be operated at variable capacities (e.g., operating a chiller at 10% capacity or 60% capacity) according to an operating setpoint received from asset allocator 402. Asset allocator 402 can control the equipment of subplants 420 and storage 430 to adjust the amount of each resource purchased, consumed, and/or produced by system 400.

In some embodiments, asset allocator 402 minimizes the cost function while participating in PBDR programs, IBDR programs, or simultaneously in both PBDR and IBDR programs. For the IBDR programs, asset allocator 402 may use statistical estimates of past clearing prices, mileage ratios, and event probabilities to determine the revenue generation potential of selling stored energy to resource purchasers 441 or energy grid 442. For the PBDR programs, asset allocator 402 may use predictions of ambient conditions, facility thermal loads, and thermodynamic models of installed equipment to estimate the resource consumption of subplants 420. Asset allocator 402 may use predictions of the resource consumption to monetize the costs of running the equipment.

Asset allocator 402 may automatically determine (e.g., without human intervention) a combination of PBDR and/or IBDR programs in which to participate over the optimization horizon in order to maximize economic value. For example, asset allocator 402 may consider the revenue generation potential of IBDR programs, the cost reduction potential of PBDR programs, and the equipment maintenance/replacement costs that would result from participating in various combinations of the IBDR programs and PBDR programs. Asset allocator 402 may weigh the benefits of participation against the costs of participation to determine an optimal combination of programs in which to participate. Advantageously, this allows asset allocator 402 to determine an optimal set of control decisions that maximize the overall value of operating asset allocation system 400.

In some embodiments, asset allocator 402 optimizes the cost function J(x) subject to the following constraint, which guarantees the balance between resources purchased, produced, discharged, consumed, and requested over the optimization horizon:

$$\sum_{sources} \text{purchase}_{resource,time} + \sum_{subplants} \text{produces}(x_{internal,time} x_{external,time}, v_{uncontrolled,time}) - \sum_{subplants} \text{consumes}(x_{internal,time} x_{external,time}, v_{uncontrolled,time}) + \sum_{storages} \text{discharges}_{resource}(x_{internal,time} x_{external,time}) - \sum_{sinks} \text{requests}_{resource} = 0$$

$$\forall \text{ resources}, \forall \text{ time} \in \text{horizon}$$

where $x_{internal,time}$ includes internal decision variables (e.g., load allocated to each component of asset allocation system 400), $x_{external,time}$ includes external decision variables (e.g., condenser water return temperature or other shared variables across subplants 420), and $v_{uncontrolled,time}$ includes uncontrolled variables (e.g., weather conditions).

The first term in the previous equation represents the total amount of each resource (e.g., electricity, water, natural gas, etc.) purchased from each source 410 over the optimization horizon. The second and third terms represent the total production and consumption of each resource by subplants 420 over the optimization horizon. The fourth term represents the total amount of each resource discharged from storage 430 over the optimization horizon. Positive values indicate that the resource is discharged from storage 430, whereas negative values indicate that the resource is charged or stored. The fifth term represents the total amount of each resource requested by sinks 440 over the optimization horizon. Accordingly, this constraint ensures that the total amount of each resource purchased, produced, or discharged from storage 430 is equal to the amount of each resource consumed, stored, or provided to sinks 440.

In some embodiments, additional constraints exist on the regions in which subplants 420 can operate. Examples of such additional constraints include the acceptable space (i.e., the feasible region) for the decision variables given the uncontrolled conditions, the maximum amount of a resource that can be purchased from a given source 410, and any number of plant-specific constraints that result from the mechanical design of the plant. In some embodiments, asset allocator 402 is configured to generate and impose the additional constraints as described in U.S. patent application Ser. No. 15/473,496 filed Mar. 29, 2017, the entirety of which is incorporated herein by reference.

Asset allocator 402 may include a variety of features that enable the application of asset allocator 402 to nearly any central plant, central energy facility, combined heating and cooling facility, or combined heat and power facility. These features include broadly applicable definitions for subplants 420, sinks 440, storage 430, and sources 410; multiples of the same type of subplant 420 or sink 440; subplant resource connections that describe which subplants 420 can send resources to which sinks 440 and at what efficiency; subplant minimum turndown into the asset allocation optimization; treating electrical energy as any other resource that must be balanced; constraints that can be commissioned during runtime; different levels of accuracy at different points in the horizon; setpoints (or other decisions) that are shared between multiple subplants included in the decision vector; disjoint subplant operation regions; incentive based electrical energy programs; and high level airside models. Incorporation of these features may allow asset allocator 402 to support a majority of the central energy facilities that will be seen in the future. Additionally, it will be possible to rapidly adapt to the inclusion of new subplant types. Some of these features are described in greater detail below.

Broadly applicable definitions for subplants 420, sinks 440, storage 430, and sources 410 allow each of these components to be described by the mapping from decision variables to resources consume and resources produced. Resources and other components of system 400 do not need to be "typed," but rather can be defined generally. The mapping from decision variables to resource consumption and production can change based on extrinsic conditions. Asset allocator 420 can solve the optimization problem by simply balancing resource use and can be configured to solve in terms of consumed resource 1, consumed resource 2, produced resource 1, etc., rather than electricity consumed, water consumed, and chilled water produced. Such an interface at the high level allows for the mappings to be injected into asset allocation system 400 rather than needing them hard coded. Of course, "typed" resources and other components of system 400 can still exist in order to generate the mapping at run time, based on equipment out of service.

Incorporating multiple subplants 420 or sinks 440 of the same type allows for modeling the interconnections between subplants 420, sources 410, storage 430, and sinks 440. This type of modeling describes which subplants 420 can use resource from which sources 410 and which subplants 420 can send resources to which sinks 440. This can be visualized as a resource connection matrix (i.e., a directed graph) between the subplants 420, sources 410, sinks 440, and storage 430. Examples of such directed graphs are described in greater detail with reference to FIGS. 5A-5B. Extending this concept, it is possible to include costs for delivering the resource along a connection and also, efficiencies of the transmission (e.g., amount of energy that makes it to the other side of the connection).

In some instances, constraints arise due to mechanical problems after an energy facility has been built. Accordingly, these constraints are site specific and are often not incorporated into the main code for any of subplants 420 or the high level problem itself. Commissioned constraints allow for such constraints to be added without software updates during the commissioning phase of the project. Furthermore, if these additional constraints are known prior to the plant build, they can be added to the design tool run. This would allow the user to determine the cost of making certain design decisions.

Incorporating minimum turndown and allowing disjoint operating regions may greatly enhance the accuracy of the asset allocation problem solution as well as decrease the number of modifications to solution of the asset allocation by the low level optimization or another post-processing technique. It may be beneficial to allow for certain features to change as a function of time into the horizon. One could use the full disjoint range (most accurate) for the first four hours, then switch to only incorporating the minimum turndown for the next two days, and finally using to the linear relaxation with no binary constraints for the rest of the horizon. For example, asset allocator 402 can be given the operational domain that correctly allocates three chillers with a range of 1800 to 2500 tons. The true subplant range is then the union of [1800, 2500], [3600, 5000], and [5400, 7500]. If the range were approximated as [1800, 7500] the low level optimization or other post-processing technique would have to rebalance any solution between 2500 and 3600 or between 5000 and 5400 tons. Rebalancing is typically done heuristically and is unlikely to be optimal. Incorporating these disjoint operational domains adds binary variables to the optimization problem (described in greater detail below).

Some decisions made by asset allocator 402 may be shared by multiple elements of system 400. The condenser water setpoint of cooling towers is an example. It is possible to assume that this variable is fixed and allow the low level optimization to decide on its value. However, this does not allow one to make a trade-off between the chiller's electrical use and the tower's electrical use, nor does it allow the optimization to exceed the chiller's design load by feeding it cooler condenser water. Incorporating these extrinsic decisions into asset allocator 402 allows for a more accurate solution at the cost of computational time.

Incentive programs often require the reservation of one or more assets for a period of time. In traditional systems, these assets are typically turned over to alternative control, different than the typical resource price based optimization. Advantageously, asset allocator 402 can be configured to add revenue to the cost function per amount of resource reserved. Asset allocator 402 can then make the reserved portion of the resource unavailable for typical price based cost optimization. For example, asset allocator 402 can reserve a portion of a battery asset for frequency response. In this case, the battery can be used to move the load or shave the peak demand, but can also be reserved to participate in the frequency response program.

Plant Resource Diagrams

Figure 5A:
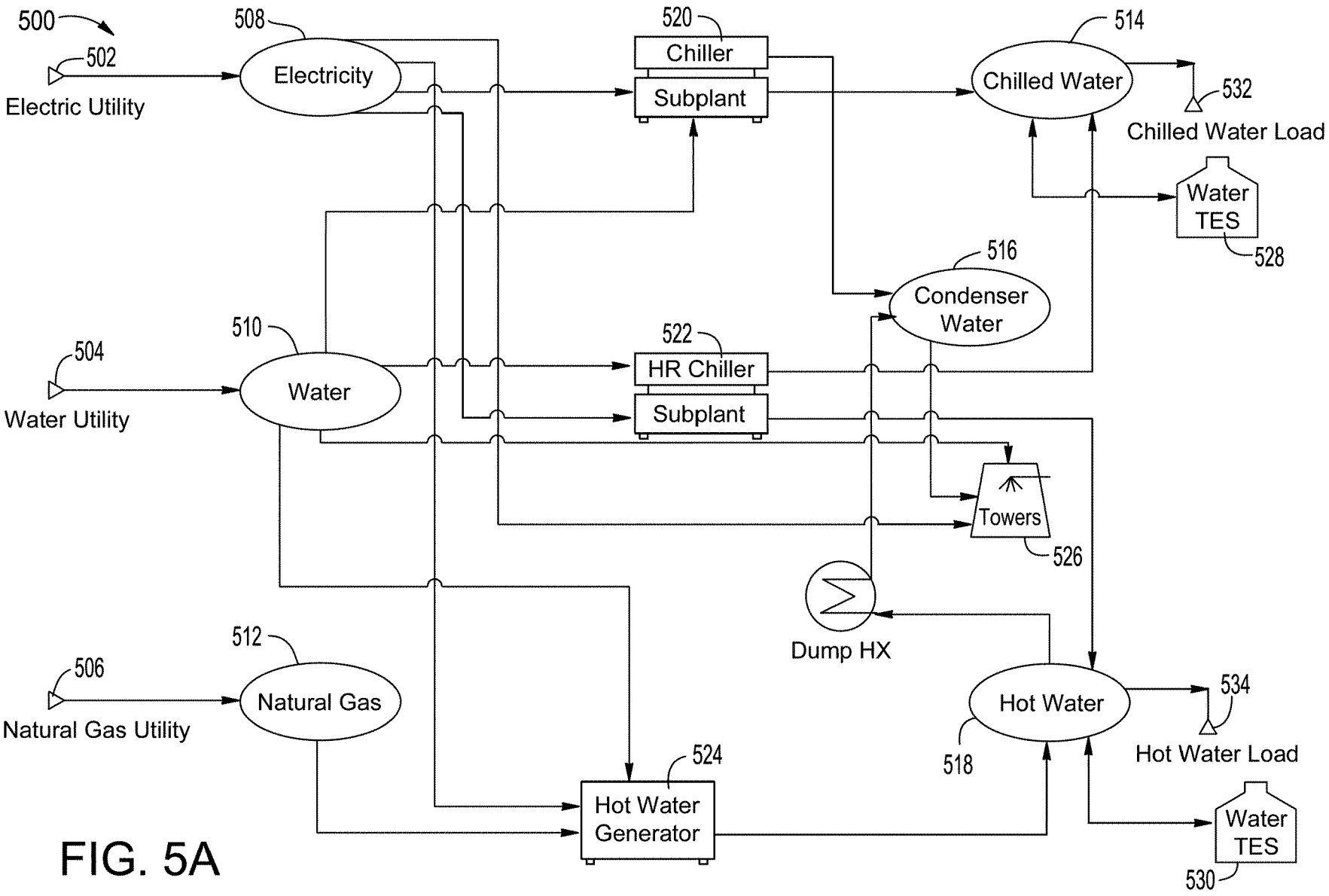
FIG. 5A is a plant resource diagram illustrating the elements of a central plant and the connections between such elements, according to some embodiments.

Referring now to FIG. 5A, a plant resource diagram 500 is shown, according to an exemplary embodiment. Plant resource diagram 500 represents a particular implementation of a central plant and indicates how the equipment of the central plant are connected to each other and to external systems or devices. Asset allocator 402 can use plant resource diagram 500 to identify the interconnections between various sources 410, subplants 420, storage 430, and sinks 440 in the central plant. In some instances, the interconnections defined by diagram 500 are not capable of being inferred based on the type of resource produced. For this reason, plant resource diagram 500 may provide asset allocator 402 with new information that can be used to establish constraints on the asset allocation problem.

Plant resource diagram 500 is shown to include an electric utility 502, a water utility 504, and a natural gas utility 506. Utilities 502-506 are examples of sources 410 that provide resources to the central plant. For example, electric utility 502 may provide an electricity resource 508, water utility 504 may provide a water resource 510, and natural gas utility 506 may provide a natural gas resource 512. The lines connecting utilities 502-506 to resources 508-512 along with the directions of the lines (i.e., pointing toward resources 508-512) indicate that resources purchased from utilities 502-506 add to resources 508-512.

Plant resource diagram 500 is shown to include a chiller subplant 520, a heat recovery (HR) chiller subplant 522, a hot water generator subplant 524, and a cooling tower subplant 526. Subplants 520-526 are examples of subplants 420 that convert resource types (i.e., convert input resources to output resources). For example, the lines connecting electricity resource 508 and water resource 510 to chiller subplant 520 indicate that chiller subplant 520 receives electricity resource 508 and water resource 510 as input resources. The lines connecting chiller subplant 520 to chilled water resource 514 and condenser water resource 516 indicate that chiller subplant 520 produces chilled water resource 514 and condenser water resource 516. Similarly, the lines connecting electricity resource 508 and water resource 510 to HR chiller subplant 522 indicate that HR chiller subplant 522 receives electricity resource 508 and water resource 510 as input resources. The lines connecting HR chiller subplant 522 to chilled water resource 514 and hot water resource 518 indicate that HR chiller subplant 522 produces chilled water resource 514 and hot water resource 518.

Plant resource diagram 500 is shown to include water TES 528 and 530. Water TES 528-530 are examples of storage 530 that can be used to store and discharge resources. The line connecting chilled water resource 514 to water TES 528 indicates that water TES 528 stores and discharges chilled water resource 514. Similarly, the line connecting hot water resource 518 to water TES 530 indicates that water TES 530 stores and discharges hot water resource 518. In diagram 500, water TES 528 is connected to only chilled water resource 514 and not to any of the other water resources 516 or 518. This indicates that water TES 528 can be used by asset allocator 402 to store and discharge only chilled water resource 514 and not the other water resources 516 or 518. Similarly, water TES 530 is connected to only hot water resource 518 and not to any of the other water resources 514 or 516. This indicates that water TES 530 can be used by asset allocator 402 to store and discharge only hot water resource 518 and not the other water resources 514 or 516.

Plant resource diagram 500 is shown to include a chilled water load 532 and a hot water load 534. Loads 532-534 are examples of sinks 440 that consume resources. The line connecting chilled water load 532 to chilled water resource 514 indicates that chilled water resource 514 can be used to satisfy chilled water load 532. Similarly, the line connecting hot water load 534 to hot water resource 518 indicates that hot water resource 518 can be used to satisfy hot water load 534. Asset allocator 402 can use the interconnections and limitations defined by plant resource diagram 500 to establish appropriate constraints on the optimization problem.

Figure 5B:
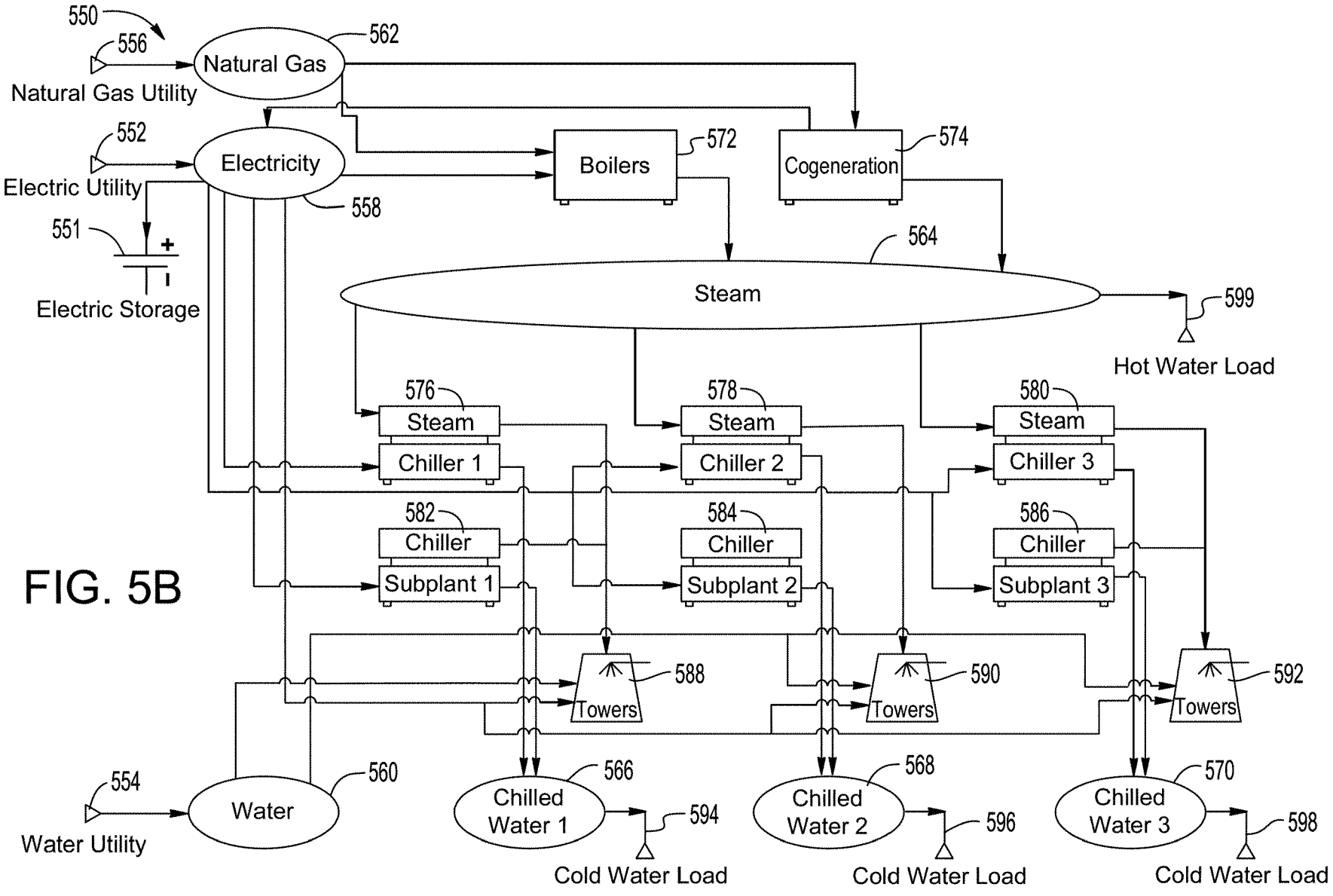
FIG. 5B is another plant resource diagram illustrating the elements of a central plant and the connections between such elements, according to some embodiments.

Referring now to FIG. 5B, another plant resource diagram 550 is shown, according to an exemplary embodiment. Plant resource diagram 550 represents another implementation of a central plant and indicates how the equipment of the central plant are connected to each other and to external systems or devices. Asset allocator 402 can use plant resource diagram 550 to identify the interconnections between various sources 410, subplants 420, storage 430, and sinks 440 in the central plant. In some instances, the interconnections defined by diagram 550 are not capable of being inferred based on the type of resource produced. For this reason, plant resource diagram 550 may provide asset allocator 402 with new information that can be used to establish constraints on the asset allocation problem.

Plant resource diagram 550 is shown to include an electric utility 552, a water utility 554, and a natural gas utility 556. Utilities 552-556 are examples of sources 410 that provide resources to the central plant. For example, electric utility 552 may provide an electricity resource 558, water utility 554 may provide a water resource 560, and natural gas utility 556 may provide a natural gas resource 562. The lines connecting utilities 552-556 to resources 558-562 along with the directions of the lines (i.e., pointing toward resources 558-562) indicate that resources purchased from utilities 552-556 add to resources 558-562. The line connecting electricity resource 558 to electrical storage 551 indicates that electrical storage 551 can store and discharge electricity resource 558.

Plant resource diagram 550 is shown to include a boiler subplant 572, a cogeneration subplant 574, several steam chiller subplants 576-580, several chiller subplants 582-586, and several cooling tower subplants 588-592. Subplants 572-592 are examples of subplants 420 that convert resource types (i.e., convert input resources to output resources). For example, the lines connecting boiler subplant 572 and cogeneration subplant 574 to natural gas resource 562, electricity resource 558, and steam resource 564 indicate that both boiler subplant 572 and cogeneration subplant 574 consume natural gas resource 562 and electricity resource 558 to produce steam resource 564.

The lines connecting steam resource 564 and electricity resource 558 to steam chiller subplants 576-580 indicate that each of steam chiller subplants 576-580 receives steam resource 564 and electricity resource 558 as input resources. However, each of steam chiller subplants 576-580 produces a different output resource. For example, steam chiller subplant 576 produces chilled water resource 566, steam chiller subplant 578 produces chilled water resource 568, and steam chiller subplant 580 produces chilled water resource 570. Similarly, the lines connecting electricity resource 558 to chiller subplants 582-586 indicate that each of chiller subplants 582-586 receives electricity resource 558 as an input. However, each of chiller subplants 582-586 produces a different output resource. For example, chiller subplant 582 produces chilled water resource 566, chiller subplant 584 produces chilled water resource 568, and chiller subplant 586 produces chilled water resource 570.

Chilled water resources 566-570 have the same general type (i.e., chilled water) but can be defined as separate resources by asset allocator 402. The lines connecting chilled water resources 566-570 to subplants 576-586 indicate which of subplants 576-586 can produce each chilled water resource 566-570. For example, plant resource diagram 550 indicates that chilled water resource 566 can only be produced by steam chiller subplant 576 and chiller subplant 582. Similarly, chilled water resource 568 can only be produced by steam chiller subplant 578 and chiller subplant 584, and chilled water resource 570 can only be produced by steam chiller subplant 580 and chiller subplant 586.

Plant resource diagram 550 is shown to include a hot water load 599 and several cold water loads 594-598. Loads 594-599 are examples of sinks 440 that consume resources. The line connecting hot water load 599 to steam resource 564 indicates that steam resource 564 can be used to satisfy hot water load 599. Similarly, the lines connecting chilled water resources 566-570 to cold water loads 594-598 indicate which of chilled water resources 566-570 can be used to satisfy each of cold water loads 594-598. For example, only chilled water resource 566 can be used to satisfy cold water load 594, only chilled water resource 568 can be used to satisfy cold water load 596, and only chilled water resource 570 can be used to satisfy cold water load 598. Asset allocator 402 can use the interconnections and limitations defined by plant resource diagram 550 to establish appropriate constraints on the optimization problem.

Central Plant Controller

Figure 6:
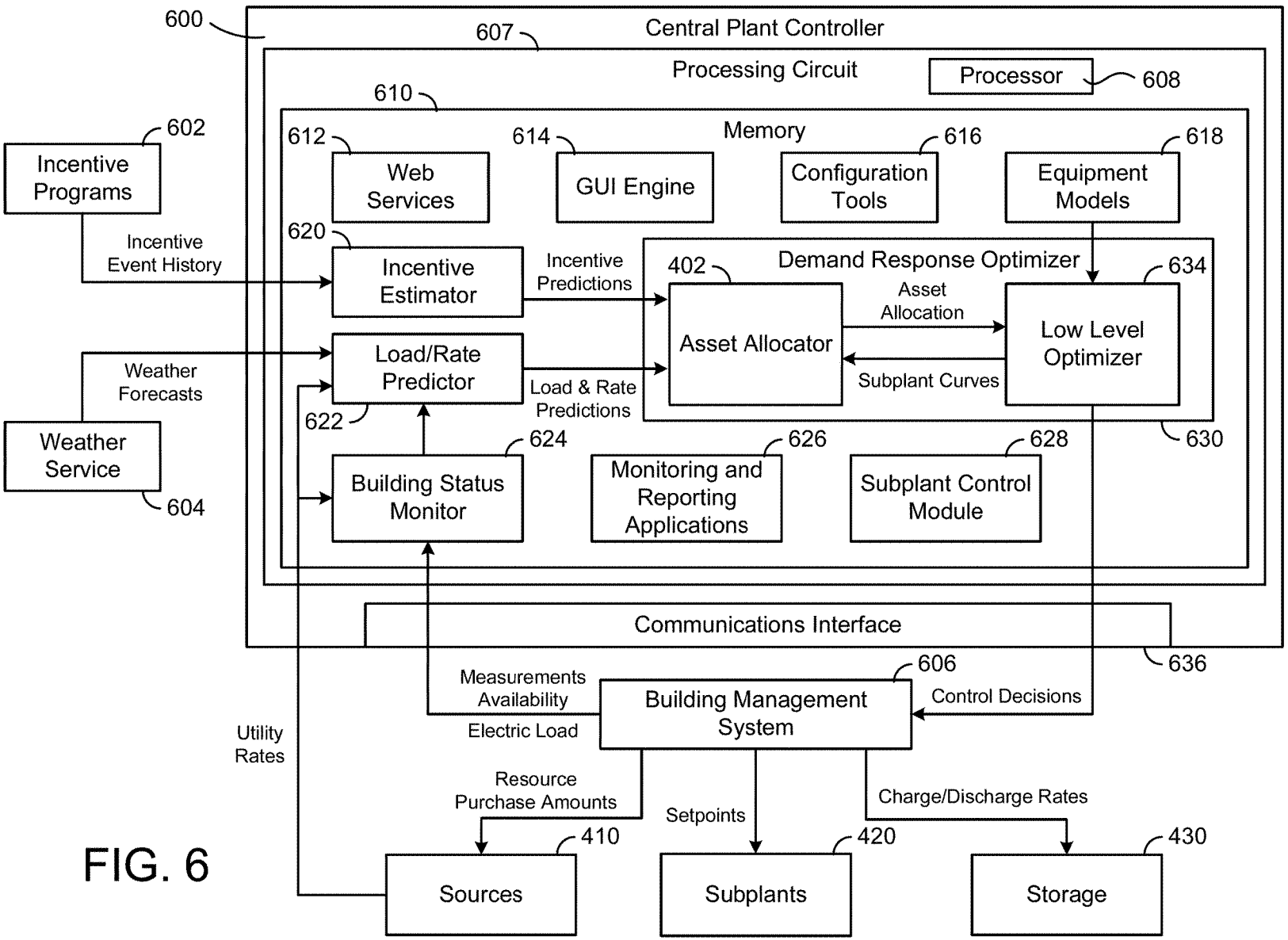
FIG. 6 is a block diagram of a central plant controller in which the asset allocator of FIG. 4 can be implemented, according to some embodiments.

Referring now to FIG. 6, a block diagram of a central plant controller 600 in which asset allocator 402 can be implemented is shown, according to an exemplary embodiment. In various embodiments, central plant controller 600 can be configured to monitor and control central plant 200, asset allocation system 400, and various components thereof (e.g., sources 410, subplants 420, storage 430, sinks 440, etc.). Central plant controller 600 is shown providing control decisions to a building management system (BMS) 606. The control decisions provided to BMS 606 may include resource purchase amounts for sources 410, setpoints for subplants 420, and/or charge/discharge rates for storage 430.

In some embodiments, BMS 606 is the same or similar to the BMS described with reference to FIG. 1. BMS 606 may be configured to monitor conditions within a controlled building or building zone. For example, BMS 606 may receive input from various sensors (e.g., temperature sensors, humidity sensors, airflow sensors, voltage sensors, etc.) distributed throughout the building and may report building conditions to central plant controller 600. Building conditions may include, for example, a temperature of the building or a zone of the building, a power consumption (e.g., electric load) of the building, a state of one or more actuators configured to affect a controlled state within the building, or other types of information relating to the controlled building. BMS 606 may operate subplants 420 and storage 430 to affect the monitored conditions within the building and to serve the thermal energy loads of the building.

BMS 606 may receive control signals from central plant controller 600 specifying on/off states, charge/discharge rates, and/or setpoints for the subplant equipment. BMS 606 may control the equipment (e.g., via actuators, power relays, etc.) in accordance with the control signals provided by central plant controller 600. For example, BMS 606 may operate the equipment using closed loop control to achieve the setpoints specified by central plant controller 600. In various embodiments, BMS 606 may be combined with central plant controller 600 or may be part of a separate building management system. According to an exemplary embodiment, BMS 606 is a METASYS® brand building management system, as sold by Johnson Controls, Inc.

Central plant controller 600 may monitor the status of the controlled building using information received from BMS 606. Central plant controller 600 may be configured to predict the thermal energy loads (e.g., heating loads, cooling loads, etc.) of the building for plurality of time steps in an optimization period (e.g., using weather forecasts from a weather service 604). Central plant controller 600 may also predict the revenue generation potential of incentive based demand response (IBDR) programs using an incentive event history (e.g., past clearing prices, mileage ratios, event probabilities, etc.) from incentive programs 602. Central plant controller 600 may generate control decisions that optimize the economic value of operating central plant 200 over the duration of the optimization period subject to constraints on the optimization process (e.g., energy balance constraints, load satisfaction constraints, etc.). The optimization process performed by central plant controller 600 is described in greater detail below.

In some embodiments, central plant controller 600 is integrated within a single computer (e.g., one server, one housing, etc.). In various other exemplary embodiments, central plant controller 600 can be distributed across multiple servers or computers (e.g., that can exist in distributed locations). In another exemplary embodiment, central plant controller 600 may integrated with a smart building manager that manages multiple building systems and/or combined with BMS 606.

Central plant controller 600 is shown to include a communications interface 636 and a processing circuit 607. Communications interface 636 may include wired or wireless interfaces (e.g., jacks, antennas, transmitters, receivers, transceivers, wire terminals, etc.) for conducting data communications with various systems, devices, or networks. For example, communications interface 636 may include an Ethernet card and port for sending and receiving data via an Ethernet-based communications network and/or a WiFi transceiver for communicating via a wireless communications network. Communications interface 636 may be configured to communicate via local area networks or wide area networks (e.g., the Internet, a building WAN, etc.) and may use a variety of communications protocols (e.g., BACnet, IP, LON, etc.).

Communications interface 636 may be a network interface configured to facilitate electronic data communications between central plant controller 600 and various external systems or devices (e.g., BMS 606, subplants 420, storage 430, sources 410, etc.). For example, central plant controller 600 may receive information from BMS 606 indicating one or more measured states of the controlled building (e.g., temperature, humidity, electric loads, etc.) and one or more states of subplants 420 and/or storage 430 (e.g., equipment status, power consumption, equipment availability, etc.). Communications interface 636 may receive inputs from BMS 606, subplants 420, and/or storage 430 and may provide operating parameters (e.g., on/off decisions, setpoints, etc.) to subplants 420 and storage 430 via BMS 606. The operating parameters may cause subplants 420 and storage 430 to activate, deactivate, or adjust a setpoint for various devices thereof.

Still referring to FIG. 6, processing circuit 607 is shown to include a processor 608 and memory 610. Processor 608 may be a general purpose or specific purpose processor, an application specific integrated circuit (ASIC), one or more field programmable gate arrays (FPGAs), a group of processing components, or other suitable processing components. Processor 608 may be configured to execute computer code or instructions stored in memory 610 or received from other computer readable media (e.g., CDROM, network storage, a remote server, etc.).

Memory 610 may include one or more devices (e.g., memory units, memory devices, storage devices, etc.) for storing data and/or computer code for completing and/or facilitating the various processes described in the present disclosure. Memory 610 may include random access memory (RAM), read-only memory (ROM), hard drive storage, temporary storage, non-volatile memory, flash memory, optical memory, or any other suitable memory for storing software objects and/or computer instructions. Memory 610 may include database components, object code components, script components, or any other type of information structure for supporting the various activities and information structures described in the present disclosure. Memory 610 may be communicably connected to processor 608 via processing circuit 607 and may include computer code for executing (e.g., by processor 608) one or more processes described herein.

Memory 610 is shown to include a building status monitor 624. Central plant controller 600 may receive data regarding the overall building or building space to be heated or cooled by system 400 via building status monitor 624. In an exemplary embodiment, building status monitor 624 may include a graphical user interface component configured to provide graphical user interfaces to a user for selecting building requirements (e.g., overall temperature parameters, selecting schedules for the building, selecting different temperature levels for different building zones, etc.).

Central plant controller 600 may determine on/off configurations and operating setpoints to satisfy the building requirements received from building status monitor 624. In some embodiments, building status monitor 624 receives, collects, stores, and/or transmits cooling load requirements, building temperature setpoints, occupancy data, weather data, energy data, schedule data, and other building parameters. In some embodiments, building status monitor 624 stores data regarding energy costs, such as pricing information available from sources 410 (energy charge, demand charge, etc.).

Still referring to FIG. 6, memory 610 is shown to include a load/rate predictor 622. Load/rate predictor 622 may be configured to predict the thermal energy loads ($\hat{\ell}_k$) of the building or campus for each time step k (e.g., k=1 n) of an optimization period. Load/rate predictor 622 is shown receiving weather forecasts from a weather service 604. In some embodiments, load/rate predictor 622 predicts the thermal energy loads $\hat{\ell}_k$ as a function of the weather forecasts. In some embodiments, load/rate predictor 622 uses feedback from BMS 606 to predict loads $\hat{\ell}_k$. Feedback from BMS 606 may include various types of sensory inputs (e.g., temperature, flow, humidity, enthalpy, etc.) or other data relating to the controlled building (e.g., inputs from a HVAC system, a lighting control system, a security system, a water system, etc.).

In some embodiments, load/rate predictor 622 receives a measured electric load and/or previous measured load data from BMS 606 (e.g., via building status monitor 624). Load/rate predictor 622 may predict loads $\hat{\ell}_k$ as a function of a given weather forecast ($\hat{\phi}_w$), a day type (clay), the time of day (t), and previous measured load data ($Y_{k-1}$). Such a relationship is expressed in the following equation:

$$\hat{\ell}_k = f(\hat{\phi}_w, \text{day}, t \mid Y_{k-1})$$

In some embodiments, load/rate predictor 622 uses a deterministic plus stochastic model trained from historical load data to predict loads $\hat{\ell}_k$ Load/rate predictor 622 may use any of a variety of prediction methods to predict loads $\hat{\ell}_k$ (e.g., linear regression for the deterministic portion and an AR model for the stochastic portion). Load/rate predictor 622 may predict one or more different types of loads for the building or campus. For example, load/rate predictor 622 may predict a hot water load $\hat{\ell}_{Hot,k}$ and a cold water load $\hat{\ell}_{Cold,k}$ for each time step k within the prediction window. In some embodiments, load/rate predictor 622 makes load/rate predictions using the techniques described in U.S. patent application Ser. No. 14/717,593.

Load/rate predictor 622 is shown receiving utility rates from sources 410. Utility rates may indicate a cost or price per unit of a resource (e.g., electricity, natural gas, water, etc.) provided by sources 410 at each time step k in the prediction window. In some embodiments, the utility rates are time-variable rates. For example, the price of electricity may be higher at certain times of day or days of the week (e.g., during high demand periods) and lower at other times of day or days of the week (e.g., during low demand periods). The utility rates may define various time periods and a cost per unit of a resource during each time period. Utility rates may be actual rates received from sources 410 or predicted utility rates estimated by load/rate predictor 622.

In some embodiments, the utility rates include demand charges for one or more resources provided by sources 410. A demand charge may define a separate cost imposed by sources 410 based on the maximum usage of a particular resource (e.g., maximum energy consumption) during a demand charge period. The utility rates may define various demand charge periods and one or more demand charges associated with each demand charge period. In some instances, demand charge periods may overlap partially or completely with each other and/or with the prediction window. Advantageously, demand response optimizer 630 may be configured to account for demand charges in the high level optimization process performed by asset allocator 402. Sources 410 may be defined by time-variable (e.g., hourly) prices, a maximum service level (e.g., a maximum rate of consumption allowed by the physical infrastructure or by contract) and, in the case of electricity, a demand charge or a charge for the peak rate of consumption within a certain period. Load/rate predictor 622 may store the predicted loads $\hat{\ell}_k$ and the utility rates in memory 610 and/or provide the predicted loads $\hat{\ell}_k$ and the utility rates to demand response optimizer 630.

Still referring to FIG. 6, memory 610 is shown to include an incentive estimator 620. Incentive estimator 620 may be configured to estimate the revenue generation potential of participating in various incentive-based demand response (IBDR) programs. In some embodiments, incentive estimator 620 receives an incentive event history from incentive programs 602. The incentive event history may include a history of past IBDR events from incentive programs 602. An IBDR event may include an invitation from incentive programs 602 to participate in an IBDR program in exchange for a monetary incentive. The incentive event history may indicate the times at which the past IBDR events occurred and attributes describing the IBDR events (e.g., clearing prices, mileage ratios, participation requirements, etc.). Incentive estimator 620 may use the incentive event history to estimate IBDR event probabilities during the optimization period.

Incentive estimator 620 is shown providing incentive predictions to demand response optimizer 630. The incentive predictions may include the estimated IBDR probabilities, estimated participation requirements, an estimated amount of revenue from participating in the estimated IBDR events, and/or any other attributes of the predicted IBDR events. Demand response optimizer 630 may use the incentive predictions along with the predicted loads $\hat{\ell}_k$ and utility rates from load/rate predictor 622 to determine an optimal set of control decisions for each time step within the optimization period.

Still referring to FIG. 6, memory 610 is shown to include a demand response optimizer 630. Demand response optimizer 630 may perform a cascaded optimization process to optimize the performance of asset allocation system 400. For example, demand response optimizer 630 is shown to include asset allocator 402 and a low level optimizer 634. Asset allocator 402 may control an outer (e.g., subplant level) loop of the cascaded optimization. Asset allocator 402 may determine an optimal set of control decisions for each time step in the prediction window in order to optimize (e.g., maximize) the value of operating asset allocation system 400. Control decisions made by asset allocator 402 may include, for example, load setpoints for each of subplants 420, charge/discharge rates for each of storage 430, resource purchase amounts for each type of resource purchased from sources 410, and/or an amount of each resource sold to energy purchasers 504. In other words, the control decisions may define resource allocation at each time step. The control decisions made by asset allocator 402 are based on the statistical estimates of incentive event probabilities and revenue generation potential for various IBDR events as well as the load and rate predictions.

Low level optimizer 634 may control an inner (e.g., equipment level) loop of the cascaded optimization. Low level optimizer 634 may determine how to best run each subplant at the load setpoint determined by asset allocator 402. For example, low level optimizer 634 may determine on/off states and/or operating setpoints for various devices of the subplant equipment in order to optimize (e.g., minimize) the energy consumption of each subplant while meeting the resource allocation setpoint for the subplant. In some embodiments, low level optimizer 634 receives actual incentive events from incentive programs 602. Low level optimizer 634 may determine whether to participate in the incentive events based on the resource allocation set by asset allocator 402. For example, if insufficient resources have been allocated to a particular IBDR program by asset allocator 402 or if the allocated resources have already been used, low level optimizer 634 may determine that asset allocation system 400 will not participate in the IBDR program and may ignore the IBDR event. However, if the required resources have been allocated to the IBDR program and are available in storage 430, low level optimizer 634 may determine that system 400 will participate in the IBDR program in response to the IBDR event. The cascaded optimization process performed by demand response optimizer 630 is described in greater detail in U.S. patent application Ser. No. 15/247,885.

In some embodiments, low level optimizer 634 generates and provides subplant curves to asset allocator 402. Each subplant curve may indicate an amount of resource consumption by a particular subplant (e.g., electricity use measured in kW, water use measured in L/s, etc.) as a function of the subplant load. In some embodiments, low level optimizer 634 generates the subplant curves by running the low level optimization process for various combinations of subplant loads and weather conditions to generate multiple data points. Low level optimizer 634 may fit a curve to the data points to generate the subplant curves. In other embodiments, low level optimizer 634 provides the data points asset allocator 402 and asset allocator 402 generates the subplant curves using the data points. Asset allocator 402 may store the subplant curves in memory for use in the high level (i.e., asset allocation) optimization process.

In some embodiments, the subplant curves are generated by combining efficiency curves for individual devices of a subplant. A device efficiency curve may indicate the amount of resource consumption by the device as a function of load. The device efficiency curves may be provided by a device manufacturer or generated using experimental data. In some embodiments, the device efficiency curves are based on an initial efficiency curve provided by a device manufacturer and updated using experimental data. The device efficiency curves may be stored in equipment models 618. For some devices, the device efficiency curves may indicate that resource consumption is a U-shaped function of load. Accordingly, when multiple device efficiency curves are combined into a subplant curve for the entire subplant, the resultant subplant curve may be a wavy curve. The waves are caused by a single device loading up before it is more efficient to turn on another device to satisfy the subplant load.

Still referring to FIG. 6, memory 610 is shown to include a subplant control module 628. Subplant control module 628 may store historical data regarding past operating statuses, past operating setpoints, and instructions for calculating and/or implementing control parameters for subplants 420 and storage 430. Subplant control module 628 may also receive, store, and/or transmit data regarding the conditions of individual devices of the subplant equipment, such as operating efficiency, equipment degradation, a date since last service, a lifespan parameter, a condition grade, or other device-specific data. Subplant control module 628 may receive data from subplants 420, storage 430, and/or BMS 606 via communications interface 636. Subplant control module 628 may also receive and store on/off statuses and operating setpoints from low level optimizer 634.

Data and processing results from demand response optimizer 630, subplant control module 628, or other modules of central plant controller 600 may be accessed by (or pushed to) monitoring and reporting applications 626. Monitoring and reporting applications 626 may be configured to generate real time "system health" dashboards that can be viewed and navigated by a user (e.g., a system engineer). For example, monitoring and reporting applications 626 may include a web-based monitoring application with several graphical user interface (GUI) elements (e.g., widgets, dashboard controls, windows, etc.) for displaying key performance indicators (KPI) or other information to users of a GUI. In addition, the GUI elements may summarize relative energy use and intensity across energy storage systems in different buildings (real or modeled), different campuses, or the like. Other GUI elements or reports may be generated and shown based on available data that allow users to assess performance across one or more energy storage systems from one screen. The user interface or report (or underlying data engine) may be configured to aggregate and categorize operating conditions by building, building type, equipment type, and the like. The GUI elements may include charts or histograms that allow the user to visually analyze the operating parameters and power consumption for the devices of the energy storage system.

Still referring to FIG. 6, central plant controller 600 may include one or more GUI servers, web services 612, or GUI engines 614 to support monitoring and reporting applications 626. In various embodiments, applications 626, web services 612, and GUI engine 614 may be provided as separate components outside of central plant controller 600 (e.g., as part of a smart building manager). Central plant controller 600 may be configured to maintain detailed historical databases (e.g., relational databases XML databases, etc.) of relevant data and includes computer code modules that continuously, frequently, or infrequently query, aggregate, transform, search, or otherwise process the data maintained in the detailed databases. Central plant controller 600 may be configured to provide the results of any such processing to other databases, tables, XML files, or other data structures for further querying, calculation, or access by, for example, external monitoring and reporting applications.

Central plant controller 600 is shown to include configuration tools 616. Configuration tools 616 can allow a user to define (e.g., via graphical user interfaces, via prompt-driven "wizards," etc.) how central plant controller 600 should react to changing conditions in the energy storage subsystems. In an exemplary embodiment, configuration tools 616 allow a user to build and store condition-response scenarios that can cross multiple energy storage system devices, multiple building systems, and multiple enterprise control applications (e.g., work order management system applications, entity resource planning applications, etc.). For example, configuration tools 616 can provide the user with the ability to combine data (e.g., from subsystems, from event histories) using a variety of conditional logic. In varying exemplary embodiments, the conditional logic can range from simple logical operators between conditions (e.g., AND, OR, XOR, etc.) to pseudo-code constructs or complex programming language functions (allowing for more complex interactions, conditional statements, loops, etc.). Configuration tools 616 can present user interfaces for building such conditional logic. The user interfaces may allow users to define policies and responses graphically. In some embodiments, the user interfaces may allow a user to select a pre-stored or pre-constructed policy and adapt it or enable it for use with their system.

Planning Tool

Figure 7:
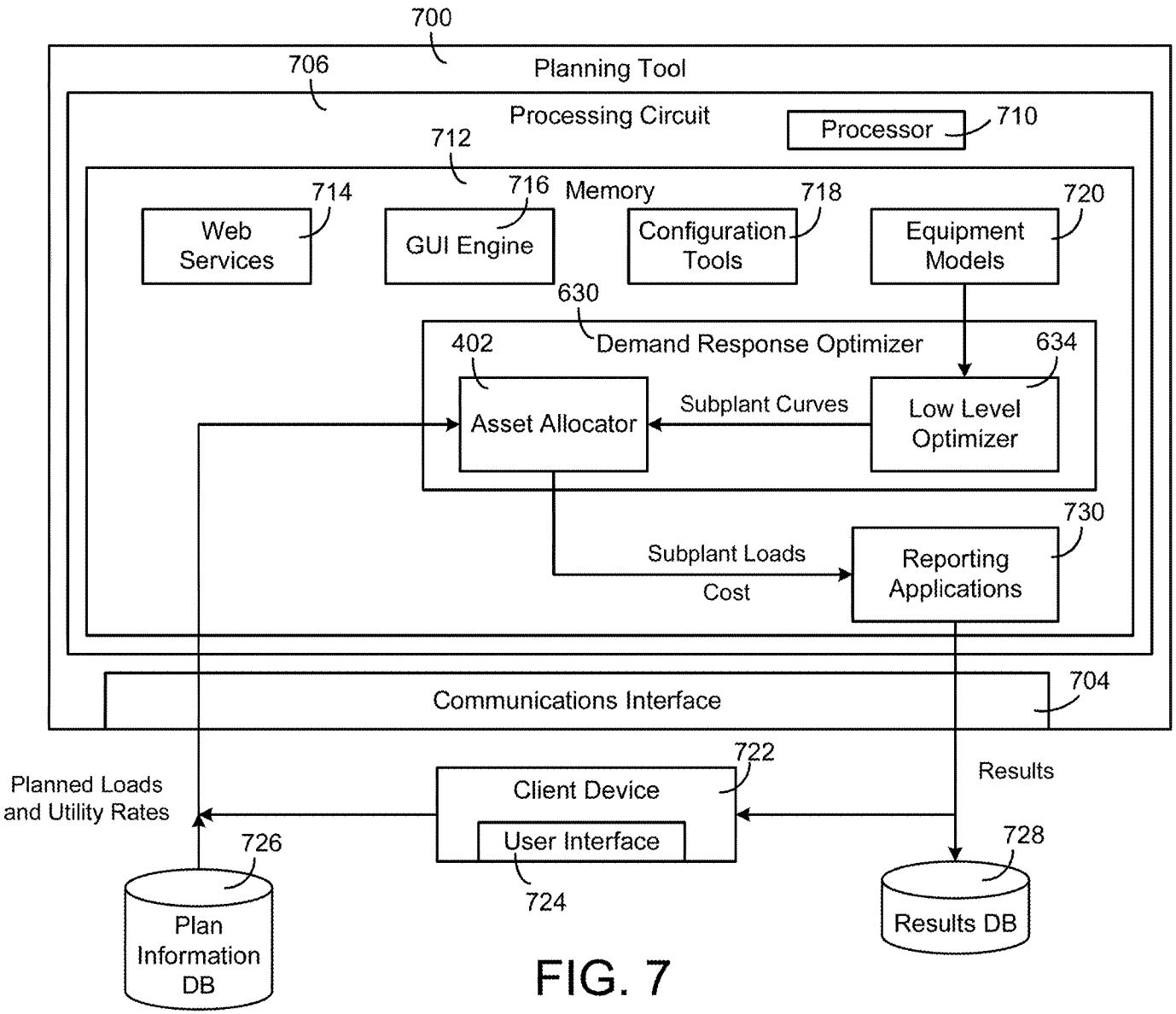
FIG. 7 is a block diagram of a planning tool in which the asset allocator of FIG. 4 can be implemented, according to some embodiments.

Referring now to FIG. 7, a block diagram of a planning tool 700 in which asset allocator 402 can be implemented is shown, according to an exemplary embodiment. Planning tool 700 may be configured to use demand response optimizer 630 to simulate the operation of a central plant over a predetermined time period (e.g., a day, a month, a week, a year, etc.) for planning, budgeting, and/or design considerations. When implemented in planning tool 700, demand response optimizer 630 may operate in a similar manner as described with reference to FIG. 6. For example, demand response optimizer 630 may use building loads and utility rates to determine an optimal resource allocation to minimize cost over a simulation period. However, planning tool 700 may not be responsible for real-time control of a building management system or central plant.

Planning tool 700 can be configured to determine the benefits of investing in a battery asset and the financial metrics associated with the investment. Such financial metrics can include, for example, the internal rate of return (IRR), net present value (NPV), and/or simple payback period (SPP). Planning tool 700 can also assist a user in determining the size of the battery which yields optimal financial metrics such as maximum NPV or a minimum SPP. In some embodiments, planning tool 700 allows a user to specify a battery size and automatically determines the benefits of the battery asset from participating in selected IBDR programs while performing PBDR. In some embodiments, planning tool 700 is configured to determine the battery size that minimizes SPP given the IBDR programs selected and the requirement of performing PBDR. In some embodiments, planning tool 700 is configured to determine the battery size that maximizes NPV given the IBDR programs selected and the requirement of performing PBDR.

In planning tool 700, asset allocator 402 may receive planned loads and utility rates for the entire simulation period. The planned loads and utility rates may be defined by input received from a user via a client device 722 (e.g., user-defined, user selected, etc.) and/or retrieved from a plan information database 726. Asset allocator 402 uses the planned loads and utility rates in conjunction with subplant curves from low level optimizer 634 to determine an optimal resource allocation (i.e., an optimal dispatch schedule) for a portion of the simulation period.

The portion of the simulation period over which asset allocator 402 optimizes the resource allocation may be defined by a prediction window ending at a time horizon. With each iteration of the optimization, the prediction window is shifted forward and the portion of the dispatch schedule no longer in the prediction window is accepted (e.g., stored or output as results of the simulation). Load and rate predictions may be predefined for the entire simulation and may not be subject to adjustments in each iteration. However, shifting the prediction window forward in time may introduce additional plan information (e.g., planned loads and/or utility rates) for the newly-added time slice at the end of the prediction window. The new plan information may not have a significant effect on the optimal dispatch schedule since only a small portion of the prediction window changes with each iteration.

In some embodiments, asset allocator 402 requests all of the subplant curves used in the simulation from low level optimizer 634 at the beginning of the simulation. Since the planned loads and environmental conditions are known for the entire simulation period, asset allocator 402 may retrieve all of the relevant subplant curves at the beginning of the simulation. In some embodiments, low level optimizer 634 generates functions that map subplant production to equipment level production and resource use when the subplant curves are provided to asset allocator 402. These subplant to equipment functions may be used to calculate the individual equipment production and resource use (e.g., in a post-processing module) based on the results of the simulation.

Still referring to FIG. 7, planning tool 700 is shown to include a communications interface 704 and a processing circuit 706. Communications interface 704 may include wired or wireless interfaces (e.g., jacks, antennas, transmitters, receivers, transceivers, wire terminals, etc.) for conducting data communications with various systems, devices, or networks. For example, communications interface 704 may include an Ethernet card and port for sending and receiving data via an Ethernet-based communications network and/or a WiFi transceiver for communicating via a wireless communications network. Communications interface 704 may be configured to communicate via local area networks or wide area networks (e.g., the Internet, a building WAN, etc.) and may use a variety of communications protocols (e.g., BACnet, IP, LON, etc.).

Communications interface 704 may be a network interface configured to facilitate electronic data communications between planning tool 700 and various external systems or devices (e.g., client device 722, results database 728, plan information database 726, etc.). For example, planning tool 700 may receive planned loads and utility rates from client device 722 and/or plan information database 726 via communications interface 704. Planning tool 700 may use communications interface 704 to output results of the simulation to client device 722 and/or to store the results in results database 728.

Still referring to FIG. 7, processing circuit 706 is shown to include a processor 710 and memory 712. Processor 710 may be a general purpose or specific purpose processor, an application specific integrated circuit (ASIC), one or more field programmable gate arrays (FPGAs), a group of processing components, or other suitable processing components. Processor 710 may be configured to execute computer code or instructions stored in memory 712 or received from other computer readable media (e.g., CDROM, network storage, a remote server, etc.).

Memory 712 may include one or more devices (e.g., memory units, memory devices, storage devices, etc.) for storing data and/or computer code for completing and/or facilitating the various processes described in the present disclosure. Memory 712 may include random access memory (RAM), read-only memory (ROM), hard drive storage, temporary storage, non-volatile memory, flash memory, optical memory, or any other suitable memory for storing software objects and/or computer instructions. Memory 712 may include database components, object code components, script components, or any other type of information structure for supporting the various activities and information structures described in the present disclosure. Memory 712 may be communicably connected to processor 710 via processing circuit 706 and may include computer code for executing (e.g., by processor 710) one or more processes described herein.

Still referring to FIG. 7, memory 712 is shown to include a GUI engine 716, web services 714, and configuration tools 718. In an exemplary embodiment, GUI engine 716 includes a graphical user interface component configured to provide graphical user interfaces to a user for selecting or defining plan information for the simulation (e.g., planned loads, utility rates, environmental conditions, etc.). Web services 714 may allow a user to interact with planning tool 700 via a web portal and/or from a remote system or device (e.g., an enterprise control application).

Configuration tools 718 can allow a user to define (e.g., via graphical user interfaces, via prompt-driven "wizards," etc.) various parameters of the simulation such as the number and type of subplants, the devices within each subplant, the subplant curves, device-specific efficiency curves, the duration of the simulation, the duration of the prediction window, the duration of each time step, and/or various other types of plan information related to the simulation. Configuration tools 718 can present user interfaces for building the simulation. The user interfaces may allow users to define simulation parameters graphically. In some embodiments, the user interfaces allow a user to select a pre-stored or pre-constructed simulated plant and/or plan information (e.g., from plan information database 726) and adapt it or enable it for use in the simulation.

Still referring to FIG. 7, memory 712 is shown to include demand response optimizer 630. Demand response optimizer 630 may use the planned loads and utility rates to determine an optimal resource allocation over a prediction window. The operation of demand response optimizer 630 may be the same or similar as previously described with reference to FIG. 6. With each iteration of the optimization process, demand response optimizer 630 may shift the prediction window forward and apply the optimal resource allocation for the portion of the simulation period no longer in the prediction window. Demand response optimizer 630 may use the new plan information at the end of the prediction window to perform the next iteration of the optimization process. Demand response optimizer 630 may output the applied resource allocation to reporting applications 730 for presentation to a client device 722 (e.g., via user interface 724) or storage in results database 728.

Still referring to FIG. 7, memory 712 is shown to include reporting applications 730. Reporting applications 730 may receive the optimized resource allocations from demand response optimizer 630 and, in some embodiments, costs associated with the optimized resource allocations. Reporting applications 730 may include a web-based reporting application with several graphical user interface (GUI) elements (e.g., widgets, dashboard controls, windows, etc.) for displaying key performance indicators (KPI) or other information to users of a GUI. In addition, the GUI elements may summarize relative energy use and intensity across various plants, subplants, or the like. Other GUI elements or reports may be generated and shown based on available data that allow users to assess the results of the simulation. The user interface or report (or underlying data engine) may be configured to aggregate and categorize resource allocation and the costs associated therewith and provide the results to a user via a GUI. The GUI elements may include charts or histograms that allow the user to visually analyze the results of the simulation. An exemplary output that may be generated by reporting applications 730 is shown in FIG. 8.

Figure 8:
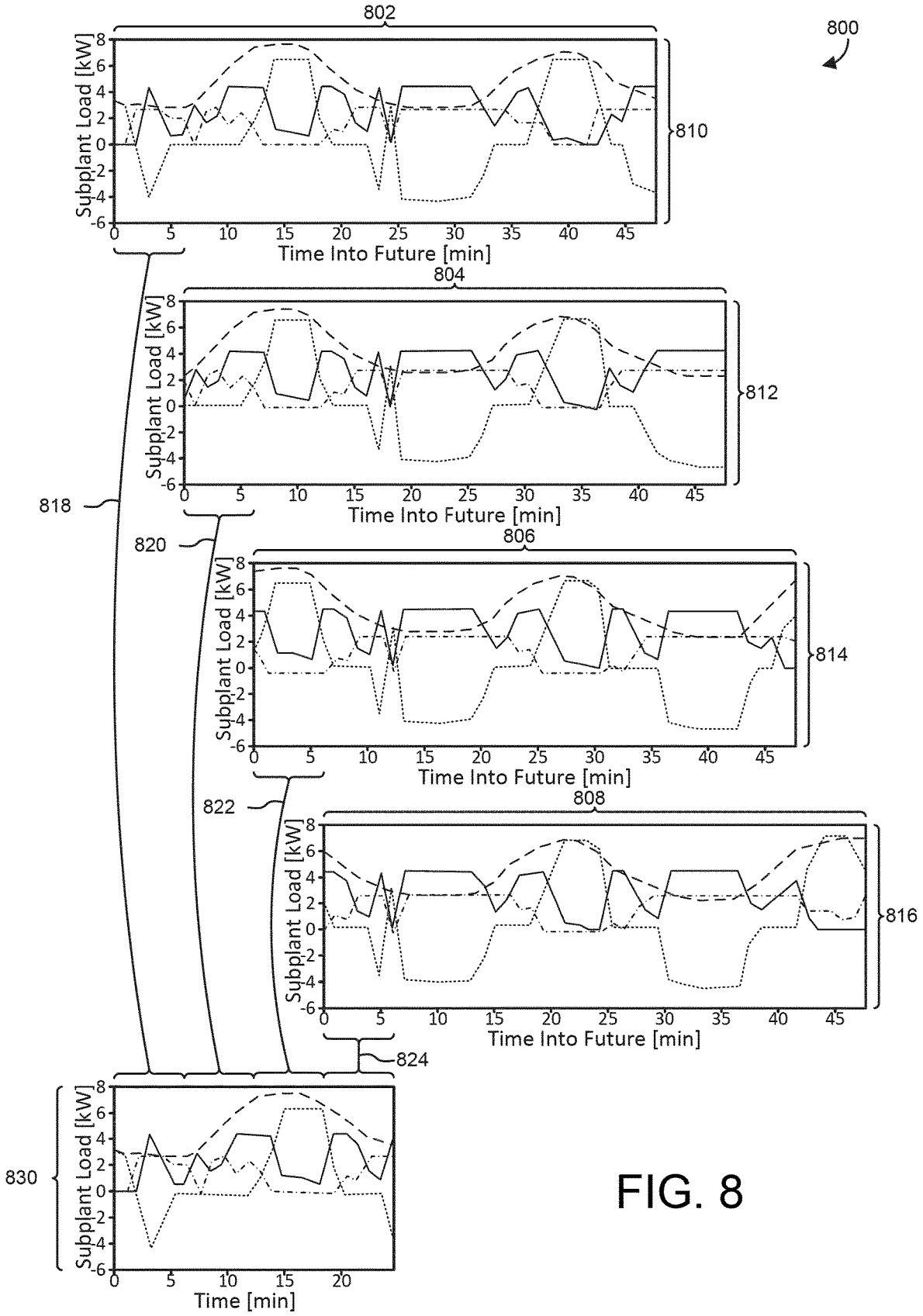
FIG. 8 is a flow diagram illustrating an optimization process which can be performed by the planning tool of FIG. 7, according to some embodiments.

Referring now to FIG. 8, several graphs 800 illustrating the operation of planning tool 700 are shown, according to an exemplary embodiment. With each iteration of the optimization process, planning tool 700 selects an optimization period (i.e., a portion of the simulation period) over which the optimization is performed. For example, planning tool 700 may select optimization period 802 for use in the first iteration. Once the optimal resource allocation 810 has been determined, planning tool 700 may select a portion 818 of resource allocation 810 to send to plant dispatch 830. Portion 818 may be the first b time steps of resource allocation 810. Planning tool 700 may shift the optimization period 802 forward in time, resulting in optimization period 804. The amount by which the prediction window is shifted may correspond to the duration of time steps b.

Planning tool 700 may repeat the optimization process for optimization period 804 to determine the optimal resource allocation 812. Planning tool 700 may select a portion 820 of resource allocation 812 to send to plant dispatch 830. Portion 820 may be the first b time steps of resource allocation 812. Planning tool 700 may then shift the prediction window forward in time, resulting in optimization period 806. This process may be repeated for each subsequent optimization period (e.g., optimization periods 806, 808, etc.) to generate updated resource allocations (e.g., resource allocations 814, 816, etc.) and to select portions of each resource allocation (e.g., portions 822, 824) to send to plant dispatch 830. Plant dispatch 830 includes the first b time steps 818-824 from each of optimization periods 802-808. Once the optimal resource allocation is compiled for the entire simulation period, the results may be sent to reporting applications 730, results database 728, and/or client device 722, as described with reference to FIG. 7.

Predicting and Controlling Heat Load Disturbance

Environmental Control System for Managing Heat Load Disturbances

Figure 9:
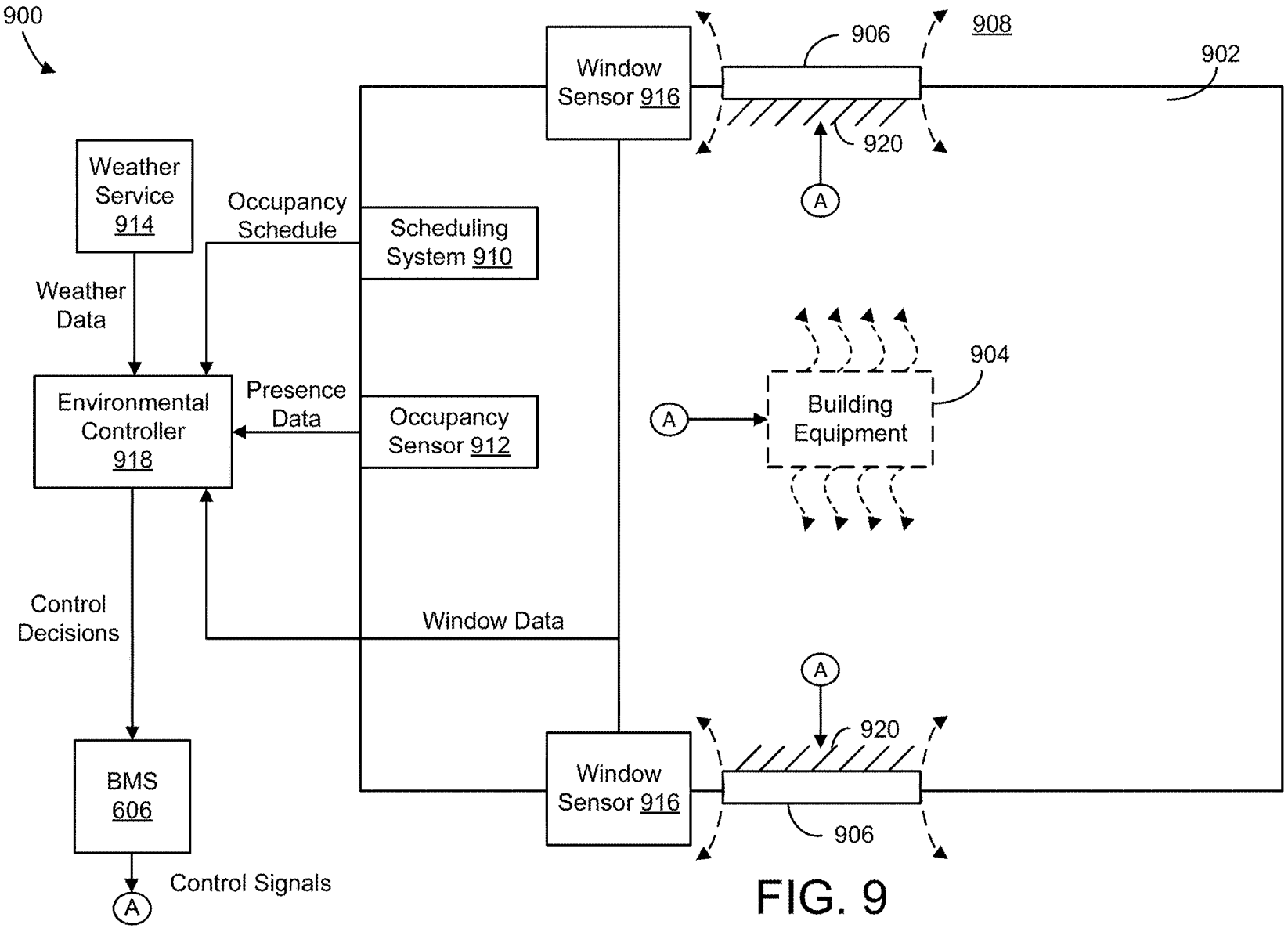
FIG. 9 is a block diagram of an environmental control system including an environmental controller and a conditioned space, according to some embodiments.

Referring now to FIG. 9, an environmental control system 900 is shown, according to some embodiments. Environmental control system 900 can include or be configured to serve (e.g., provide heating and/or cooling to) a conditioned space 902 of a building (e.g., building 10). Conditioned space 902 can be any space in the building that may require conditions (e.g., temperature, humidity, air quality, etc.) of the space to be managed in order to maintain occupant comfort. For example, conditioned space 902 may be a room of the building, a hallway, a zone, etc. that requires conditions to be comfortable to occupants.

Conditioned space 902 is shown to include building equipment 904. Building equipment 904 can be operated to affect a variable state or condition of conditioned space 902. Building equipment 904 may include one or more building devices operable to affect the variable state or condition. For example, building equipment 904 may include heating, ventilation, or air conditioning (HVAC) equipment, an indoor unit of a variable refrigerant flow (VRF) system, air handling units (AHU), packaged air conditioning units (PAC), lighting equipment (e.g., shading equipment 920 of windows, electric lights, etc.), etc. In some embodiments, building equipment 904 is operated respective of a heat load disturbance affecting conditioned space 902. The heat load disturbance, as described in greater detail below, can be estimated based on various information such as, for example, an amount of solar radiation affecting conditioned space 902, an estimated amount of heat generated by operational states of lighting equipment and/or other equipment inside conditioned space 902, heat generated by occupants of conditioned space 902, etc. In particular, the heat load disturbance may be predicted/estimated at least partially based on the operational states of the lighting equipment which may include, for example, operational states of lighting devices (e.g., electric lights) that add heat to conditioned space 902 or operational states of window shades that mitigate solar ingress. The operational states of the lighting devices may include states such as, for example, off, on, a percentage of maximum luminosity output (e.g., 10% of maximum luminosity output for dimmed lights), etc. The operational states of the window shades may include states such as, for example, fully open, fully closed, partially open, etc.

Conditioned space 902 is also shown to include windows 906. Windows 906 can facilitate a heat transfer (e.g., heat losses) between conditioned space 902 and an external space 908. External space 908 can be any space beyond conditioned space 902 that can affect the heat load disturbance affecting conditioned space 902. For example, external space 908 can be the outdoors, a separate space of building 10, etc. As described herein, external space 908 may be explained as the outdoors for ease of explanation, but should be understood to illustrate any space (e.g., an uncontrolled/unconditioned space) external to conditioned space 902. Windows 906 may cause a heat load disturbance to affect conditioned space 902. If not managed correctly, the heat load disturbance may jeopardize occupant comfort in conditioned space 902. For example, windows 906 may let sunlight (i.e., a heat load disturbance) into conditioned space 902, thereby raising a temperature of conditioned space 902. A window facing the sun may result in a higher heat load disturbance affecting conditioned space 902 than a window facing away from the sun.

In some embodiments, each window of windows 906 are grouped into window groups. A window group may include associated windows that have similar attributes/characteristics. For example, a window group may include all windows facing north on a third floor of building 10. As another example, a window group may include all windows on a wall of conditioned space 902. As described herein, windows 906 can be used to described individual windows of conditioned space 902 and/or windows of a window group of conditioned space 902. Window groups can be helpful when performing model predictive control by reducing a number of variables (i.e., individual windows) that are considered. Instead, attributes of all windows of a window group can be considered collectively to reduce an amount of computational power/processing power required to perform model predictive control.

In some embodiments, a heat load disturbance permeating through windows 906 can be managed via shading equipment 920 of building equipment 904 (e.g., automatic window shades, curtains, blinds, etc.). Shading equipment 920 can be operated to control the heat load disturbance affecting conditioned space 902. As shading equipment 920 can belong to building equipment 904, shading equipment 920 can be operated based on control signals provided by BMS 606. Shading equipment 920 of a window may be able to block some and/or all sunlight depending on a shade ratio (i.e., how open/closed shading equipment 920 is) of shading equipment 920. The shade ratio can be measured as a normalized value from 0 to 1, with a shade radio of 0 indicating a shade is fully open and a shade ratio of 1 indicating that the shade is fully closed. For example, a shade radio of 1 (i.e., a shade is fully closed) of the shade may block 100% of the sunlight entering through the window while a shade radio of 0 of the shade may block 0% of the sunlight entering through the window. In some embodiments, a different scale is used to measure the shade ratio. In some embodiments, a fully activated shade (e.g., the shade has a shade ratio of 1) may only be able to block a portion of the sunlight entering through the window. In some embodiments, shading equipment 920 acts reduces radiative heat transfer of conditioned space 902. For example, if shading equipment 920 is operated at the maximum shade ratio, conditioned space 902 may not lose as much heat through windows 906 due to heat transfer between conditioned space 902 and external space 908. In some embodiments, the shade ratio is considered an operational state of the shading equipment that can be used in predicting heat load disturbances affecting conditioned space 902.

Still referring to FIG. 9, environmental control system 900 is also shown to include an environmental controller 918. In some embodiments, environmental controller 918 generates control decisions to operate building equipment 904 and/or windows 906 based on. Particularly, environmental controller 918 can solve an optimization problem (e.g., the objective function J) to determine optimal decisions to maintain occupant comfort in conditioned space 902 and/or optimize (e.g., reduce) costs related to operation of various building equipment. In some embodiments, environmental controller 918 includes some and/or all of the functionality of central plant controller 600.

In some embodiments, environmental controller 918 solves the optimization problem subject to various constraints. The constraints can limit what solutions to the optimization problem can be determined. The constraints can be generated to ensure occupant comfort is maintained, to control how lighting equipment (e.g., shading equipment 920, electric lights, etc.) and/or other building equipment is operated, etc. For example, a constraint can be generated to limit an overall luminosity of conditioned space 902 such that occupants are not uncomfortable due to excess amounts of light. Because of the luminosity constraint, environmental controller 918 may determine a solution to the optimization problem that maintains a luminosity value in conditioned space 902 below the luminosity constraint even if costs can be further optimized (e.g., reduced) if the luminosity value were to exceed the luminosity constraint.

Environmental controller 918 is shown to receive an occupancy schedule from scheduling system 910. The occupancy schedule can indicate various times when conditioned space 902 is expected to be occupied. For example, if conditioned space 902 is a conference room in the building, the occupancy schedule may indicate that conditioned space 902 has meetings scheduled from 9:00a.m.-11:00a.m. and from 2:00 p.m.-5:00 p.m. Based on the meetings, environmental controller 918 can ensure conditioned space 902 is comfortable for occupants during the meetings by operating the building equipment in preparation for said meetings. In some embodiments, the occupancy schedule includes information regarding how many occupants are expected to be in attendance during a time conditioned space 902 is scheduled to be occupied. Per the above example, the occupancy schedule may indicate that 20 people are expected during the meeting from 9:00a.m.-11:00a.m. and 5 people are expected during the meeting from 2:00 p.m.-5:00 p.m. Based on a number of people expected, environmental controller 918 can estimate a heat load disturbance due to emitted body heat. As the number of occupants increases, the estimated heat load disturbance may also increase.

Scheduling system 910 may be any application/system capable of reserving spaces in the building. In some embodiments, scheduling system 910 is integrated with the building. In some embodiments, scheduling system 910 is hosted by a third party provider. For example, scheduling system 910 can be hosted by a cloud service such that occupants of the building can access the cloud service to reserve spaces (e.g., conditioned space 902) of the building.

Conditioned space 902 is also shown to include an occupancy sensor 912. Environmental controller 918 is shown to receive presence data from occupancy sensor 912. Occupancy sensor 912 can be configured to monitor conditioned space 902 for occupants. Occupancy sensor 912 may provide beneficial information to environmental controller 918 as occupants may still be inside conditioned space 902 during periods of time not indicated by the occupancy schedule provided by scheduling system 910. For example, an occupant may forget to reserve conditioned space 902 for a time period and decide to host a meeting in conditioned space 902 regardless, even if the occupancy schedule indicates that conditioned space 902 is not occupied during the time period. As such, occupancy sensor 912 can indicate to environmental controller 918 when occupants are present.

Occupancy sensor 912 can be any sensor capable of detecting an occupant in conditioned space 902. For example, occupancy sensor 912 may be a visual detection device such as a video camera capable of detecting an occupant. As another example, occupancy sensor 912 may be a motion detector (e.g., positioned near an entrance of conditioned space 902, mounted on a wall or a ceiling of conditioned space 902, etc.) configured to associate detected motion in conditioned space 902 with an occupant. In some embodiments, occupancy sensor 912 is configured to determine a number of occupants in conditioned space 902 to include in the presence data provided to environmental controller 918. Environmental controller 918 can use the presence data independently and/or in conjunction with the occupancy schedule provided by scheduling system 910 to operate building equipment 904 to maintain occupant comfort in conditioned space 902 and/or estimate a heat load disturbance of conditioned space 902 due to people/occupants.

In some embodiments, occupancy sensor 912 can also provide lighting information regarding conditioned space 902 to environmental controller 918. For example, if occupancy sensor 912 is a visual detection device (e.g., a video camera), occupancy sensor 912 may be able to detect a current brightness (luminosity) level of conditioned space 902. In addition to maintaining conditions such as temperature, environmental controller 918 may also be required to maintain a comfortable brightness value in conditioned space 902. As such, lighting information provided by occupancy sensor 912 may allow environmental controller 918 to determine how to operate building equipment 904 to adjust the brightness value. For example, if the lighting information indicates conditioned space 902 is too bright, environmental controller 918 may determine shading equipment 920 of building equipment 904 should be lowered to decrease an amount of sunlight entering conditioned space 902. In some embodiments, the lighting information is provided to environmental controller 918 by a separate device capable of measuring the brightness value of conditioned space 902.

Environmental control system 900 is also shown to include a weather service 914. Environmental controller 918 is shown to receive weather data from weather service 914. In some embodiments, weather service 914 is a third party weather provider capable of communicating weather data to environmental controller 918. For example, weather service 914 may be an Internet web site, a radio station, a television station, etc., that track and communicate weather data. In some embodiments, weather service 914 includes one or more environmental sensors configured to measure and communicate environmental data. For example, weather service 914 may include a temperature sensor configured to measure an outdoor air temperature of external space 908. In some embodiments, weather service 914 is a part of the building including conditioned space 902. If weather service 914 is a part of the building, the building may include any sensors or other devices necessary to detect and communicate weather data to environmental controller 918.

Based on the weather data, environmental controller 918 can estimate a heat load disturbance due to external weather conditions. For example, if the weather data indicates heavy cloud cover exists in external space 908, environmental controller 918 may estimate a lower heat load disturbance due to solar effects. As another example, if an outdoor air temperature is higher than an indoor air temperature, environmental controller 918 may estimate a higher heat load disturbance due to outdoor air passing through windows 906.

Conditioned space 902 is also shown to include a window sensor 916 configured to sense and/or collect information regarding windows 906. Window sensor 916 is shown next to each window 906 for ease of explanation, however environmental control system 900 may include a single window sensor 916 configured to sense some and/or all windows 906 in conditioned space 902. Environmental controller 918 is also shown to receive window data from window sensor 916. Window sensor 916 can be any sensor, device, database, etc. that can gather and/or store information regarding windows 906. For example, window sensor 916 may be a sensing device attached to each window that can detect various information regarding windows 906 (e.g., an amount of sunlight entering through windows 906, a thickness of windows 906, shading equipment 920 of windows 906, etc.). As another example, window sensor 916 can be a sensing device positioned outside the building, on a rooftop of the building, or other location at which window sensor 916 can measure the amount of light to which windows 906 are exposed. In other embodiments, window sensor 916 may be a database storing information received from an external data source (e.g., an external light sensor) regarding windows 906 such that the information can be retrieved by environmental controller 918. In some embodiments, window sensor 916 collects data regarding windows 906 of conditioned space 902 and how windows 906 may affect the heat load disturbance affecting conditioned space 902. For example, if a window of windows 906 is facing the sun, the window may cause a higher heat load disturbance to affect conditioned space 902 than a window facing away from the sun. In some embodiments, the window data includes information regarding shading equipment 920 for each window of windows 906 as described above.

Based on the window data, environmental controller 918 can estimate a heat load disturbance due to windows 906 and can determine how to control shading equipment 920 to manage said heat load disturbance. Operation of shading equipment 920 can be particularly helpful in reducing costs related to maintaining occupant comfort in conditioned space 902 of the building. For example, if a temperature of the space should increase to maintain occupant comfort, environmental controller 918 can operate shades to let sunlight into conditioned space 902 to naturally increase the temperature. Operating the shades to let in sunlight may be less expensive than operating a heater to increase the temperature. Therefore, the window data can provide useful information to environmental controller 918 for determining optimal control decisions.

It should be noted that scheduling system 910 and window sensor 916 are shown as a part of conditioned space 902 for ease of explanation. In some embodiments, scheduling system 910 and/or window sensor 916 are not a part of conditioned space 902. Scheduling system 910 and/or window sensor 916 may be hosted by the building, by a cloud service provider, etc.

In some embodiments, environmental controller 918 solves an optimization problem based on information collected from scheduling system 910, occupancy sensor 912, weather service 914, and/or window sensor 916 to determine control decisions. The control decisions can be provided to BMS 606 to generate control signals. Based on the control signals, building equipment 904 (e.g., shading equipment 920 of windows 906) can be operated to affect a variable state or condition of conditioned space 902 to maintain occupant comfort in conditioned space 902.

In some embodiments, environmental controller 918 predicts and controls other types of disturbances. For example, environmental controller 918 may predict and control humidity disturbances, air quality (e.g., carbon monoxide, carbon dioxide, particulate matter 2.5, pollen, etc.) disturbances, or any other types of disturbances affecting environmental conditions of conditioned space 902. As a more particular example, environmental controller 918 may estimate a humidity disturbance affecting conditioned space 902 based on estimated humidity provided due to occupant breathing respective of the occupancy schedule and/or of presence data gathered by occupancy sensor 912. As another example, environmental controller 918 may predict and control an air quality disturbance by controlling shading equipment 920 to manage the natural disinfection properties of sunlight. As such, it should be appreciated that environmental controller 918 can predict and control various different types of disturbances affecting conditioned space 902.

Asset Allocator Configured to Manage Heat Load Disturbances

Figure 10:
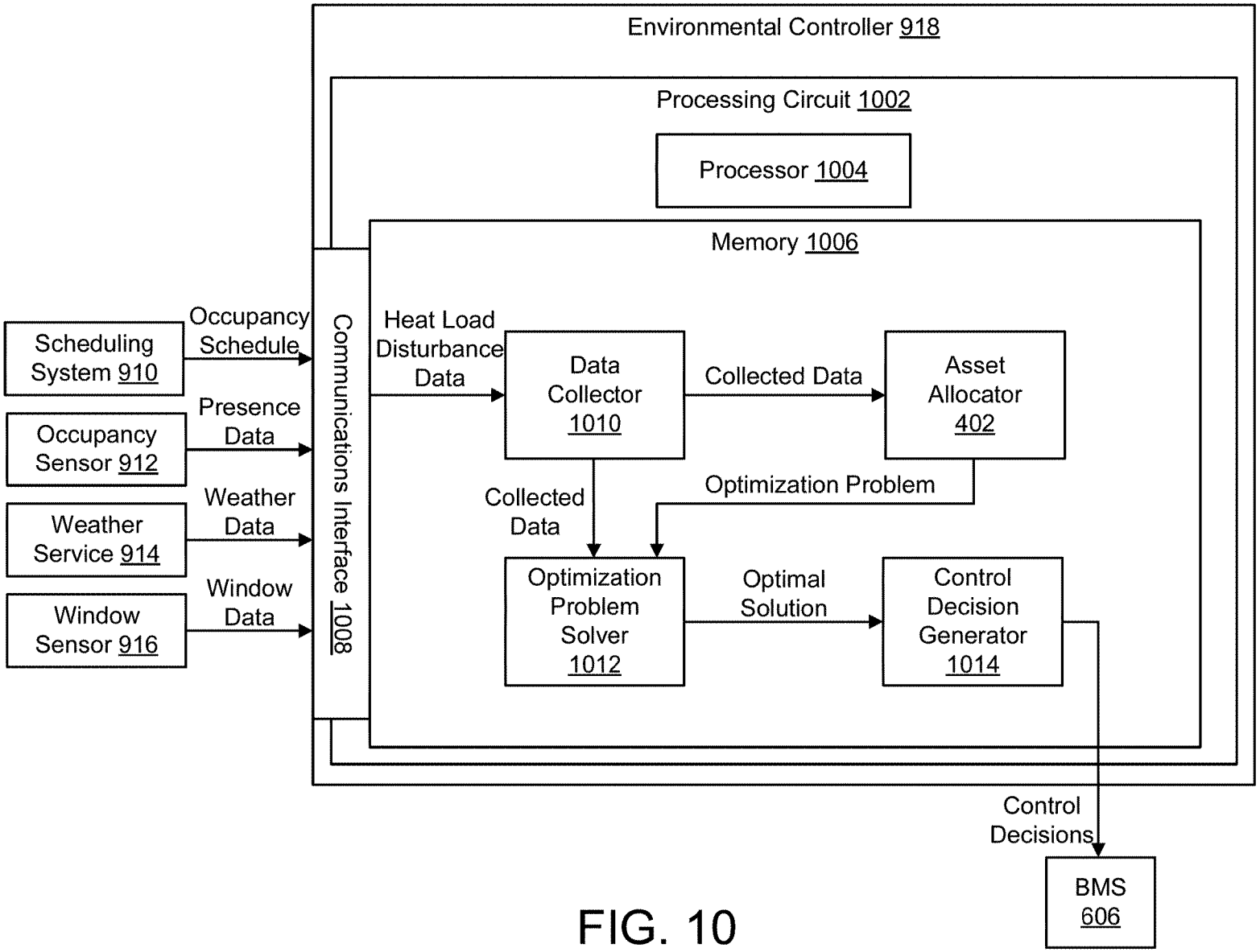
FIG. 10 is a block diagram of the environmental controller of FIG. 9 in greater detail, according to some embodiments.

Referring now to FIG. 10, environmental controller 918 as described above with reference to FIG. 9 is shown in greater detail, according to some embodiments. Environmental controller 918 can be configured to perform model predictive control (MPC) to determine how to operate building equipment of conditioned space 902 based on sources of a heat load disturbance. For example, environmental controller 918 can account for radiant heat entering through windows 906, an amount of heat generated by lighting equipment and other building equipment, heat generated by occupants, etc. and can generate control decisions to provide to BMS 606. Based on the control decisions, BMS 606 can generate control signals associated with controlling building equipment 904 to maintain comfortable conditions in conditioned space 902 based on the radiant heat. The conditions kept within comfortable ranges may include lighting, temperature, humidity, CO2 levels, or any other environmental condition of conditioned space 902. As another example, environmental controller 918 may be able to determine occupancy information (e.g., a number of occupants, when occupants are expected, etc.) in conditioned space 902 to predict how heat emitted by people may affect conditioned space 902 and how to control the building equipment based on the occupancy information.

Environmental controller 918 is shown to include a communications interface 1008 and a processing circuit 1002. Communications interface 1008 may include wired or wireless interfaces (e.g., jacks, antennas, transmitters, receivers, transceivers, wire terminals, etc.) for conducting data communications with various systems, devices, or networks. For example, communications interface 1008 may include an Ethernet card and port for sending and receiving data via an Ethernet-based communications network and/or a WiFi transceiver for communicating via a wireless communications network. Communications interface 1008 may be configured to communicate via local area networks or wide area networks (e.g., the Internet, a building WAN, etc.) and may use a variety of communications protocols (e.g., BACnet, IP, LON, etc.).

Communications interface 1008 may be a network interface configured to facilitate electronic data communications between environmental controller 918 and various external systems or devices (e.g., scheduling system 910, occupancy sensor 912, weather service 914, BMS 606, etc.). For example, environmental controller 918 may receive information from scheduling system 910 indicating times when conditioned space 902 is expected to be occupied.

Still referring to FIG. 10, processing circuit 1002 is shown to include a processor 1004 and memory 1006. Processor 1004 may be a general purpose or specific purpose processor, an application specific integrated circuit (ASIC), one or more field programmable gate arrays (FPGAs), a group of processing components, or other suitable processing components. Processor 1004 may be configured to execute computer code or instructions stored in memory 1006 or received from other computer readable media (e.g., CDROM, network storage, a remote server, etc.).

Memory 1006 may include one or more devices (e.g., memory units, memory devices, storage devices, etc.) for storing data and/or computer code for completing and/or facilitating the various processes described in the present disclosure. Memory 1006 may include random access memory (RAM), read-only memory (ROM), hard drive storage, temporary storage, non-volatile memory, flash memory, optical memory, or any other suitable memory for storing software objects and/or computer instructions. Memory 1006 may include database components, object code components, script components, or any other type of information structure for supporting the various activities and information structures described in the present disclosure. Memory 1006 may be communicably connected to processor 1004 via processing circuit 1002 and may include computer code for executing (e.g., by processor 1004) one or more processes described herein. In some embodiments, one or more components of memory 1006 are a part of a single component of memory 1006. However, each component of memory 1006 is shown separately for ease of explanation.

Memory 1006 is shown to include a data collector 1010. In some embodiments, data collector 1010 receives information communicated by scheduling system 910, occupancy sensor 912, weather service 914, and/or window sensor 916 via communications interface 1008 as heat load disturbance data. The heat load disturbance data can include any information provided to environmental controller 918 that can be utilized in solving an optimization problem. For example, the heat load disturbance data may include information regarding shading equipment 920 of windows (e.g., operational states of shading equipment 920), weather data (e.g., cloud cover data, solar intensity data, etc.), detections of occupants in conditioned space 902, a number of occupants in conditioned space 902, the occupancy schedule, etc. In some embodiments, data collector 1010 receives heat load disturbance data from other sensors, services, controllers, etc. capable of communicating information useful for model predictive control performed by environmental controller 918.

Data collector 1010 is shown to provide collected data to asset allocator 402. The collected data may include some and/or all of the heat load disturbance data collected by data collector 1010. In some embodiments, data collector 1010 provides the collected data as the heat load disturbance data is received. In some embodiments, data collector 1010 provides the collected data to asset allocator 402 after a determination that the collected data should be provided. For example, data collector 1010 may provide the collected data after a set amount of time (e.g., a second, a minute, an hour, etc.) and/or after a request for the collected data by asset allocator 402.

Based on the collected data, asset allocator 402 can construct an optimization problem for environmental controller 918 to solve. The optimization problem may include an objective function (e.g., the objective function J) to be considered during optimization. The objective function generated by asset allocator 402 may have the following form:

$$J(x) = \sum_{k=1}^{h}(\text{Source Usage Cost})_k + (\text{Total Demand Charges}) - (\text{Total Incentives}) + \sum_{k=1}^{h}(\text{Distribution Cost})_k + \sum_{k=1}^{h}(\text{Unmet/Overmet Load Penalties})_k + \sum_{k=1}^{h}(\text{Rate of Change Penalties})_k$$

where the index k denotes a time step in the optimization period and h is the total number of time steps in the optimization period. In some embodiments, asset allocator 402 is configured to perform any of the functionality of the asset allocator described in U.S. patent application Ser. No. 15/473,496 filed Mar. 29, 2017, the entirety of which is incorporated herein by reference. In some embodiments, asset allocator 402 does not require all and/or any of the collected data provided by data collector 1010 to generate the optimization problem.

It should be understood that solving the optimization problem, minimizing the objective function, etc., may not result in an ideal solution being obtained. As referred to herein, an optimal solution may refer to a solution to the optimization problem that is generated after performing a process to solve the optimization problem. The optimal solution determined by solving the optimization problem may or may not be a best solution (e.g., a solution to the optimization problem that maximizes occupant comfort and achieves a lowest possible cost) available.

Asset allocator 402 is shown to provide the optimization problem to optimization problem solver 1012. In some embodiments, optimization problem solver 1012 and asset allocator 402 are a single component of memory 1006. Optimization problem solver 1012 is also shown to receive collected data from data collector 1010. In some embodiments, the collected data provided to optimization problem solver 1012 is the same as the collected data provided to asset allocator 402 (i.e., includes the same heat load disturbance data). In some embodiments, data collector 1010 provides different collected data to optimization problem solver 1012 than to asset allocator 402. For example, optimization problem solver 1012 may require more heat load disturbance data to solve the optimization problem than is required by asset allocator 402 to construct the optimization problem. In some embodiments, data collector 1010 makes determinations regarding what information should be provided to asset allocator 402 and to optimization problem solver 1012 based on the requirements of each to perform the respective operations of each.

Optimization problem solver 1012 can utilize the collected data provided by data collector 1010 if solving the optimization problem. To solve the optimization problem, optimization problem solver 1012 can perform model predictive control (MPC) to determine values of decision variables that maintain occupant comfort and optimize (e.g., reduce) costs. In some embodiments, the values of the decision variables are included in an optimal solution to the optimization problem. In some embodiments, the optimal solution includes a setpoint trajectory. The setpoint trajectory can indicate how setpoints are to change over time given various environmental conditions. In some embodiments, optimization problem solver 1012 estimates/predicts a heat load disturbance affecting conditioned space 902 in order to determine values of the decision variables that maintain occupant comfort based on the heat load disturbance. Estimation of the heat load disturbance may be based on the received heat load disturbance data. For example, the heat load disturbance may be estimated based on operational states of lighting equipment (e.g., shade ratios of shading equipment, luminosity output levels of electric lights, etc.).

Optimization problem solver 1012 may incorporate a variety of optimization strategies to determine the values of the decision variables dependent on a form of the optimization problem provided by asset allocator 402. In some embodiments, optimization problem solver 1012 performs a coordinated control process. The coordinated control process can account for various sources of heat disturbance to determine an optimal solution for operating HVAC equipment and lighting equipment (e.g., electric lights, shading equipment, etc.). Specifically, the coordinated control process can include predicting an effect of control decisions for some equipment (e.g., lighting equipment) on a heat load disturbance and adjusting control decisions for other equipment (e.g., HVAC equipment) based on the effect. The coordinated control process may include a hierarchical approach and/or a combined optimization approach as described in greater detail below for determining how to operate building equipment. As should be appreciated, an approach used in the coordinated control process may be dependent on what control decisions are included in the optimization problem provided by asset allocator 402.

In some embodiments, asset allocator 402 includes control decisions of shading equipment 920 and/or other lighting equipment in the optimization problem. If control decisions for lighting equipment are included in the optimization problem, the coordinated control process performed by optimization problem solver 1012 may be based on a combined optimization approach. In this case, control of shading equipment 920 and/or other lighting equipment (e.g., electric lights) of building equipment 904 may be directly included in the optimization problem generated by asset allocator 402. Based on the optimization problem, optimization problem solver 1012 can determine an optimal solution to the optimization problem that maintains comfortable conditions whilst optimizing (e.g., minimizing) a cost of operating building equipment. Operating shading equipment 920 and/or other lighting equipment may be less expensive than operating HVAC equipment. Therefore, optimization problem solver 1012 may determine a solution to the optimization problem that operates shading equipment 920 and/or other lighting equipment to affect the head load disturbance before operating more expensive equipment such as the HVAC equipment.

As described above, coordinated control processes may predict an effect of control decisions for some equipment (e.g., lighting equipment) on a heat load disturbance and adjust control decisions for other equipment (e.g., HVAC equipment) based on the effect. In the combined optimization approach, prediction of the effect may be accounted for by constraints on the optimization problem that define the heat load disturbance as a function of the decision variables for equipment such as the lighting equipment. Accordingly, in the combined optimization approach, the predicted effects of operating the lighting equipment on the heat load disturbance and control decisions for other equipment (e.g., HVAC equipment) are determined simultaneously by performing a single optimization.

In some embodiments, the optimization problem generated by asset allocator 402 does not include control decisions for shading equipment 920 and/or the other lighting equipment. In this case, optimization problem solver 1012 may utilize a hierarchical approach in the coordinated control process. In some embodiments, the hierarchical approach includes determining a modified heat disturbance value and then performing the optimization of the optimization problem respective of the modified heat disturbance value. To determine the modified heat disturbance value, optimization problem solver 1012 can first estimate a heat load disturbance affecting a space (e.g., conditioned space 902). The estimated heat load disturbance can be determined based on collected data provided by data collector 1010. For example, the estimated heat load disturbance can be determined as a function of solar effects (e.g., as indicated by weather data), heat emitted by operation of building equipment, heat emitted by occupants, etc. Based on the estimated heat load disturbance, optimization problem solver 1012 can determine if shading equipment 920 and/or the other lighting equipment can be operated to move the heat load disturbance towards a desired value. In particular, optimization problem solver 1012 may predict an effect of control decisions for the lighting equipment on the heat load disturbance. For example, an operational state of "fully closed" for shading equipment 920 may be predicted to decrease the heat load disturbance whereas an operational state of "on" for electric lights may be predicted to increase the heat load disturbance. In some embodiments, said determination is at least partially based on a luminosity of the space such that operation of shading equipment 920 and/or the other lighting equipment must maintain luminosity above a threshold value and/or within a predefined range of values.

The projected operation of shading equipment 920 and/or the other lighting equipment can allow optimization problem solver 1012 to determine the modified heat disturbance value. In other words, optimization problem solver 1012 can determine the modified heat disturbance value based on a predicted amount in which shading equipment 920 and/or the other lighting equipment will affect the estimated heat load disturbance. Once the modified heat disturbance value is determined, optimization problem solver 1012 can perform an optimization of the optimization problem respective of the modified heat disturbance value to generate the optimal solution. In the hierarchical approach, optimization problem solver 1012 can determine how to operate shading equipment 920 and/or the other lighting equipment prior to performing the optimization. It should be noted that the hierarchical approach may be less computationally expensive as compared to the combined optimization described above as fewer variables need to be optimized in the optimization. Various inputs and information that can be accounted for by optimization problem solver 1012 in the combined optimization and/or the hierarchical approach are described in detail below.

In some embodiments, optimization problem solver 1012 analyzes the occupancy schedule provided by scheduling system 910 as included in the collected data provided by data collector 1010. As explained in detail above with reference to FIG. 9, the occupancy schedule can indicate times in which conditioned space 902 is expected to be utilized by occupants and when conditioned space 902 is expected to be vacant. Based on the occupancy schedule, optimization problem solver 1012 can determine values of decision variables that can maintain occupant comfort for periods in which conditioned space 902 is expected to be utilized. In some embodiments, optimization problem solver 1012 determines values of decision variables that prepare conditioned space 902 to be comfortable in advance of a period in which conditioned space 902 is expected to be utilized. For example, if the occupancy schedule indicates conditioned space 902 has a meeting scheduled starting at 1:00 p.m., optimization problem solver 1012 may determine values of decision variables that operate building equipment 904 to transition a temperature in conditioned space 902 to a comfortable temperature starting at 12:30 p.m. In this way, conditioned space 902 can be comfortable to occupants at the beginning of the meeting even if the temperature takes time to adjust based on operation of building equipment 904.

If the occupancy schedule indicates that conditioned space 902 is not occupied for a prolonged period of time (e.g., overnight, over a weekend, etc.), optimization problem solver 1012 may determine values of decision variables that reduce costs, but the decision values may not necessarily be comfortable solutions if occupant comfort does not need to be maintained. If conditioned space 902 is not expected to have occupants for the prolonged period of time, operating building equipment 904 to maintain comfortable conditions in conditioned space 902 may incur unnecessary costs (e.g., electrical consumption costs). Based on the occupancy schedule, optimization problem solver 1012 can determine values of decision variables indicate building equipment 904 need only to be operated minimally and/or not at all. By considering the occupancy schedule provided by scheduling system 910, model predictive control performed by environmental controller 918 can achieve a solution that is both cost effective and maintains occupant comfort for time periods of time when conditioned space 902 is expected to be occupied.

When solving the optimization problem, optimization problem solver 1012 can also consider presence data provided by occupancy sensor 912. As explained in greater detail above with reference to FIG. 9, occupancy sensor 912 can detect if occupants are present in conditioned space 902 and/or how many occupants are present (e.g., currently) in conditioned space 902. In some embodiments, the presence data indicated by the collected data provided by data collector 1010 can supplement the occupancy schedule. The occupancy schedule can provide information to environmental controller 918 to maintain occupant comfort at a reduced cost, but may not always reflect how conditioned space 902 is utilized in practice.

For example, an occupant may schedule a meeting in conditioned space 902 from 2:00 p.m.-4:00 p.m., but may only end up utilizing conditioned space 902 from 3:00 p.m.-4:00 p.m. (i.e., no occupants are present in conditioned space 902 from 2:00 p.m.-3:00 p.m.). As such, operating building equipment 904 to maintain occupant comfort from 2:00 p.m.-3:00 p.m. may not be necessary if no occupants are present in conditioned space 902 even if the occupancy schedule indicates otherwise. In this case, the presence data collected by occupancy sensor 912 can be utilized by optimization problem solver 1012 in order to further optimize (e.g., reduce) costs without compromising occupant comfort. For example, if the presence data indicates no occupants are present during a period of time conditioned space 902 is scheduled to be occupied as indicated by the occupancy schedule, optimization problem solver 1012 may determine values of decision variables that maintain some amount of occupant comfort in case occupants arrive, but does not operate building equipment 904 to maintain a high degree of occupant comfort as no occupants are present. If after a period of time the occupants arrive, the presence data can indicate occupants are present and/or a number of occupants present. Based on the presence data, new values of the decision variables can be determined to maintain a higher degree of occupant comfort.

As another example, conditioned space 902 may still be utilized even during times not indicated by the occupancy schedule. For example, occupants may enter conditioned space 902 for a brief conversation during a period of time not indicated by the occupancy schedule. In this case, optimization problem solver 1012 can determine based on the presence data that building equipment 904 should be operated to bring conditions of conditioned space 902 to comfortable values if the conditions are not currently comfortable. In this way, occupant comfort can be maintained in conditioned space 902 during periods of time when occupancy schedule indicates conditioned space 902 is not expected to be occupied, but occupants are nonetheless present in conditioned space 902.

Based on the occupancy schedule and/or the presence data, optimization problem solver 1012 can account for a heat load disturbance caused by emitted body heat (e.g., radiative body heat, convective body heat, etc.). As a number of people in conditioned space 902 increases, the heat load disturbance due to emitted body heat can increase. Using this information, optimization problem solver 1012 can account for the increased heat load disturbance when determining values of decision variables. For example, if the occupancy schedule indicates 20 people are to be present in a meeting, optimization problem solver 1012 can utilize a standard amount of heat emitted by a person multiplied by 20 to estimate the heat load disturbance due to body heat during the meeting. Likewise, as another example, if the presence data indicates 10 people are present in conditioned space 902, optimization problem solver 1012 can utilize the standard amount of heat emitted by a person multiplied by 10 to estimate a current heat load disturbance due to body heat. The estimated heat load disturbance due to body heat can be incorporated by optimization problem solver 1012 if determining what building devices should be operated to affect conditions in conditioned space 902. For example, if a temperature in conditioned space 902 should be increased for a meeting, but a large number of people are expected in the meeting, optimization problem solver 1012 may determine that a heater does not need to be operated as body heat emitted by the people may naturally increase the temperature in conditioned space 902.

In some embodiments, the presence data provided by occupancy sensor 912 indicates lighting information of conditioned space 902 to environmental controller 918. In some embodiments, environmental controller 918 receives the lighting information based on data provided by a separate device/sensor. The lighting information can be utilized by environmental controller 918 to ensure comfortable lighting conditions (e.g., a comfortable luminosity) are maintained in conditioned space 902. For example, if the lighting information indicates conditioned space 902 is too bright, environmental controller 918 may determine shading equipment 920 of building equipment 904 should be operated in order to reduce an amount of sunlight entering conditioned space 902. As another example, if the lighting information indicates a brightness level of conditioned space 902 is too dim, environmental controller 918 may determine lighting equipment of building equipment 904 should be operated in order to increase luminosity in conditioned space 902.

In some embodiments, environmental controller 918 can predict a change in brightness of conditioned space 902 by performing a system identification regarding conditioned space 902. The system identification can be used if determining how building equipment 904 can be operated to maintain occupant comfort. The system identification can generate a system model that can be used to capture various dynamics of conditioned space 902. Particularly, the system model can be used to predict how lighting of conditioned space 902 is affected due to operation of building equipment 904, weather conditions, etc. Likewise, the system identification can be used to determine a dynamic model of how conditioned space 902 and surfaces thereof absorb and store radiative heat from windows 906. In some embodiments, environmental controller 918 is configured to perform any of the system identification processes described in U.S. patent application Ser. No. 15/953,324 filed Apr. 13, 2018, the entirety of which is incorporated herein by reference. After a system is identified by system identification, environmental controller 918 can determine decision variables related to controlling building equipment 904 such as shading equipment 920 or lighting to affect the brightness of conditioned space 902.

In some embodiments, the lighting information is utilized to estimate/predict a heat load disturbance caused by operation of lighting equipment. As described above, operation of shading equipment 920 and/or other lighting equipment of building equipment 904 can affect a heat load disturbance affecting conditioned space 902 and/or a luminosity of conditioned space 902. With regard to the combined optimization approach described above, optimization problem solver 1012 may determine how to operate shading equipment 920 and/or the other lighting equipment by performing an optimization of the optimization problem that accounts for control decisions for said equipment. In this case, the lighting information can be utilized to estimate the heat load disturbance used directly in the optimization. With regard to the hierarchical approach described above, the lighting information may be used by optimization problem solver 1012 to estimate an initial head load disturbance and determine how to operate shading equipment 920 and/or the other lighting equipment prior to performing an optimization. In this case, optimization problem solver 1012 can calculate a modified heat disturbance value based on operation of shading equipment 920 and/or the other lighting equipment. The modified heat disturbance value can be used as input to the optimization performed by optimization problem solver 1012.

In solving the optimization problem, optimization problem solver 1012 can also account for the weather data provided by weather service 914. Similar to the presence data, the weather data can be used independently and/or in conjunction with other data by optimization problem solver 1012 in determining values of decision variables. Specifically, optimization problem solver 1012 may estimate a heat load disturbance due to said weather conditions. For example, if an outdoor temperature is cold, optimization problem solver 1012 may estimate a heat load disturbance that decreases a temperature in conditioned space 902 due to heat transfer between conditioned space 902 and external space 908. As another example, if the weather data indicates little cloud cover is present outside, optimization problem solver 1012 may estimate a high heat load disturbance that increases a temperature of conditioned space 902 due to solar radiation. Depending on an estimated heat load disturbance due to weather conditions, optimization problem solver 1012 can determine values of decision variables that operate building equipment 904 in accordance with the estimated heat load disturbance to maintain occupant comfort and optimize costs.

Optimization problem solver 1012 can also account for window data when solving the optimization problem provided by asset allocator 402. As described in greater detail above with reference to FIG. 9, the window data can indicate information regarding windows 906 of conditioned space 902 such as, for example, a number of windows 906 in conditioned space 902, an insulation factor of windows 906 (i.e., how much heat is estimated to enter/leave through windows 906), shading equipment 920 of windows 906, etc. The information indicated by the window data can be utilized by optimization problem solver 1012 in determining a heat load disturbance resulting from windows 906.

For example, if the window data indicates a large number of windows 906 are in conditioned space 902 and the weather data indicates solar effects are high, optimization problem solver 1012 may estimate a high heat load disturbance caused by solar radiation entering through windows 906. Due to the high heat load disturbance, optimization problem solver 1012 may determine values of decision variables that increase an amount of cooling provided to conditioned space 902. For example, with regard to the combined optimization approach described above, optimization problem solver 1012 may determine values of decision variables while performing the optimization that close shading equipment 920 and operate an air conditioner to mitigate the heat load disturbance caused by the solar radiation entering through windows 906. As another example, with regard to the hierarchical approach, optimization problem solver 1012 may determine how to operate shading equipment 920 and/or other lighting equipment (e.g., electric lights) to lower the heat disturbance prior to performing the optimization. Based on how shading equipment 920 and/or the other lighting equipment is operated, optimization problem solver 1012 can determine a modified heat disturbance value to use in optimizing the optimization problem for other building equipment (e.g., HVAC equipment).

The window data provided by window sensor 916 can include information regarding shading equipment 920 of windows 906. If shading equipment 920 of windows 906 is present and operable, shading equipment 920 can be operated to result in changes to a heat load disturbance. Moreover, operating shading equipment 920 may be less expensive in comparison to operating building equipment 904 to affect conditions (e.g., temperature) of conditioned space 902. As a result, shading equipment 920 can result in cost savings for model predictive control without jeopardizing occupant comfort. For example, if a temperature of conditioned space 902 should be increased to maintain occupant comfort during a meeting indicated by the occupancy schedule, shading equipment 920 of windows 906 can be operated to let sunlight into conditioned space 902 to naturally increase the temperature. Operating shading equipment 920 to increase the temperature may be less expensive than operating heating equipment to increase the temperature. Further, shading equipment 920 can be operated to let varying amounts of light into conditioned space 902 depending on whether the temperature should be later increased or decreased and/or whether a current luminosity is comfortable for occupants. As such, optimization problem solver 1012 can also utilize the window data and the weather data to determine if an amount of light in conditioned space 902 is too bright or too dim and can determine operation of shading equipment 920 and/or other lighting equipment accordingly.

Using all the information indicated by the collected data, optimization problem solver 1012 can perform model predictive control and/or some other coordinated control process to determine values of decision variables that maintain occupant comfort and optimize (e.g., reduce) costs. More particularly, optimization problem solver 1012 may utilize the combined optimization approach or the hierarchical approach dependent on decision variables included in the optimization problem generated by asset allocator 402. If optimization problem solver 1012 determines a solution to the optimization problem, the optimal solution can be provided to control decision generator 1014 as shown in FIG. 10. The values of the decision variables can be included in the optimal solution to be provided to and used by control decision generator 1014. The optimal solution may also indicate a setpoint trajectory for building equipment to achieve over an optimization period. In some embodiments, the optimal solution includes additional information regarding a solution to the optimization problem, other decisions determined by optimization problem solver 1012, and/or heat disturbance data useful to control decision generator 1014. Using the optimal solution, control decision generator 1014 can generate control decisions indicating information such as, for example, what building devices of building equipment 904 to operate, how to operate said building devices, when to operate said building devices, etc. In some embodiments, control decision generator 1014 is similar to and/or the same as low level optimizer 634 described above with reference to FIG. 6. If control decision generator 1014 is similar to and/or the same as low level optimizer 634, some and/or all of control decision generator 1014 may be implemented separate from environmental controller 918. In some embodiments, the values of the decision variables of the optimal solution provided to control decision generator 1014 are similar to and/or the same as the asset allocator provided to low level optimizer 634 by environmental controller 918 as described above with reference to FIG. 6.

The control decisions are shown to be provided to BMS 606. Based on the control decisions, BMS 606 can generate control signals to operate building equipment 904 and/or shading equipment 920 of windows 906 to affect a variable state or condition of conditioned space 902. In this way, occupant comfort can be maintained in conditioned space 902 and costs related to maintaining occupant comfort can be optimized (e.g., reduced).

Figure 11A:
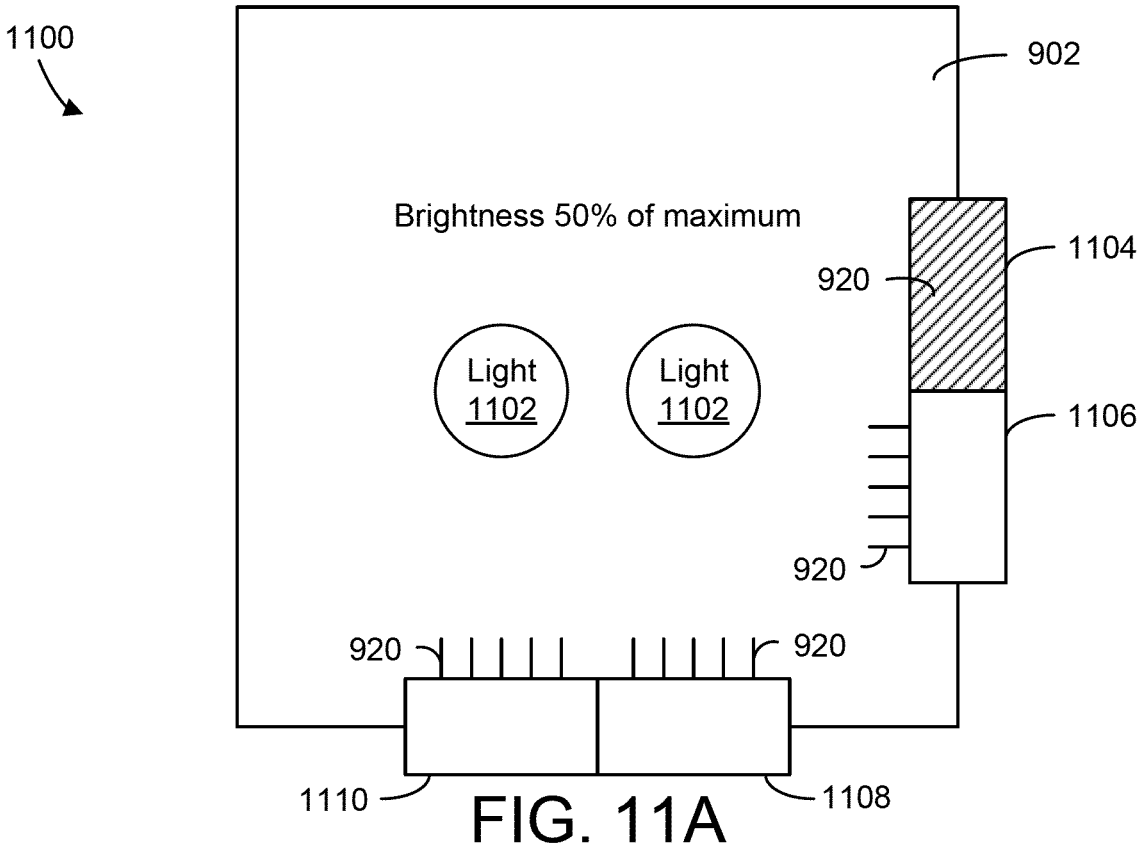
FIG. 11A is a block diagram of an environmental control system illustrating how the conditioned space of FIG. 9 can maintain comfortable conditions for occupants and optimize costs in the morning, according to some embodiments.
Figure 11B:
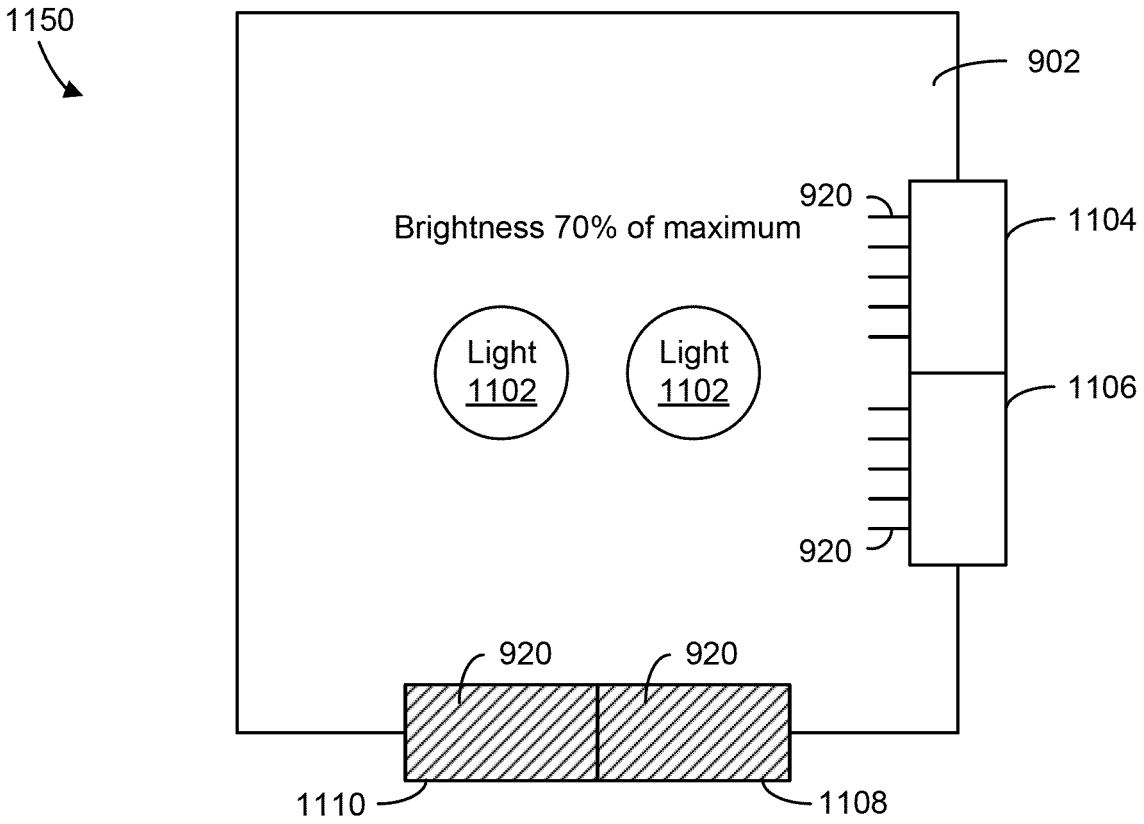
FIG. 11B is a block diagram of the environmental control system of FIG. 11A illustrating how the conditioned space of FIG. 9 can maintain comfortable conditions for occupants and optimize costs near midday, according to some embodiments.

Referring now to FIGS. 11A-11B, an environmental control system 1100 and an environmental control system 1150 are shown, according to some embodiments. Environmental control system 1100 and environmental control system 1150 illustrate how shading equipment 920 as described with reference to FIG. 9 can be operated to affect a heat load disturbance of conditioned space 902 at different times during a day. Further, environmental control system 1100 can illustrate how lights 1102 can affect both a heat load disturbance and an amount of light in conditioned space 902.

Referring particularly to FIG. 11A, environmental control system 1100 illustrates how conditioned space 902 can maintain comfortable conditions for occupants and optimize costs in the morning. In the morning, conditioned space 902 may experience limited effects due to solar radiation as the sun may be low in the sky. As such, a heat load disturbance due to solar radiation may be little. To maintain occupant comfort for both a temperature and an amount of light of conditioned space 902, a window 1104 is shown to have shading equipment 920 closed (i.e., at a maximum shade ratio) to reduce an amount of light entering conditioned space 902. However, windows 1106-1110 are shown to have shading equipment 920 open, thereby not blocking light from entering conditioned space 902. In other words, shading equipment 920 for windows 1106-1110 may be retracted to allow light to enter conditioned space 902 via windows 1106-1110. Conditioned space 902 is also shown to include two lights 1102 operable to emit light in conditioned space 902.

As FIG. 11A illustrates environmental control system 1100 in the morning, a brightness in conditioned space 902 is shown to be 50% of a maximum brightness value. In some embodiments, shading equipment 920 of window 1104 is closed as to not let additional sunlight into conditioned space 902. In some embodiments, shading equipment 920 of window 1104 is closed as to reduce a heat disturbance due to the morning sun. When solving the optimization problem, optimization problem solver 1012 should account for lights 1102 and windows 1104-1110 to balance an amount of light and a heat load disturbance affecting conditioned space 902. For example, when solving the optimization problem, optimization problem solver 1012 may determine that by closing shading equipment 920 of window 1104 and operating lights 1102 at a maximum level, conditioned space 902 can be kept comfortable for occupants based on both the temperature of conditioned space 902 and the amount of light in conditioned space 902. In some embodiments, windows 1104-1110 indicate window groups each including one or more windows.

Referring now to FIG. 11B, environmental control system 1150 illustrates how conditioned space 902 can maintain comfortable conditions for occupants and optimize costs near midday. Around midday solar effects may be higher than in the morning. As such, a heat load disturbance due to solar radiation may be higher in conditioned space 902. Further, the amount of light in conditioned space 902 may be higher as well. To mitigate the heat load disturbance and the increased amount of light, optimization problem solver 1012 is shown to determine that shading equipment 920 of window 1108 and window 1110 should be activated. By operating shading equipment 920 of window 1108 and window 1110, the heat load disturbance due to solar radiation can be reduced. However, if a comfortable brightness level for occupants is 70%, lights 1102 may be required to be operated if operating shading equipment 920 of window 1108 and window 1110 reduces the amount of light entering conditioned space 902 too much. In some embodiments, lights 1102 are dimmable lights. As such, optimization problem solver 1012 can also determine an amount to dim lights 1102 in order to maintain a comfortable amount of light in conditioned space 902 and manage a heat load disturbance caused by operation of lights 1102.

As shown in FIGS. 11A-11B, a heat load disturbance affecting conditioned space 902 can be managed by operating shading equipment 920 and lights 1102 (or other lighting equipment). In other words, occupant comfort can be maintained by operating shading equipment 920 and lights 1102. If operating shading equipment 920 and lights 1102 results in an adequate change in conditioned space 902 to maintain occupant comfort, other building equipment 904 such as heaters, air conditioners, etc. may require limited to no operation. As such, costs can be reduced when performing model predictive control by accounting for effects of shading equipment 920 and/or lights 1102. It should be noted that operating decisions for shading equipment 920 and lights 1102 may be determined either prior to performing an optimization of an optimization problem or during optimization of the optimization problem dependent on an optimization approach utilized by optimization problem solver 1012 (e.g., combined optimization approach or hierarchical approach).

Figure 12:
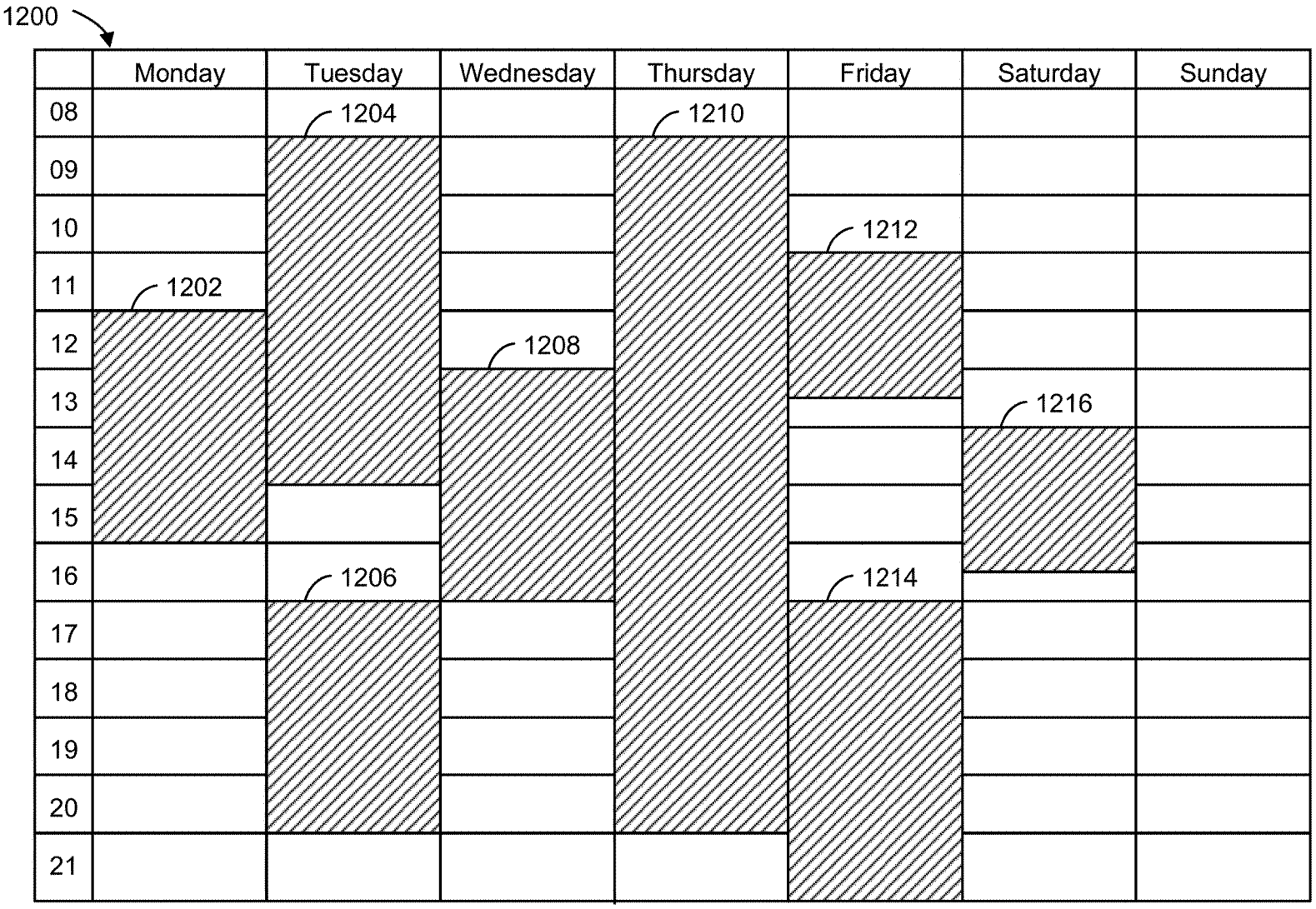
FIG. 12 is a block diagram of an occupancy schedule for the conditioned space of FIG. 9, according to some embodiments.

Referring now to FIG. 12, an occupancy schedule 1200 of conditioned space 902 is shown, according to some embodiments. Occupancy schedule 1200 can be utilized by environmental controller 918 to determine time periods when conditioned space 902 is reserved. Occupancy schedule 1200 can be determined and provided to environmental controller 918 by scheduling system 910 as described with reference to FIGS. 9 and 10. By utilizing occupancy schedule 1200, environmental controller 918 can determine how to manage building equipment 904 in order to maintain comfortable conditions while reducing costs. Particularly, optimization problem solver 1012 can utilize occupancy schedule 1200 to ensure conditions of conditioned space 902 are comfortable for occupants when occupants are expected.

Occupancy schedule 1200 is shown to include a meeting 1202, a meeting 1204, a meeting 1206, a meeting 1208, a meeting 1210, a meeting 1212, a meeting 1214, and a meeting 1216. During each meeting of meetings 1202-1216, conditioned space 902 is scheduled to be occupied. In some embodiments, each meeting of meetings 1202-1216 indicates a number of occupants anticipated for the meeting. For example, meeting 1202 is shown to occur from 12:00 p.m.-4:00 p.m. on Monday and may indicate 12 occupants are expected. In preparation for meeting 1202, optimization problem solver 1012 may determine values of decision variables indicating for building equipment 904 to be operated to adjust a temperature of conditioned space 902 to 72° F. starting at 11:45 p.m. In this way, if the temperature of conditioned space 902 takes an amount of time to adjust, conditioned space 902 can be comfortable once meeting 1202 begins.

Occupancy schedule also indicates periods of time when conditioned space 902 is not expected to have occupants. For example, after meeting 1216 on Saturday, no more meetings are shown to be scheduled. Optimization problem solver 1012 can utilize the fact no more meetings are scheduled after meeting 1216 to optimize costs. Since no more meetings are scheduled, it may not be necessary to maintain conditions comfortable for occupants as no occupants are expected to be present. By knowing that conditions do not need to be comfortable for occupants, model predictive control can optimize costs by not operating building equipment 904. In this way, occupancy schedule 1200 can allow environmental controller 918/optimization problem solver 1012 to further optimize costs in comparison to performing model predictive control without scheduling knowledge.

Figure 13:
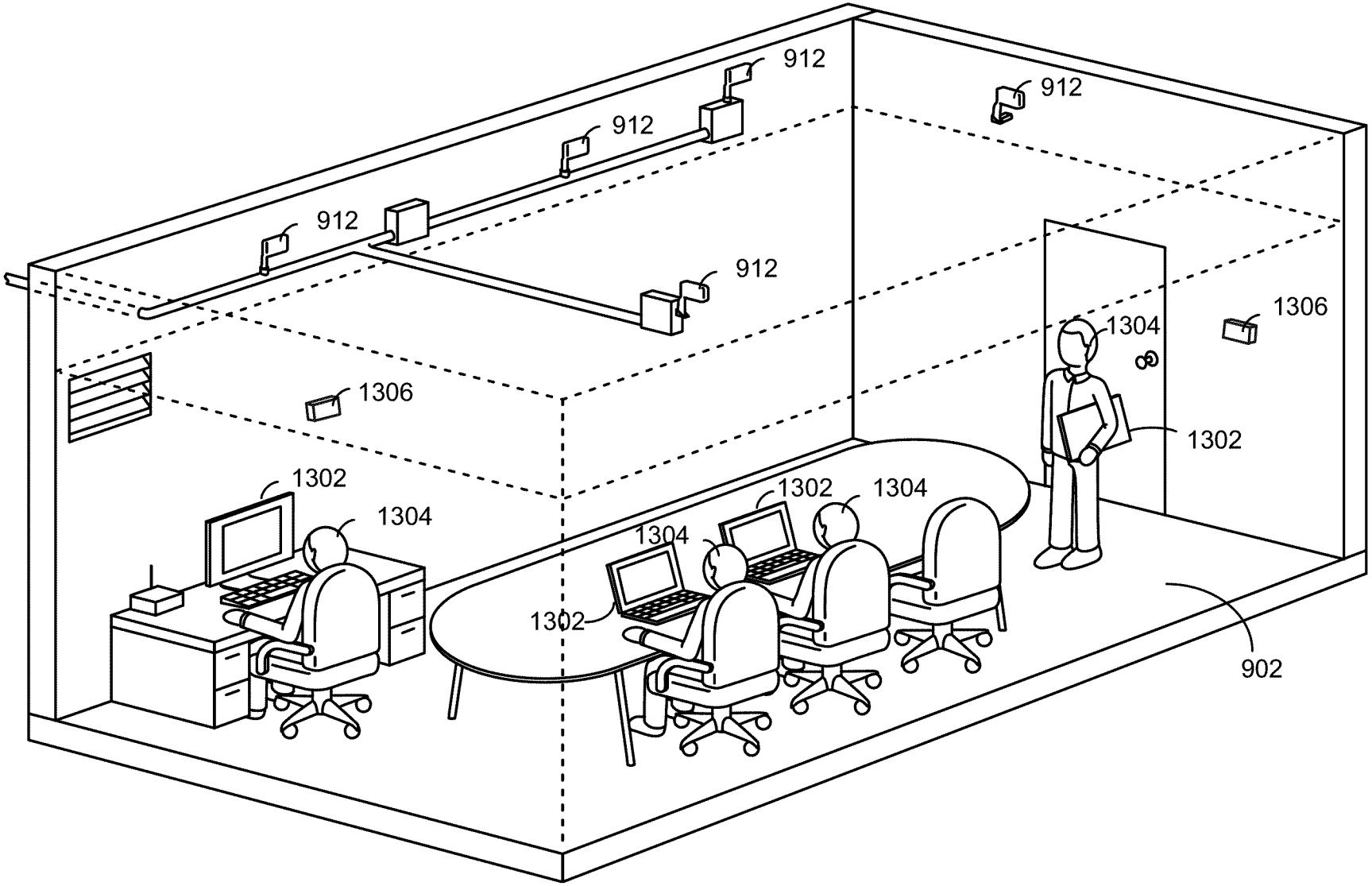
FIG. 13 is a drawing of an example configuration of the conditioned space of FIG. 9, according to some embodiments.

Referring now to FIG. 13, an example configuration of conditioned space 902 is shown, according to some embodiments. Conditioned space 902 is shown to include people 1304. In some embodiments, people 1304 cause a heat load disturbance in conditioned space 902 due to body heat emission. As such, a number of people 1304 may be required to be known to account for the heat load disturbance when solving an optimization problem. In some embodiments, the number of people 1304 is indicated by a meeting of an occupancy schedule (e.g., occupancy schedule 1200 described with reference to FIG. 12). In some embodiments, the number of people 1304 is determined based on data gathered by occupancy sensors 912. As described in greater detail with reference to FIG. 9, occupancy sensors 912 can be visual detection devices, motion sensors, and/or and type of sensor/device capable of determining if occupants are present in conditioned space 902 and/or determining how many occupants are present.

Conditioned space 902 is also shown to include light sensors 1306. Light sensors 1306 can utilized by environmental controller 918 to determine a current light level of conditioned space 902. When performing model predictive control, environmental controller 918 can ensure a brightness in conditioned space 902 is set at a comfortable value (i.e., not too bright and not too dim). Maintaining a comfortable brightness can be achieved by operating lighting equipment (e.g., lights, shading equipment 920, etc.) in conditioned space 902. In some embodiments, light sensors 1306 are incorporated in other devices of conditioned space 902. For example, if occupancy sensors 912 are visual detection devices, light sensors 1306 can be incorporated in occupancy sensors 912. If light sensors 1306 are incorporated in occupancy sensors 912, occupancy sensors 912 may provide lighting data as well as presence data to environmental controller 918.

Conditioned space 902 is also shown to include electronic devices 1302. In some embodiments, electronic devices 1302 are capable of causing a heat load disturbance in conditioned space 902. Electronic devices 1302 can include an electronic device capable of emitting heat such as, for example, laptops, phones, personal computers, etc. In some embodiments, if solving an optimization problem, optimization problem solver 1012 considers the heat load disturbance caused by electronic devices 1302. In some embodiments, optimization problem solver 1012 can estimate an amount of electronic devices present in conditioned space 902 based on a number of people 1304. For example, optimization problem solver 1012 may estimate each person of people 1304 to have 2 electronic devices 1302. As such, when estimating the heat load disturbance caused by people 1304, optimization problem solver 1012 can incorporate a heat load disturbance of each person's electronic devices 1302.

Figure 14:
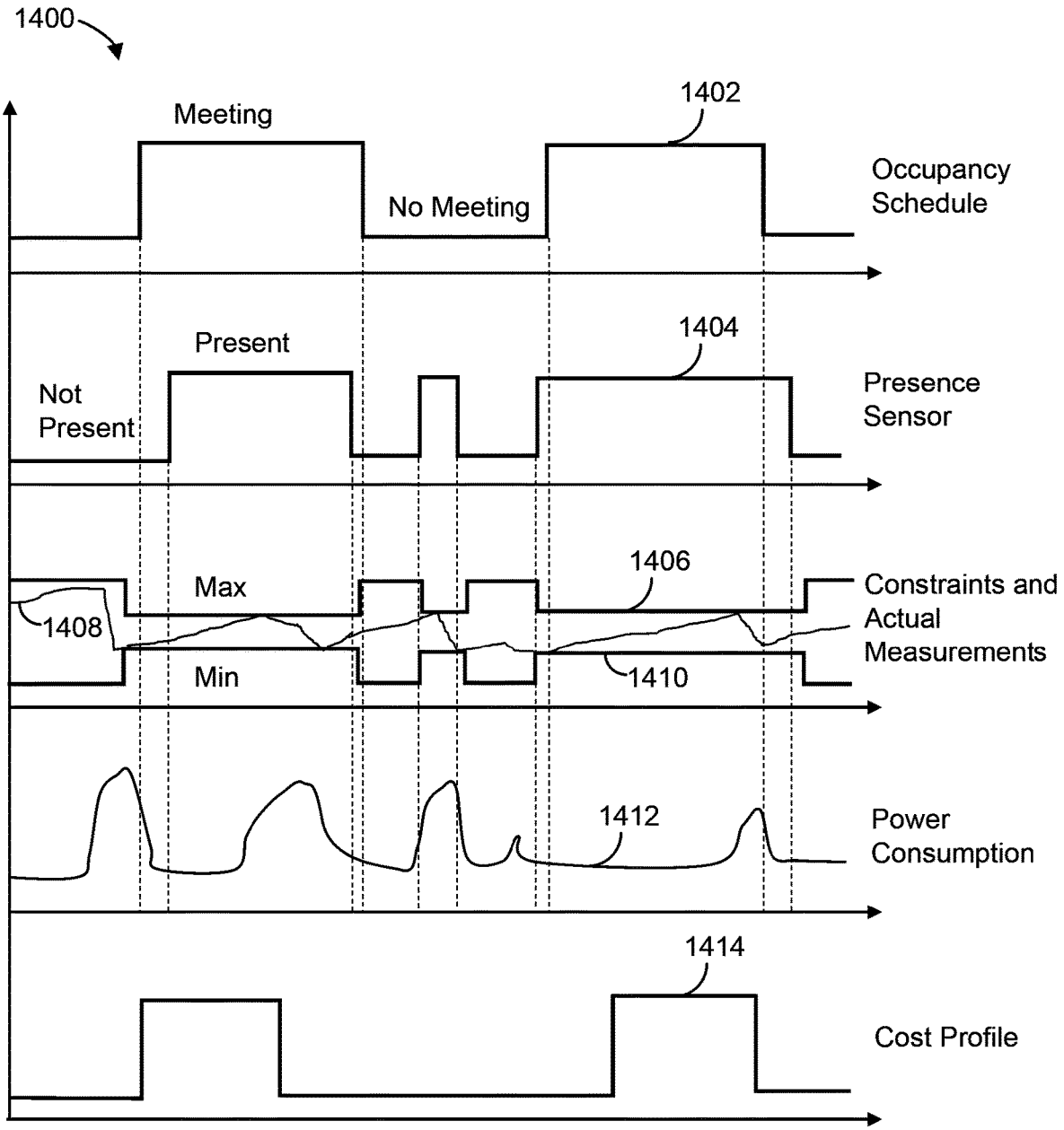
FIG. 14 is a graph illustrating a relationship between occupants in the conditioned space of FIG. 9 and costs associated with maintaining occupant comfort, according to some embodiments.

Referring now to FIG. 14, a graph 1400 illustrating a relationship between occupants in conditioned space 902 and costs associated with maintaining occupant comfort is shown, according to some embodiments. Graph 1400 is shown to include a series 1402. Series 1402 illustrates how an occupancy schedule (e.g., occupancy schedule 1200 as described with reference to FIG. 12) can indicate time periods when conditioned space 902 has a meeting scheduled. Particularly, series 1402 is shown to include a first meeting and a second meeting as indicated by the occupancy schedule.

Graph 1400 is also shown a series 1404 illustrating detections of occupants in conditioned space 902. In some embodiments, series 1404 is determined by occupancy sensor 912 as described with reference to FIG. 9. Series 1404 is shown to illustrate three periods of time when occupants are detected in conditioned space 902. The first detection of occupants is shown to occur during a portion of the first meeting indicated by series 1402. A second detection of occupants is shown to occur outside of any meetings indicated by series 1402. Finally, a third detection of occupants is shown to occur starting before the second meeting begins and the third detection is shown to stop after the second meeting ends. Series 1404 illustrates how occupants the occupancy schedule may only partially reflect how conditioned space 902 is utilized by occupants. For example, the second detection of occupants may not correlate with any meeting indicated by the occupancy schedule. Therefore, without an ability to detect occupants beyond the occupancy schedule, environmental controller 918 may otherwise determine occupant comfort does not need to be maintained in time periods outside meetings indicated by the occupancy schedule. However, series 1404 clearly illustrates that occupants may not strictly follow the occupancy schedule when utilizing conditioned space 902.

Graph 1400 is also shown to include a series 1406, a series 1408, and a series 1410. Series 1408 illustrates measurements of a condition (e.g., temperature) in conditioned space 902. Series 1406 and series 1410 are shown to illustrate a maximum and a minimum constraint on a condition of conditioned space 902 respectively. For example, series 1406 and series 1410 may illustrate a maximum temperature constraint and a minimum temperature constraint on a temperature in conditioned space 902 and series 1408 illustrates measurements of said temperature. As another example, series 1406 and series 1410 can illustrate a maximum luminosity constraint and a minimum luminosity constraint on conditioned space 902 respectively and where series 1408 illustrates measurements of the luminosity. Based on the constraints set by series 1406 and series 1410, series 1408 is shown to stay between said constraints.

Series 1406 and series 1410 are shown to place narrower constraints on series 1408 in response to meetings indicated by series 1402 and presence of occupants indicated by series 1404. For example, before the first meeting indicated by series 1402 begins, a difference between the maximum and minimum constraint indicated by series 1406 and series 1410 is shown to narrower. The difference may narrow as to ensure occupant comfort is maintained throughout the first meeting as to restrict allowable values of the condition indicated by series 1408. Similarly, for example, the difference between series 1406 and series 1410 is shown to narrow based on the second detection of occupants indicated by series 1404. Even though the second detection of occupants is shown to not occur in relation to any meetings, conditioned space 902 may still be required to be comfortable for occupants in conditioned space 902. As such, upon detection of occupants, the difference between series 1406 and series 1410 is shown to narrow.

However, during periods of time when no occupants are detected as indicated by series 1404 and no meetings are scheduled as indicated by series 1402, the difference between series 1406 and series 1410 is shown to be larger than when meetings are scheduled and/or occupants are present. During said periods of time, no occupants may be in conditioned space 902 and no occupants may be expected to be in conditioned space 902. As such, occupant comfort may not be required to be maintained. By not requiring environmental controller 918 to maintain occupant comfort during said periods of time, costs can be reduced by allowing a larger range of adequate values of the condition indicated by series 1408.

Graph 1400 is also shown to include a series 1412 illustrating power consumption over time. Power consumption indicated by series 1412 is shown to fluctuate in relation to series 1408. If series 1408 approaches constraints set by series 1406 and series 1410, building equipment 904 can be operated to ensure the condition illustrated by series 1408 stays within the constraints. If operating building equipment 904, power consumption can increase.

Graph 1400 is also shown to include a series 1414 illustrating a cost profile over time. Series 1414 is shown to have two periods of time when costs are anticipated to be high, particularly during the two meetings indicated by series 1402. The cost profile can be used to estimate an amount required to be spent over time on operation of building equipment 904. As such, it may be estimated that costs are higher during periods of time when building equipment 904 will be required to be operated (e.g., during meetings).

In some embodiments, environmental controller 918 uses graph 1400 to solve the optimization problem. Based on meetings indicated by series 1402 and occupant presence indicated by series 1404, environmental controller 918 can determine how to operate building equipment 904 to ensure occupant comfort is maintained while optimizing (e.g., reducing) costs.

Processes for Maintaining Occupant Comfort Based on Heat Load Disturbances

Figure 15:
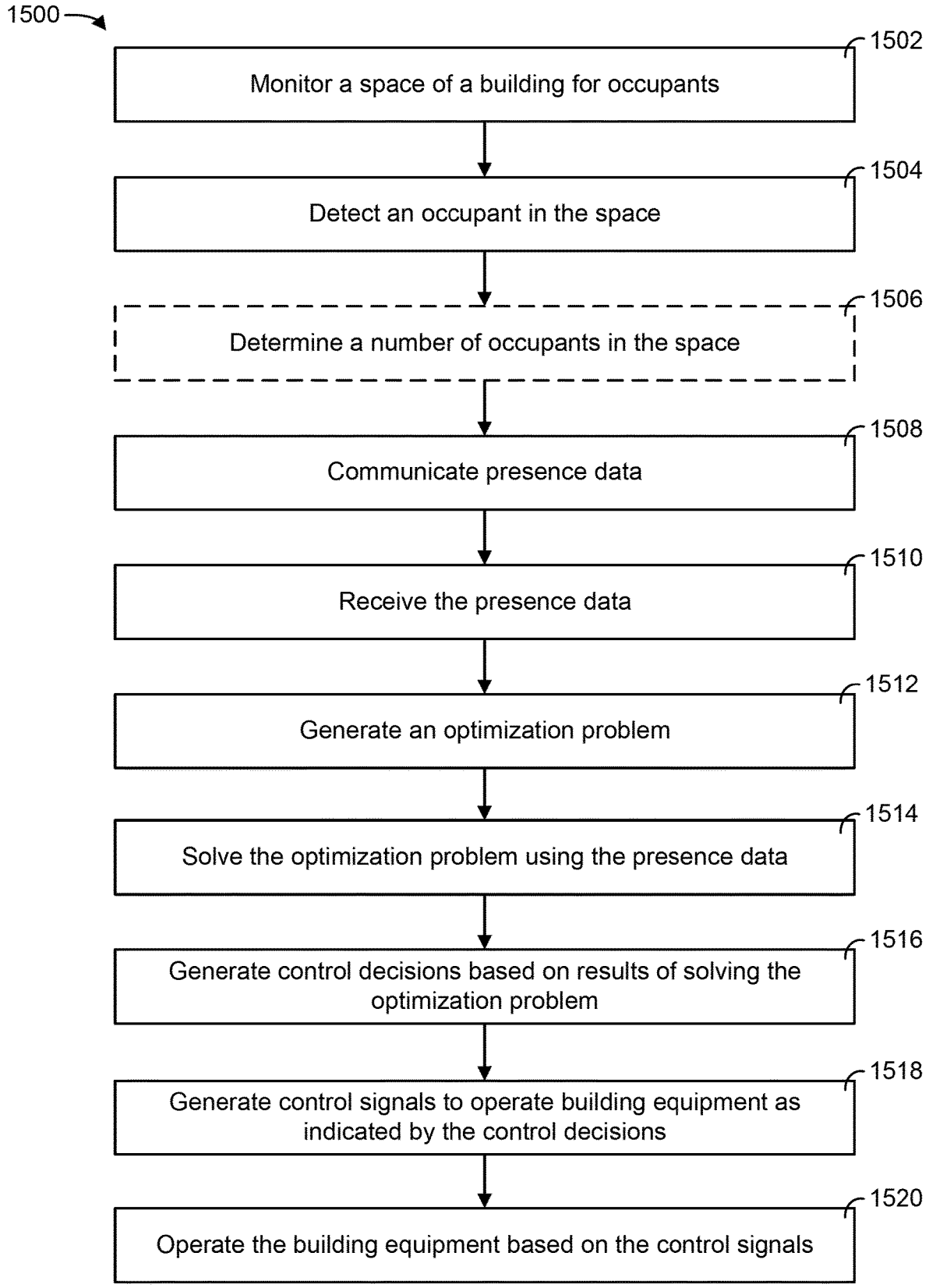
FIG. 15 is a flow diagram of a process for maintaining occupant comfort in a space of a building based on occupant presence within the space, according to some embodiments.
Figure 16:
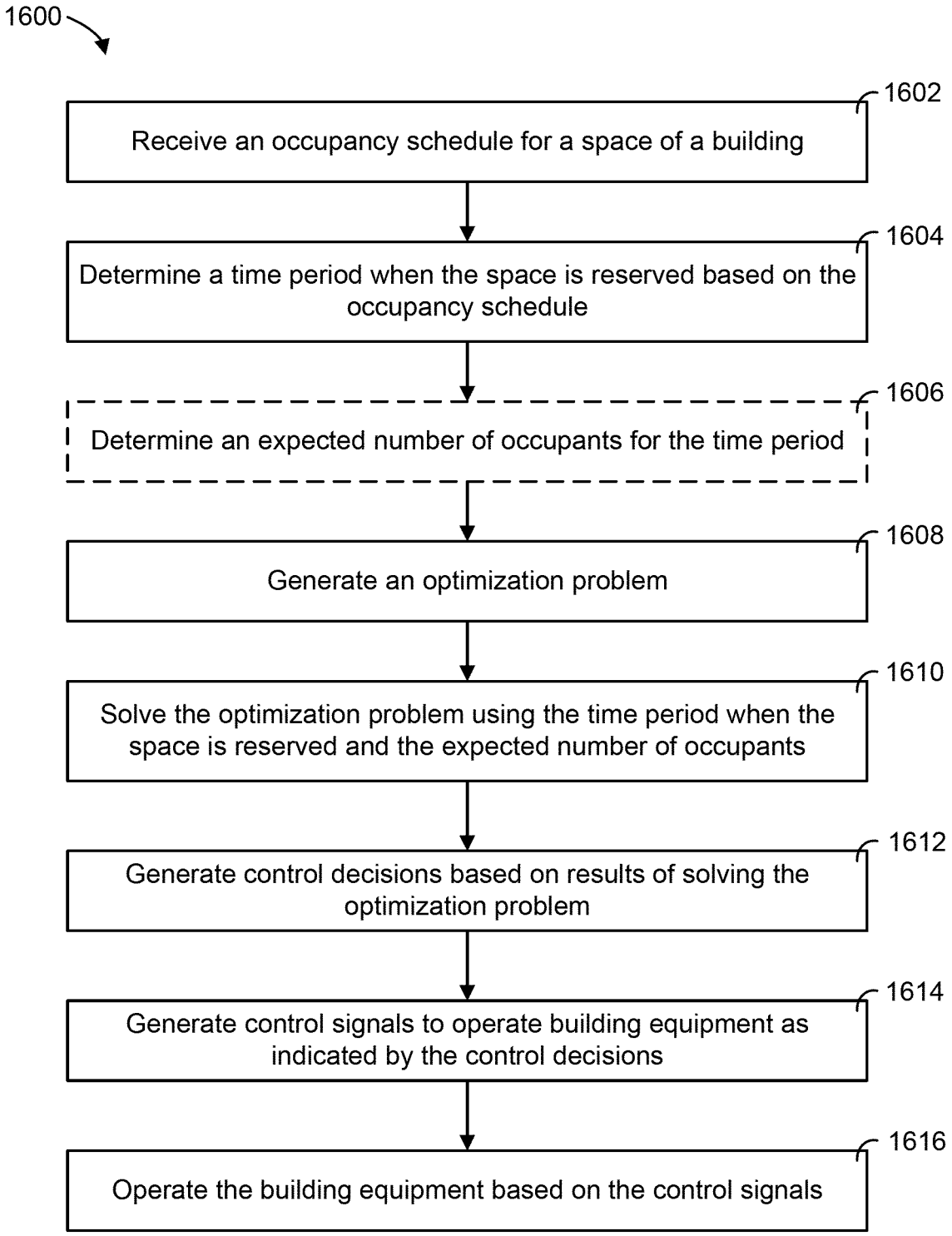
FIG. 16 is a flow diagram of a process for maintaining occupant comfort in a space of a building based on an occupancy schedule for the space, according to some embodiments.
Figure 17:
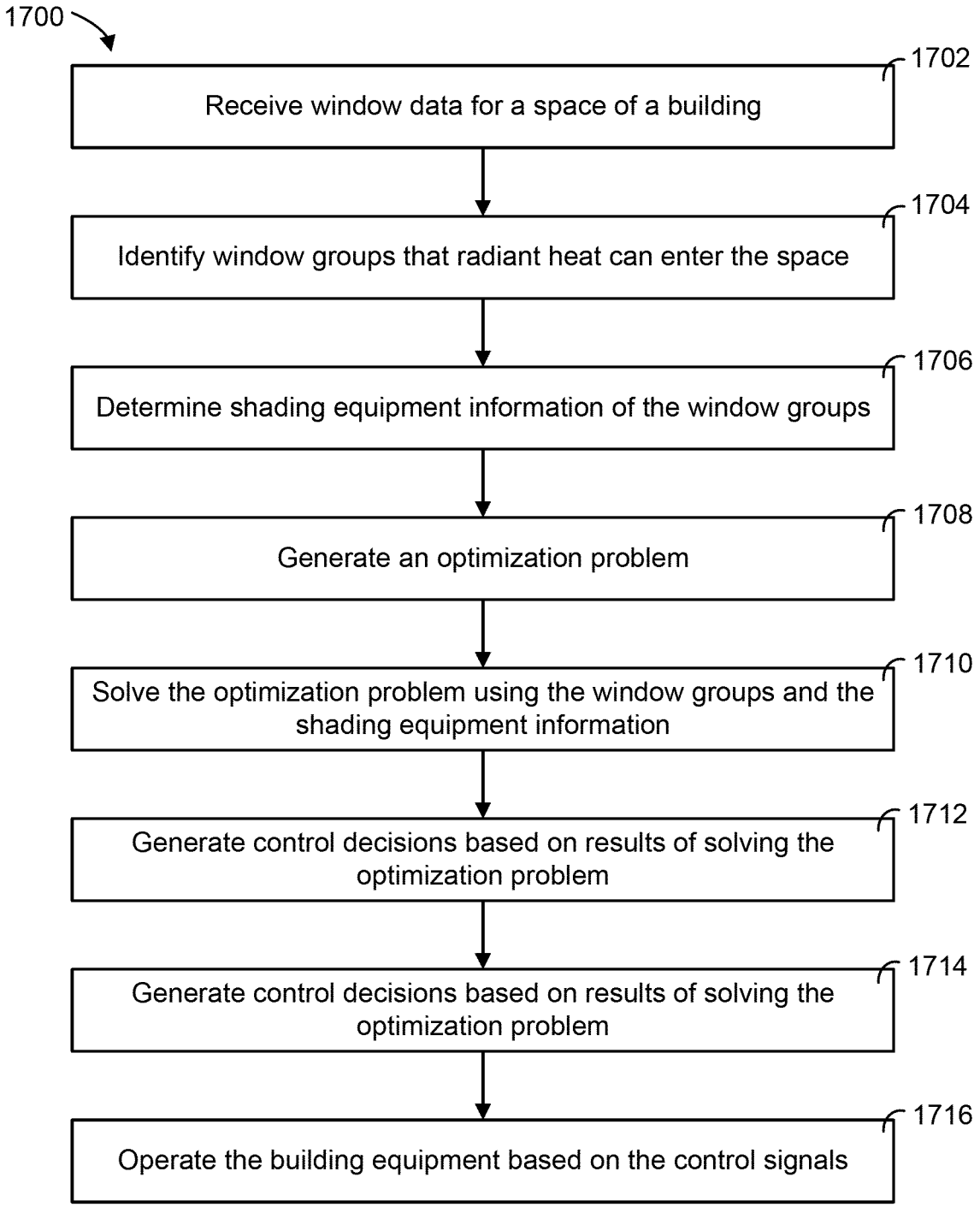
FIG. 17 is a flow diagram of a process for maintaining occupant comfort in a space of a building based on information regarding windows and shading equipment of the space, according to some embodiments.

Referring generally to FIGS. 15-17, processes for maintain occupant comfort based on heat load disturbances are shown and described, according to some embodiments. FIGS. 15-17 are shown individually to illustrate how various sources of information related to heat load disturbances may be utilized in generating and solving an optimization problem. However, it should be appreciated that some and/or all steps of the processes defined in FIGS. 15-17 can be included in a single process that accounts for various sources of information and solves the optimization problem accordingly. Moreover, the processes defined in FIGS. 15-17 may be solved using either a combined optimization approach or a hierarchical approach as described in greater detail above with reference to FIG. 10, according to some embodiments. In other words, the optimization problems defined in FIGS. 15-17 may include different variables (e.g., different control decisions) depending on an approach used. Further, solving the optimization problems may include different steps dependent on what variables are included in the optimization problems. It should be noted that the process described throughout FIGS. 15-17 can be similarly applied for a variety of disturbances (e.g., humidity disturbances, air quality disturbances, etc.) in addition to and/or separate from heat load disturbances.

Referring now to FIG. 15, a process 1500 for maintaining occupant comfort in a space of a building based on occupant presence within the space is shown, according to some embodiments. In some embodiments, process 1500 illustrates how presence data can be utilized if solving an optimization problem. If occupants are present in the space, the space may need to be managed such that conditions (e.g., temperature, humidity, etc.) of the space are comfortable for occupants. However, if occupants are not present in the space, maintaining comfortable conditions in the space may not be required to maintain occupant comfort and costs can be saved. As such, process 1500 illustrates how occupant comfort can be maintained in the space while optimizing (e.g., reducing) costs. In some embodiments, some and/or all steps of process 1500 are performed by components of environmental control system 900.

Process 1500 is shown to include monitoring a space of a building for occupants (step 1502), according to some embodiments. If an occupant is present in the space, conditions of the space may be required to be adjusted as to maintain comfort of the occupant. However, if the space is unoccupied, occupant comfort does not necessarily have to be maintained and cost savings can be achieved. Monitoring the space for the occupant can also aid in determining if a heat load disturbance is affecting the space due to heat emitted by the occupant. In some embodiments, step 1502 is performed by occupancy sensor 912.

Process 1500 is shown to include detecting an occupant in the space (step 1504), according to some embodiments. If the occupant is detected, conditions of the space can be adjusted as to ensure the occupant is comfortable in the space. For example, if a temperature comfortable in the space for the occupant is 72° F. but a current temperature in the space is 76° F., the space may require cooling to maintain occupant comfort. As another example, if a brightness value of the space comfortable to the occupant is 75% but a current brightness value of the space is 56%, the space may require additional lighting. The occupant can be detected by a device in the space. For example, the occupant may be detected by a video camera monitoring the space. As another example, the occupant may be detected due to motion captured by a motion detector. In some embodiments, step 1504 is performed by occupancy sensor 912.

Process 1500 is shown to include determining a number of occupants in the space (step 1506), according to some embodiments. Step 1506 is shown as an optional step in process 1500 as the space may not include any devices capable of determining the number of occupants. For example, if occupants are detected by a motion detection device, the motion detection device may not be able determine the number of occupants. In some embodiments, the number of occupants in the space is utilized when determining a total heat disturbance due to emitted body heat. If the number of occupants is not determined, an estimated heat load disturbance of the space may not be accurate. If the estimated heat load disturbance is not accurate, conditions of the space may be inaccurately adjusted. For example, if a current temperature of the space is 68° F. while a comfortable temperature is 72° F., the space may require additional heating. However, if a large number of occupants are in the space, body heat emitted by the occupants may naturally increase the temperature. Therefore, if building equipment is operated to increase the temperature, the temperature of the space may become too warm. Thus, determining the number of occupants in the space may be beneficial in determining how to operate the building equipment. In some embodiments, step 1506 is performed by occupancy sensor 912.

Process 1500 is shown to include communicating presence data (step 1508), according to some embodiments. The presence data communicated in step 1508 may include information gathered in step 1504 and/or step 1506. In some embodiments, step 1508 is performed by occupancy sensor 912.

Process 1500 is shown to include receiving the presence data (step 1510), according to some embodiments. The presence data may be received over various data transferring mediums. For example, the presence data may be received by a wired or wireless connection. For example, the presence data may be transmitted and received over a Wi-Fi channel. In some embodiments, step 1510 is performed by environmental controller 918.

Process 1500 is shown to include generating an optimization problem (step 1512), according to some embodiments. The optimization problem can be used to determine how to operate building equipment to maintain occupant comfort while optimizing (e.g., reducing) costs. In some embodiments, the presence data received in step 1510 is utilized when generating the optimization problem. However, the optimization problem may not require the presence data to be generated depending on a structure of the optimization problem. The optimization problem generated in step 1512 can include a cost function that can be optimized. In some embodiments, step 1512 is performed by asset allocator 402.

Process 1500 is shown to include solving an optimization problem using the presence data (step 1514), according to some embodiments. If the presence data is used to solve the optimization problem, costs can be further optimized without jeopardizing occupant comfort. As described above, if occupants are present in the space, conditions of the space can be required to be comfortable. However, if occupants are not present in the space, conditions may not be required to be comfortable. Based on the presence data whether or not occupant comfort is to be maintained in the space can be determined. Without the presence data, the optimization problem may be required to be solved as to always maintain occupant comfort. Always having to maintain occupant comfort may not be cost effective. Therefore, by solving the optimization problem using the presence data, a more optimal solution to the optimization problem can be attained. In some embodiments, step 1514 is performed by optimization problem solver 1012.

Process 1500 is shown to include generating control decisions based on results of solving the optimization problem (step 1516), according to some embodiments. The results of the optimization problem can indicate how building equipment should be operated in order to maintain occupant comfort while optimizing (e.g., reducing) costs. As such, the control decisions generated in step 1516 extract said indications from the results as to be utilized for operating the building equipment. For example, a control decision may indicate for a heater to be operated at 60% of full operational power for 20 minutes starting at 1:00 p.m. In some embodiments, each control decision generated in step 1516 is associated with operation of a single device. In some embodiments, each control decision generated in step 1516 is associated with operation of multiple devices and/or is associated with multiple operations of one or more devices. In some embodiments, step 1516 is performed by control decision generator 1014.

Process 1500 is shown to include generating control signals to operate building equipment as indicated by the control decisions (step 1518), according to some embodiments. A control signal can be communicated to a building device of the building equipment in order to operate the building device to affect a variable state or condition of the space. In some embodiments, each control signal includes a single instruction regarding operation of a building device. In some embodiments, each control signal includes multiple instructions regarding operation of the building device. In some embodiments, step 1518 is performed by BMS 606.

Process 1500 is shown to include operating the building equipment based on the control signals (step 1520), according to some embodiments. By operating the building equipment based on the control signals generated in step 1518, conditions of the space can be adjusted to be comfortable to occupants. For example, a control signal may operate shading equipment of a window to reduce luminosity of the space. By operating the shading equipment, a brightness of the space and/or a heat load disturbance of the space due to solar effects can be affected. In some embodiments, step 1520 is performed by building equipment 904.

Referring now to FIG. 16, a process 1600 for maintaining occupant comfort in a space of a building based on an occupancy schedule for the space is shown, according to some embodiments. The occupancy schedule can be utilized to determine periods of time when the space is expected to have occupants. The occupancy schedule may also indicate how many occupants are expected during each period of time. Using this information, comfortable conditions of the space can be maintained and costs can be optimized (e.g., reduced). Without information indicated by the occupancy schedule, the space may always be required to maintain occupant comfort even if periods of time when no occupants are expected to be in the space exist. As such, the occupancy schedule can be useful when performing model predictive control to maintain occupant comfort in the space as needed in order to optimize costs. In some embodiments, some steps of process 1600 are similar to and/or the same as some steps of process 1500 described with reference to FIG. 15. In some embodiments, process 1600 is utilized independently. In some embodiments, process 1600 is utilized in conjunction with process 1500 in performing model predictive control. In some embodiments, some and/or all steps of process 1600 are performed by components of environmental control system 900.

Process 1600 is shown to include receiving an occupancy schedule for a space of a building (step 1602), according to some embodiments. As described above, the occupancy schedule may indicate periods of time when the space is reserved and is expected to have occupants. The occupancy schedule may also indicate a number of occupants expected during the reservation. In some embodiments, step 1602 is performed by environmental controller 918.

Process 1600 is shown to include determining a time period when the space is reserved based on the occupancy schedule (step 1604), according to some embodiments. The time period can be any period of time indicated by the occupancy schedule in which the space is reserved. For example, the time period may indicate the space is reserved for maintenance activities from 9:00a.m.-4:00 p.m. on a weekday. During the time period, conditions of the space may be required to be comfortable for occupants. In some embodiments, step 1604 is performed by optimization problem solver 1012 and/or data collector 1010.

Process 1600 is shown to include determining an expected number of occupants for the time period (step 1606), according to some embodiments. Step 1606 is shown as an optional step in process 1600 as the occupancy schedule may not indicate a number of expected occupants. For example, the occupancy schedule may only whether the space is expected to be occupied (e.g., via a binary variable where 0 indicates the space is not expected to be occupied and 1 indicates the space is expected to be occupied). If the occupancy does indicated the expected number of occupants, the expected number of occupants can be used for determining other helpful information. For example, based on the expected number of occupants, an estimated heat disturbance due to emitted body heat can be determined. In some embodiments, if the expected number of occupants is not indicated by the occupancy schedule, expected number of occupants is estimated based on other information known regarding the space. For example, the expected number of occupants can be estimated based on an average number of occupants typically in the same, some fraction of a total number of occupants allowed in the space, etc. In some embodiments, step 1606 is performed by optimization problem solver 1012 and/or data collector 1010.

Process 1600 is shown to include generating an optimization problem (step 1608), according to some embodiments. In some embodiments, step 1608 is similar to and/or the same as step 1512 of process 1500 as described with reference to FIG. 15. In some embodiments, generating the optimization problem utilizes the occupancy schedule and/or the information determined in step 1604 and/or step 1606. However, generating the optimization problem may not require information gathered in steps 1602-1606 depending on a structure of the optimization problem. The optimization problem can be used to determine how to operate building equipment to maintain occupant comfort while optimizing (e.g., reducing) costs. In some embodiments, step 1608 is performed by asset allocator 402.

Process 1600 is shown to include solving the optimization problem using the time period when the space is reserved and the expected number of occupants (step 1610), according to some embodiments. In some embodiments, step 1610 is similar to and/or the same as step 1514 of process 1500. If the time period and the expected number of occupants is used to solve the optimization problem, costs can be further optimized without jeopardizing occupant comfort. As described above, if occupants are present in the space, conditions of the space can be required to be comfortable. By utilizing the time period, results of step 1610 can ensure that the space is comfortable throughout the time period. Particularly, step 1610 can ensure conditions of the space are comfortable before the time period begins as to have no lapse in occupant comfort due to conditions taking time to be adjusted. In step 1610, the number of occupants can be used to determine a heat load disturbance due to body heat emitted by the occupants. The larger the number of expected occupants, the larger the heat load disturbance may be. For example, a meeting with 5 occupants may cause a smaller heat load disturbance than a meeting with 30 occupants. Based on the estimated heat load disturbance, results of step 1610 can utilize desired effects of the heat load disturbance and/or mitigate unwanted effects of the heat load disturbance to ensure occupant comfort is maintained and costs are optimized (e.g., reduced). Therefore, by solving the optimization problem using information indicated by the occupancy schedule, a more optimal solution to the optimization problem can be attained. In some embodiments, step 1610 is performed by optimization problem solver 1012.

Process 1600 is shown to include generating control decisions based on results of solving the optimization problem (step 1612), according to some embodiments. In some embodiments, step 1612 is similar to and/or the same as step 1516. The results of the optimization problem can indicate how building equipment should be operated in order to maintain occupant comfort while optimizing (e.g., reducing) costs. As such, the control decisions generated in step 1612 extract said indications from the results as to be utilized for operating the building equipment. For example, a control decision may indicate for shading equipment of a window to be partially lowered at 11:00 a.m. to mitigate effects of solar radiation that are highest near midday. In some embodiments, each control decision generated in step 1612 is associated with operation of a single device. In some embodiments, each control decision generated in step 1612 is associated with operation of multiple devices and/or is associated with multiple operations of one or more devices. In some embodiments, step 1612 is performed by control decision generator 1014.

Process 1600 is shown to include generating control signals to operate building equipment as indicated by the control decisions (step 1614), according to some embodiments. In some embodiments, step 1614 is similar and/or the same as step 1518 of process 1500. A control signal can be communicated to a building device of the building equipment in order to operate the building device to affect a variable state or condition of the space. In some embodiments, each control signal includes a single instruction regarding operation of a building device. In some embodiments, each control signal includes multiple instructions regarding operation of the building device. In some embodiments, step 1614 is performed by BMS 606.

Process 1600 is shown to include operating the building equipment based on the control signals (step 1616), according to some embodiments. In some embodiments, step 1616 is similar to and/or the same as step 1520 of process 1500. By operating the building equipment based on the control signals generated in step 1614, conditions of the space can be adjusted to be comfortable to occupants. For example, a control signal may operate an air conditioner of the space in order to reduce a temperature of the space. In some embodiments, step 1616 is performed by building equipment 904.

Referring now to FIG. 17, a process 1700 for maintaining occupant comfort in a space of a building based on information regarding windows and shading equipment of the space is shown, according to some embodiments. Windows in the space cause a heat load disturbance in the space due to solar radiation entering through the window, a heat exchange facilitated by the window between the space and the outdoors, etc. As such, if the windows are not considered when performing model predictive control, results of the model predictive control may not maintain comfort and/or may not optimize (e.g., reduce) costs. Further, shading equipment can be considered when performing model predictive control in order to control a brightness of the space and/or the heat load disturbance caused by the windows. By considering shading equipment, costs related to maintaining occupant comfort can be reduced as operating the shading equipment may be inexpensive in comparison to operating other building equipment such as, for example, heaters, air conditioners, etc. In some embodiments, some steps of process 1700 are similar to and/or the same as some steps of process 1600 described with reference to FIG. 16. In some embodiments, process 1700 is utilized for model predictive control independently. In some embodiments, process 1700 is utilized in conjunction with process 1500 and/or process 1600 in performing model predictive control. In some embodiments, some and/or all steps of process 1700 are performed by components of environmental control system 900.

Process 1700 is shown to include receiving window data for a space of a building (step 1702), according to some embodiments. As described above, the window data can include information regarding windows and/or shading equipment in the space. The window data may include information regarding dynamics of the windows. For example, the window data may include information such as an insulation factor of the windows, a reflectance of the windows, if the windows absorb any wavelengths of light, etc. Likewise, information regarding the shading equipment may include how much light the shading equipment blocks, an insulation factor of the shading equipment, how much energy is required to operate the shading equipment, etc. Some and/or all of the above information can be used to perform model predictive control of the space. In some embodiments, step 1702 is performed by environmental controller 918.

Process 1700 is shown to include identifying window groups that radiant heat can enter the space (step 1704), according to some embodiments. A window group may include one or more associated windows in the space. For example, a particular window group may include all windows of the space on a southern wall of the space. Utilizing window groups can reduce computational complexity of performing model predictive control as fewer variables may be considered. In some embodiments, instead of identifying window groups in step 1704, individual windows are identified. If individual windows are identified from the window data, more acute dynamics (e.g., thermal dynamics) of the space may be captured if performing model predictive control. In some embodiments, step 1704 is performed by data collector 1010 and/or optimization problem solver 1012.

Process 1700 is shown to include determining shading equipment information of the window groups (step 1706), according to some embodiments. In some embodiments, if individual windows are identified in step 1704, step 1706 may include determining shading equipment of each window. The determined shading equipment can be utilized in performing model predictive control by facilitating an additional method for managing conditions (e.g., temperature, brightness, etc.) of the space. The information determined in step 1706 may also include information of the shading equipment such as, for example, how long it takes to operate the shading equipment (e.g., how long to raise/low a blind), how much energy is required to operate the shading equipment, how much external light is blocked by the shading equipment, etc. Some and/or all of the above information can be utilized in performing model predictive control to determine cost-effective methods for maintaining occupant comfort. In some embodiments, step 1706 is performed by data collector 1010 and/or optimization problem solver 1012.

Process 1700 is shown to include generating an optimization problem (step 1708), according to some embodiments. In some embodiments, step 1708 is similar to and/or the same as step 1608 of process 1600. In some embodiments, generating the optimization problem utilizes the window data and/or the information determined in step 1704 and/or step 1706. However, generating the optimization problem may not require information gathered in steps 1702-1706 depending on a structure of the optimization problem. The optimization problem can be used to determine how to operate building equipment to maintain occupant comfort while optimizing (e.g., reducing) costs. In some embodiments, if a combined optimization approach is utilized in process 1700, the optimization problem generated in step 1708 may include control decisions for the shading equipment and/or other lighting equipment. If, however, a hierarchical approach is utilized in process 1700, the shading equipment and/or the other lighting equipment may not be included in the optimization problem. In other words, control decisions included in the optimization problem may be based on a coordinated control process utilized in process 1700. Alternatively, the coordinated control process utilized in process 1700 may be based on what control decisions are included in the optimization problem. In some embodiments, step 1708 is performed by asset allocator 402.

Process 1700 is shown to include solving the optimization problem using the window groups and the shading equipment information (step 1710), according to some embodiments. In some embodiments, step 1710 is similar to and/or the same as step 1610 of process 1600. By using information regarding the window groups (or individual windows) and the shading equipment, the optimization problem can be solved such that occupant comfort is maintained at a lower cost. In step 1710, information regarding the window groups can be utilized to determine a heat load disturbance affecting the space due to windows. For example, if a window group includes many southern facing windows in the northern hemisphere, a heat load disturbance may be determined to increase a temperature of the space and a brightness value of the space may be determined to be high due to the sun at midday. Based on information regarding the window groups, results of solving the optimization problem may be required to include increased/decreased operation of building equipment to maintain occupant comfort. Further, if the shading equipment information is considered in step 1710, costs may be able to be reduced as operating the shading equipment may be less expensive than other building equipment. When solving the optimization problem, it can be determined how the shading equipment should be operated to maintain comfortable conditions (e.g., temperature, brightness, etc.) in the space. Of course, in a hierarchical approach, operation of the shading equipment (and/or other lighting equipment) can be determined prior to solving the optimization problem. In this case, operation of the shading equipment and/or the other lighting equipment can be used to determine a modified heat disturbance value used in solving the optimization problem. In some embodiments, step 1710 is performed by optimization problem solver 1012.

Process 1700 is shown to include generating control decisions based on results of solving the optimization problem (step 1712), according to some embodiments. In some embodiments, step 1712 is similar to and/or the same as step 1612 of process 1600. The results of the optimization problem can indicate how building equipment should be operated in order to maintain occupant comfort while optimizing (e.g., reducing) costs. As such, the control decisions generated in step 1712 extract said indications from the results as to be utilized for operating the building equipment. For example, a control decision may indicate for shading equipment of a window to be open throughout a day as to allow the space to be naturally lighted and heated by solar effects. In some embodiments, each control decision generated in step 1712 is associated with operation of a single device. In some embodiments, each control decision generated in step 1712 is associated with operation of multiple devices and/or is associated with multiple operations of one or more devices. In some embodiments, step 1712 is performed by control decision generator 1014.

Process 1700 is shown to include generating control decisions based on results of solving the optimization problem (step 1714), according to some embodiments. In some embodiments, step 1714 is similar to and/or the same as step 1614 of process 1600. A control signal can be communicated to a building device of the building equipment in order to operate the building device to affect a variable state or condition of the space. In some embodiments, each control signal includes a single instruction regarding operation of a building device. In some embodiments, each control signal includes multiple instructions regarding operation of the building device. In some embodiments, step 1714 is performed by BMS 606.

Process 1700 is shown to include operating the building equipment based on the control signals (step 1716), according to some embodiments. In some embodiments, step 1716 is similar to and/or the same as step 1616 of process 1600. By operating the building equipment based on the control signals generated in step 1714, conditions of the space can be adjusted to be comfortable to occupants. For example, a control signal may operate shading equipment to increase an amount of sunlight entering the space, thereby increasing a temperature of the space. In some embodiments, step 1714 is performed by building equipment 904.

CONFIGURATION OF EXEMPLARY EMBODIMENTS

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure can be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. An environmental control system for a building space, the system comprising:

heating, ventilation, or air conditioning (HVAC) equipment that operates to control a temperature of the building space by adding heat to the building space or removing heat from the building space;

lighting equipment that operates to control a luminosity of the building space and affects a heat load disturbance for the building space;

an environmental controller comprising a processing circuit configured to:

predict the heat load disturbance based on one or more potential operating states of the lighting equipment over a time period, the heat load disturbance affecting the temperature of the building space;

generate control decisions for the HVAC equipment and the lighting equipment by adjusting the control decisions for the lighting equipment to actively control the predicted heat load disturbance and coordinating the control decisions for the HVAC equipment with the control decisions for the lighting equipment based on a predicted effect of the control decisions for the lighting equipment on the predicted heat load disturbance; and operate the HVAC equipment and the lighting equipment based on the control decisions.

2. The system of claim 1, wherein the lighting equipment comprises shading equipment that operates to affect a portion of the heat load disturbance originating from an external space.

3. The system of claim 1, wherein generating the control decisions for the HVAC equipment and the lighting equipment comprises performing an optimization of an objective function that accounts for at least one of an amount of one or more resources consumed by the HVAC equipment and the lighting equipment or a cost of the one or more resources consumed by the HVAC equipment and the lighting equipment.

4. The system of claim 3, wherein the optimization comprises:

identifying one or more periods of time during which the building space is scheduled to be occupied based on an occupancy schedule for the building space; and predicting a portion of the heat load disturbance caused by occupants in the building space during the one or more periods of time.

5. The system of claim 1, wherein predicting the heat load disturbance comprises:

determining one or more weather conditions outside the building space, the one or more weather conditions comprising at least one of a forecast of cloud cover or a forecast of solar intensity; and predicting a portion of the heat load disturbance caused by the one or more weather conditions.

6. The system of claim 1, wherein the processing circuit is configured to:

predict the luminosity of the building space based on the control decisions for the lighting equipment, the lighting equipment comprising electric lights that operate to affect the luminosity of the building space, wherein the heat load disturbance comprises heat emitted due to operation of the electric lights; and predict the temperature of the building space based on the control decisions for the HVAC equipment and the control decisions for the lighting equipment.

7. The system of claim 1, wherein predicting the heat load disturbance comprises:

determining a number of occupants in the building space based on presence data from one or more occupancy sensors associated with the building space; and estimating a portion of the heat load disturbance based on the number of occupants in the building space.

8. A method for operating heating, ventilation, or air conditioning (HVAC) equipment and lighting equipment of a building space, the method comprising:

predicting a heat load disturbance based on one or more potential operating states of the lighting equipment over a time period, the heat load disturbance affecting a temperature of the building space, wherein the lighting equipment operates to control a luminosity of the building space and affect the heat load disturbance;

generating, in a coordinated manner, control decisions for the HVAC equipment and the lighting equipment based on the predicted heat load disturbance and subject to constraints on the temperature of the building space and the luminosity of the building space over the time period by adjusting the control decisions for the HVAC equipment and the lighting equipment based on a predicted effect of the control decisions for the lighting equipment on the predicted heat load disturbance, wherein the HVAC equipment operates to control the temperature of the building space by adding heat to the building space or removing heat from the building space; and operating the HVAC equipment and the lighting equipment based on the control decisions.

9. The method of claim 8, wherein the lighting equipment comprises shading equipment that operates to affect a portion of the heat load disturbance originating from an external space.

10. The method of claim 8, wherein generating the control decisions for the HVAC equipment and the lighting equipment comprises performing an optimization of an objective function that accounts for at least one of an amount of one or more resources consumed by the HVAC equipment and the lighting equipment or a cost of the one or more resources consumed by the HVAC equipment and the lighting equipment.

11. The method of claim 10, wherein the optimization comprises:

identifying one or more periods of time during which the building space is scheduled to be occupied based on an occupancy schedule for the building space; and predicting a portion of the heat load disturbance caused by occupants in the building space during the one or more periods of time.

12. The method of claim 8, wherein predicting the heat load disturbance comprises:

determining one or more weather conditions outside the building space, the one or more weather conditions comprising at least one of a forecast of cloud cover or a forecast of solar intensity; and predicting a portion of the heat load disturbance caused by the one or more weather conditions.

13. The method of claim 8, further comprising:

predicting the luminosity of the building space based on the control decisions for the lighting equipment, the lighting equipment comprising electric lights that operate to affect the luminosity of the building space, wherein the heat load disturbance comprises heat emitted due to operation of the electric lights; and predicting the temperature of the building space based on the control decisions for the HVAC equipment and the control decisions for the lighting equipment.

14. The method of claim 8, wherein predicting the heat load disturbance comprises:

determining a number of occupants in the building space based on presence data from one or more occupancy sensors associated with the building space; and estimating a portion of the heat load disturbance based on the number of occupants in the building space.

15. An environmental controller for a building space, the controller comprising:

one or more processors; and one or more non-transitory computer-readable media storing instructions that, when executed by the one or more processors, cause the one or more processors to perform operations comprising:

predicting a heat load disturbance affecting a temperature of the building space based on an operational state of lighting equipment;

generating control decisions for both the lighting equipment and heating, ventilation, or air conditioning (HVAC) equipment by performing a coordinated control process comprising coordinating control of the HVAC equipment and the lighting equipment by adjusting the control decisions for the lighting equipment to affect the heat load disturbance and adjusting the control decisions for the HVAC equipment based on a predicted effect of the control decisions for the lighting equipment on the predicted heat load disturbance; and operating the lighting equipment and the HVAC equipment based on the control decisions for the lighting equipment and the control decisions for the HVAC equipment.

16. The controller of claim 15, wherein:

the lighting equipment comprises at least one of shading equipment or electric lights;

the shading equipment operates to affect an amount of solar radiation affecting the building space; and the electric lights operate to affect the luminosity of the building space.

17. The controller of claim 15, the operations further comprising determining a modified heat load disturbance value based on the predicted heat load disturbance and the predicted effect of the control decisions for the lighting equipment, wherein the control decisions for the HVAC equipment are generated based on the modified heat load disturbance value.

18. The controller of claim 15, wherein the control decisions for the lighting equipment are generated to proactively influence the heat load disturbance while maintaining a luminosity in the building space within a predetermined range.

19. The controller of claim 15, wherein the coordinated control process comprises performing an optimization of an objective function to generate the control decisions for both the lighting equipment and the HVAC equipment as results of the optimization, the objective function accounting for at least one of:

an amount of one or more resources consumed by the HVAC equipment and the lighting equipment; or a cost of the one or more resources consumed by the HVAC equipment and the lighting equipment.

20. The controller of claim 15, the operations further comprising:

identifying one or more periods of time during which the building space is scheduled to be occupied based on an occupancy schedule for the building space; and predicting a portion of the heat load disturbance caused by occupants in the building space during the one or more periods of time.

* * * * *